US009212825B2

(12) United States Patent
Wakamoto et al.

(10) Patent No.: US 9,212,825 B2
(45) Date of Patent: Dec. 15, 2015

(54) AIR CONDITIONER

(75) Inventors: Shinichi Wakamoto, Tokyo (JP); Koji Yamashita, Tokyo (JP); Takashi Okazaki, Tokyo (JP); Naoki Tanaka, Tokyo (JP); Keisuke Hokazono, Tokyo (JP); Hiroyuki Morimoto, Tokyo (JP); Yuji Motomura, Tokyo (JP); Takeshi Hatomura, Tokyo (JP); Tomohiko Kasai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 894 days.

(21) Appl. No.: 12/990,568

(22) PCT Filed: Nov. 17, 2008

(86) PCT No.: PCT/JP2008/070841

§ 371 (c)(1),
(2), (4) Date: Jan. 12, 2011

(87) PCT Pub. No.: WO2009/133644

PCT Pub. Date: Nov. 5, 2009

(65) Prior Publication Data

US 2011/0113802 A1 May 19, 2011

(30) Foreign Application Priority Data

Apr. 30, 2008 (JP) ..... 2008-119073

(51) Int. Cl.
*F25B 41/00* (2006.01)
*F24F 3/06* (2006.01)
(Continued)

(52) U.S. Cl.
CPC . *F24F 3/06* (2013.01); *F25B 13/00* (2013.01); *F24F 2011/0084* (2013.01);
(Continued)

(58) Field of Classification Search
CPC . F24F 3/06; F24F 2011/0084; F24F 2221/54; F25B 13/00; F25B 2400/23; F05B 13/00; F05B 400/23; F05B 2313/0272; F05B 1/10; F05B 2313/006; F05B 2400/0401; F05B 2313/0231; F05B 25/005; F05B 2400/14; F05B 2313/02741
USPC ..... 62/96.1, 335, 324.6, 99, 159, 160
See application file for complete search history.

(56) References Cited

U.S. PATENT DOCUMENTS 4,235,079 A 11/1980 Masser
4,944,158 A * 7/1990 Akiike et al. ..... 62/81
(Continued)

FOREIGN PATENT DOCUMENTS

EP 1643193 A2 * 5/2006 ..... F24F 3/06
JP 59-91566 U 6/1984
(Continued)

OTHER PUBLICATIONS

Japanese Office Action Issued Dec. 18, 2012 in Patent Application No. 2011-512288 (with English translation).
(Continued)

*Primary Examiner* — M. Alexandra Elve
*Assistant Examiner* — Larry Furdge
(74) *Attorney, Agent, or Firm* — Oblon, McClelland, Maier & Neustadt, L.L.P.

(57) ABSTRACT

A multi-chamber air conditioner including a heat-source side refrigerant circuit in which a compressor, an outdoor heat exchanger, a first heat exchanger, a refrigerant flow-rate controller, and a second heat exchanger are connected in series, a first use-side refrigerant circuit in which the first heat exchanger and an indoor heat exchanger are connected in series, and a second use-side refrigerant circuit in which the second heat exchanger and the indoor heat exchanger are connected in series, and a heat-source side refrigerant circulating in the heat-source side refrigerant circuit and a use-side refrigerant circulating in the use-side refrigerant circuit are heat-exchanged in the first heat exchanger. The heat-source side refrigerant circulating in the heat-source side refrigerant circuit and the use-side refrigerant circulating in the use-side refrigerant circuit are heat-exchanged in the second heat exchanger.

15 Claims, 17 Drawing Sheets

(51) Int. Cl.

| | |
|---|---|
| ***F25B 13/00*** | (2006.01) |
| *F24F 11/00* | (2006.01) |
| *F25B 1/10* | (2006.01) |
| *F25B 25/00* | (2006.01) |

(52) U.S. Cl.

CPC ..... *F24F 2221/54* (2013.01); *F25B 1/10* (2013.01); *F25B 25/005* (2013.01); *F25B 2313/006* (2013.01); *F25B 2313/0231* (2013.01); *F25B 2313/0272* (2013.01); *F25B 2313/02741* (2013.01); *F25B 2400/0401* (2013.01); *F25B 2400/14* (2013.01); *F25B 2400/23* (2013.01)

(56) References Cited

U.S. PATENT DOCUMENTS

| | | | | |
|---|---|---|---|---|
| 5,063,752 | A | 11/1991 | Nakamura et al. | |
| 5,103,650 | A * | 4/1992 | Jaster | 62/198 |
| 5,156,014 | A * | 10/1992 | Nakamura et al. | 62/160 |
| 5,237,833 | A | 8/1993 | Hayashida et al. | |
| 6,170,270 | B1 | 1/2001 | Arshansky et al. | |
| 6,185,956 | B1 * | 2/2001 | Brasz | 62/498 |
| 6,237,356 | B1 * | 5/2001 | Hori et al. | 62/324.1 |
| 6,250,099 | B1 * | 6/2001 | Furuya et al. | 62/473 |
| 6,966,194 | B2 * | 11/2005 | Yokozeki et al. | 62/196.3 |
| 2002/0023448 | A1 | 2/2002 | Ito et al. | |
| 2004/0003622 | A1 | 1/2004 | Negishi et al. | |
| 2006/0070719 | A1 * | 4/2006 | Kim et al. | 165/61 |
| 2006/0083628 | A1 * | 4/2006 | Kanai et al. | 417/269 |
| 2006/0137381 | A1 * | 6/2006 | Choi et al. | 62/324.1 |
| 2006/0191286 | A1 * | 8/2006 | Park et al. | 62/434 |
| 2007/0137230 | A1 * | 6/2007 | Bae et al. | 62/198 |
| 2007/0209779 | A1 * | 9/2007 | Shinmura et al. | 165/42 |

FOREIGN PATENT DOCUMENTS

| | | | | |
|---|---|---|---|---|
| JP | 02 118372 | | 5/1990 | |
| JP | 3 17475 | | 1/1991 | |
| JP | 5-256533 | | 10/1993 | |
| JP | 5-280818 | | 10/1993 | |
| JP | 6-337138 | | 12/1994 | |
| JP | 7 91753 | | 4/1995 | |
| JP | 2705031 | B2 | 1/1998 | |
| JP | 2001 289465 | | 10/2001 | |
| JP | 2002 323274 | | 11/2002 | |
| JP | 2003 307358 | | 10/2003 | |
| JP | 2003307358 | A * | 10/2003 | F25B 1/00 |
| JP | 2003 343936 | | 12/2003 | |
| JP | 2004 53069 | | 2/2004 | |
| JP | 2004 60956 | | 2/2004 | |
| JP | 2004044948 | A * | 2/2004 | |
| JP | 2004053069 | A * | 2/2004 | F25B 1/00 |
| JP | 2005 140444 | | 6/2005 | |
| JP | 2005249258 | A * | 9/2005 | F25B 1/00 |
| JP | 2006 3079 | | 1/2006 | |
| JP | 2006029744 | A * | 2/2006 | F24F 5/00 |
| JP | 2006-125790 | A | 5/2006 | |
| JP | 2006-145144 | A * | 6/2006 | F25B 1/00 |
| JP | 2007 183045 | | 7/2007 | |
| JP | 2007 255889 | | 10/2007 | |

OTHER PUBLICATIONS

Office Action issued Jan. 28, 2013, in Chinese Patent Application No. 2008801289327 with English translation.

Office Action issued Jul. 3, 2012, in Chinese Patent Application No. 200880128932.7 with English translation.

Office Action issued Aug. 14, 2012, in Japanese Patent Application No. 2010-509999 with English translation.

International Search Report issued Jan. 6, 2009 in PCT/JP08/070841 filed Nov. 17, 2008.

U.S. Appl. No. 12/990,391, filed Jan. 10, 2011, Wakamoto et al.

U.S. Appl. No. 13/266,182, filed Oct. 25, 2011, Wakamoto et al.

Office Action issued Aug. 13, 2013, in Japanese Patent Application No. 2011-512288 with English translation.

European Search Report issued in Application No. 08874121.0 on Feb. 2, 2015.

* cited by examiner

AIR CONDITIONER

TECHNICAL FIELD

The present invention relates to an air conditioner using a refrigerating cycle and particularly to a multi-chamber type air conditioner provided with a plurality of indoor units and capable of a simultaneous operation of cooling/heating.

BACKGROUND ART

An air conditioner has been known in which an outdoor unit provided with a compressor and an outdoor heat exchanger, a plurality of indoor units having indoor heat exchangers, respectively, and a relay portion connecting the outdoor unit and the indoor unit are provided, and which is capable of a cooling operation (full-cooling operation mode) or a heating operation (full-heating operation mode) with all the plurality of indoor units at the same time and a cooling operation with one indoor unit and a heating operation with another indoor unit at the same time (a cooling main operation mode in which a cooling operation capacity is larger than a heating operation capacity or a heating main operation mode in which the heating operation capacity is larger than the cooling operation capacity).

As one of such air conditioners, "an air conditioner in which, a first branching portion, which is configured by switchably connecting one side of a plurality of indoor units to a first connection pipeline or a second connection pipeline and the other side of the plurality of indoor units are connected to a second branching portion, which is configured by connecting a second connection pipeline through a first flow-rate controller connected to the indoor unit the first branching portion and the second branching portion being connected through a second flow-rate controller, and a relay unit, in which the first branching portion, the second flow-rate controller, and the second branching portion are made to be built-in, is interposed between a heat source unit and the plurality of indoor units, and the heat source unit and the relay unit are connected to each other by extending the first and the second connection pipelines" is proposed (See patent Document 1, for example).

Also, "a refrigerating cycle device includes a first refrigerant cycle having at least a single compressor, at least a single outdoor heat exchanger, a first throttle device capable of changing an opening degree, a high-pressure pipeline and a low-pressure pipeline installed in a story direction of a building having several floors, and a second refrigerant cycle having a second throttle device capable of changing an opening degree, an indoor heat exchanger, a gas pipeline installed in a story direction of each floor, and a liquid pipeline and installed on a predetermined floor of a building. With the refrigerating cycle device, a first intermediate heat exchanger provided at a pipeline connected annularly to the high-pressure pipeline and performing heat exchange between the first refrigerant cycle and the second refrigerant cycle in a heating operation and a second intermediate heat exchanger provided at a pipeline connected annularly to the low-pressure pipeline and performing heat exchange between the first refrigerant cycle and the second refrigerant cycle in a cooling operation are provided" is proposed (See Patent Document 2, for example).

Patent Document 1: Japanese Unexamined Patent Application Publication No. 2-118372 (page 3, FIG. 1)

Patent Document 2: Japanese Unexamined Patent Application Publication No. 2003-343936 (page 5, FIG. 1)

DISCLOSURE OF INVENTION

Problems to be Solved by the invention

If a refrigerant used in a refrigerating cycle device such as an air conditioner leaks, an adverse effect on a human body or safety might be a problem depending on toxicity, flammability and the like of the refrigerant. Considering the situation, an allowable concentration of the refrigerant leaking into a room or the like where an indoor unit is installed is specified by an international standard. For example, an allowable concentration by the international standard of R410A, which is one of a fluorocarbon refrigerant, is 0.44 kg/m$^3$, an allowable concentration by the international standard of carbon dioxide ($CO_2$) is 0.07 kg/m$^3$, and an allowable concentration by the international standard of propane is 0.008 kg/m$^3$.

Since the air conditioner as described in Patent Document 1 is configured by a single refrigerant circuit, if the refrigerant leaks into a room or the like where the indoor unit is installed, all the refrigerant in the refrigerant circuit would leak into the room. Several tens kg or more of the refrigerant might be used in an air conditioner, and if the refrigerant leaks into the room where the indoor unit of such an air conditioner is installed, it is likely that the refrigerant concentration in the room or the like exceeds an allowable concentration specified by the international standard.

In the refrigerating cycle device as described in Patent Document 2, the heat-source side refrigerant circuit (a heat-source side refrigerant cycle) disposed in the outdoor unit and the branching unit is separated from a use-side refrigerant circuit (a use-side refrigerant cycle) disposed in the indoor unit and the branching unit, and the refrigerant which might leak into the room or the like can be reduced. However, in such refrigerating cycle device, in a heating operation, since the first refrigerant is heat-exchanged with the second refrigerant and cooled and then, returned to the high-pressure pipe, the indoor unit installed closer to the downstream side has a lower entropy of the first refrigerant, and heating capacity and heat exchange efficiency of the indoor unit are lowered. Similarly, in a cooling operation, the entropy of the first refrigerant is gradually raised, and cooling capacity and heat exchange efficiency of the indoor unit are lowered.

The present invention was made in order to solve the above problems and has an object to provide a multi-chamber type air conditioner capable of a simultaneous cooling and heating operation, in which a refrigerant for which an adverse effect on a human body is concerned is prevented from leaking into a room or the like where the indoor unit is installed.

Means for Solving the Problems

An air conditioner according to the present invention is provided with a heat-source side refrigerant circuit in which a compressor, an outdoor heat exchanger, a plurality of intermediate heat exchangers, and refrigerant flow-rate controllers disposed between each of the intermediate heat exchangers are connected in series and a plurality of use-side refrigerant circuits in which each of the plurality of intermediate heat exchangers and a plurality of indoor heat exchangers are connected in parallel, in which the compressor and the outdoor heat exchanger are disposed in an outdoor unit, the plurality of intermediate heat exchangers and the refrigerant flow-rate controllers are disposed in a relay portion, the plurality of indoor heat exchangers are disposed in each of the plurality of indoor units, and a heat-source side refrigerant circulating in the heat-source side refrigerant circuit and a use-side refrigerant circulating in the use-side refrigerant circuit perform heat exchange in the plurality of the intermediate heat exchangers.

An air conditioner according to the present invention is provided with a heat-source side refrigerant circuit in which a compressor, an outdoor heat exchanger, a plurality of intermediate heat exchangers, first refrigerant flow-rate controllers disposed between each of the intermediate heat exchangers, a second refrigerant flow-rate controller disposed on the inlet side of a first intermediate heat exchanger located on the upstream side in the plurality of intermediate heat exchangers, and a third refrigerant flow-rate controller disposed on the outlet side of a second intermediate heat exchanger located on the downstream side in the plurality of intermediate heat exchangers are connected in series and a plurality of use-side refrigerant circuits in which each of the plurality of intermediate heat exchangers and a plurality of indoor heat exchangers are connected in parallel, in which the compressor and the outdoor heat exchanger are disposed in an outdoor unit, the plurality of intermediate heat exchangers, the first refrigerant flow-rate controllers, the second refrigerant flow-rate controller, and the third refrigerant flow-rate controller are disposed in a relay portion, the plurality of indoor heat exchangers are disposed in each of an indoor units, and a heat-source side refrigerant circulating in the heat-source side refrigerant circuit and a use-side refrigerant circulating in the use-side refrigerant circuit perform heat exchange in the plurality of intermediate heat exchangers.

An air conditioner according to the present invention is provided with a heat-source side refrigerant circuit in which a compressor, an outdoor heat exchanger, a plurality of intermediate heat exchangers, and an expanding device refrigerant flow-rate controller disposed between each of the intermediate heat exchangers and constituted by an expansion power recovery portion for recovering expansion power in decompression of a heat-source side refrigerant and a compression portion for compressing the heat-source side refrigerant using the expansion power are connected in series and a plurality of use-side refrigerant circuits in which each of the plurality of intermediate heat exchangers and a plurality of indoor heat exchangers are connected in parallel, in which the compressor and the outdoor heat exchanger are disposed in an outdoor unit, the plurality of intermediate heat exchangers and the expanding device refrigerant flow-rate controller are disposed in a relay portion, the plurality of indoor heat exchangers are disposed in each of a plurality of indoor units, and a heat-source side refrigerant circulating in the heat-source side refrigerant circuit and a use-side refrigerant circulating in the use-side refrigerant circuit perform heat exchange in the plurality of intermediate heat exchangers.

Advantages

According to the air conditioner of the present invention, since the heat-source side refrigerant circuit and the use-side refrigerant circuit are made to be independent while the simultaneous cooling/heating operation is made capable, the heat-source side refrigerant does not leak into a space where the indoor unit is installed. Therefore, by using a highly safe refrigerant for the use-side refrigerant, adverse effect is not given to a human body.

According to the air conditioner of the present invention, in addition to the above effect, size reduction of the plurality of intermediate heat exchangers disposed in the relay portion (the first intermediate heat exchanger and the second intermediate heat exchanger) can be realized. Therefore, the relay portion where the intermediate heat exchangers are disposed can be made compact.

According to the air conditioner of the present invention, in addition to the above effects, the expansion power of the heat-source side refrigerant can be used for pressure rising of the heat-source side refrigerant, power in the compressor can be reduced, and refrigerating cycle efficiency is improved.

REFERENCE NUMERALS

Figure 1:
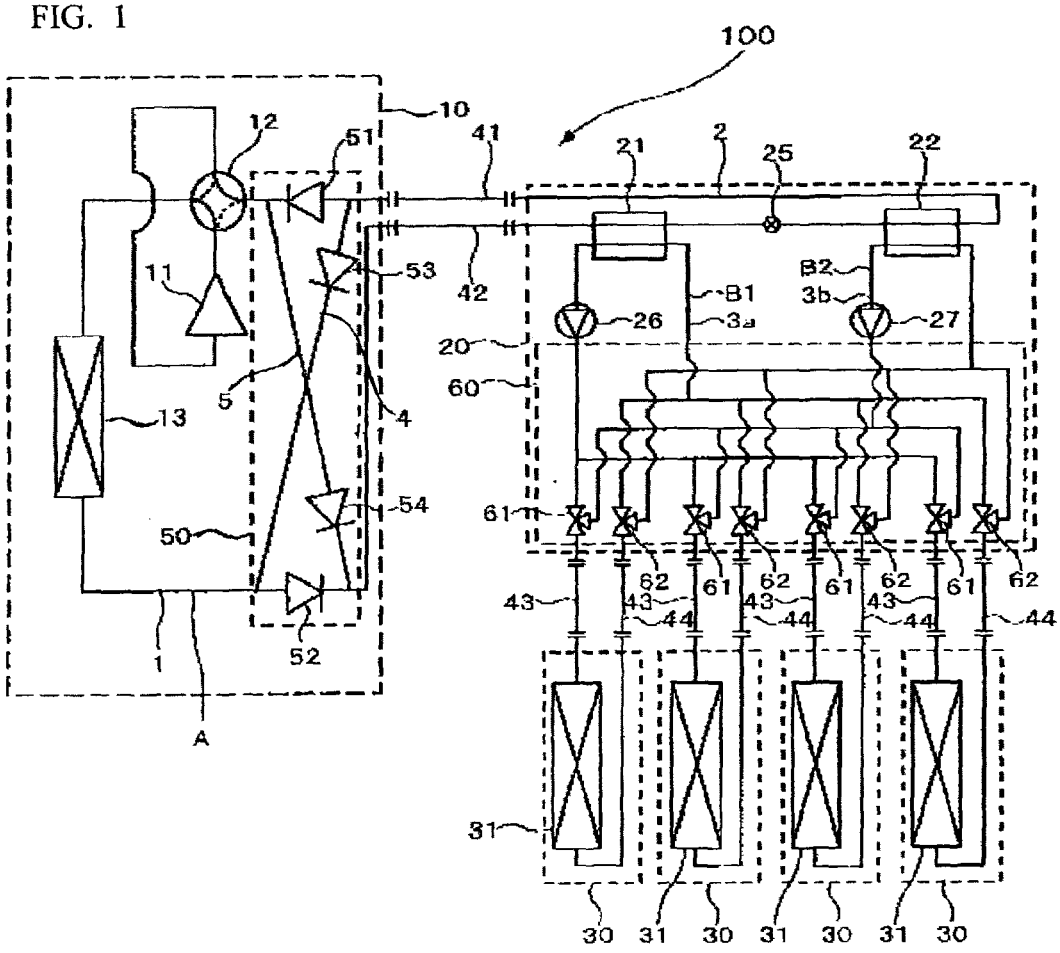
FIG. 1 is a circuit diagram illustrating a circuit configuration of an air conditioner according to Embodiment 1.

1 heat-source side refrigerant pipeline
2 heat-source side refrigerant pipeline
3 use-side refrigerant pipeline
3*a* first use-side refrigerant pipeline
3*b* second use-side refrigerant pipeline
4 first connection pipeline
5 second connection pipeline
10 outdoor unit
11 compressor
12 four-way valve
13 outdoor heat exchanger
20 relay portion
20*a* relay portion
20*b* relay portion
20*c* relay portion
20*d* relay portion
21 first intermediate heat exchanger
22 second intermediate heat exchanger
23 third intermediate heat exchanger
25 refrigerant flow-rate controller
25*a* first refrigerant flow-rate controller
25*b* second refrigerant flow-rate controller
25*c* third refrigerant flow-rate controller
26 first pump
27 second pump
28 second refrigerant flow-rate controller
30 indoor unit
30*a* indoor unit
30*b* indoor unit
30*c* indoor unit
30*d* indoor unit
31 indoor heat exchanger
41 first extension pipeline
42 second extension pipeline
43 third extension pipeline
44 fourth extension pipeline
45 bypass pipeline
46 bypass refrigerant flow-rate controller
47 gas-liquid separator
48 liquid-state refrigerant bypass pipeline
48A bypass pipeline
49 liquid-state refrigerant flow-rate controller
49A bypass refrigerant flow-rate controller
50 heat-source side refrigerant passage switching portion
51 check valve
52 check valve
53 check valve
54 check valve
60 use-side refrigerant passage switching portion
60*a* use-side refrigerant passage switching portion
61 first switching valve
61*a* first switching valve
61*b* first switching valve
61*c* first switching valve
61*d* first switching valve
62 second switching valve
62*a* second switching valve
62*b* second switching valve
62*c* second switching valve
62*d* second switching valve
63 third switching valve
64 fourth switching valve
65 use-side refrigerant passage switching portion
66*a* fifth switching valve
66*b* fifth switching valve
66*c* fifth switching valve
66*d* fifth switching valve
67*a* sixth switching valve
67*b* sixth switching valve
67*c* sixth switching valve
67*d* sixth switching valve
68*a* seventh switching valve
68*b* seventh switching valve
68*c* seventh switching valve
68*d* seventh switching valve
69*a* eighth switching valve
69*b* eighth switching valve
69*c* eighth switching valve
69*d* eighth switching valve
80 expanding device
81 expansion power recovery portion
82 compression portion
83 power transfer portion
85 compression portion bypass pipe
86 refrigerant flow-rate controller
90 first use-side refrigerant flow-rate control portion
91 first temperature sensor
91*a* first temperature sensor
91*b* first temperature sensor
92 second temperature sensor
92*a* second temperature sensor
92*b* second temperature sensor
93 inverter
93*a* inverter
93*b* inverter
95 second use-side refrigerant flow-rate control portion
96 indoor inflow-side temperature sensor
96*a* indoor inflow-side temperature sensor
96*b* indoor inflow-side temperature sensor
96*c* indoor inflow-side temperature sensor
96*d* indoor inflow-side temperature sensor
97 indoor outflow-side temperature sensor
97*a* indoor outflow-side temperature sensor
97*b* indoor outflow-side temperature sensor
97*c* indoor outflow-side temperature sensor
97*d* indoor outflow-side temperature sensor
98 flow-rate control valve
98*a* flow-rate control valve
98*b* flow-rate control valve
98*c* flow-rate control valve
98*d* flow-rate control valve
100 air conditioner
200 air conditioner
300 air conditioner
400 air conditioner
500 air conditioner
700 building
711 living space
712 living space
713 living space

721 common space
722 common space
713 common space
730 pipeline installation space
A heat-source side refrigerant circuit
B use-side refrigerant circuit
B1 first use-side refrigerant circuit
B2 second use-side refrigerant circuit

BEST MODE FOR CARRYING OUT THE INVENTION

Embodiments of the present invention will be described below based on the attached drawings.

Embodiment 1

FIG. 1 is a circuit diagram illustrating a circuit configuration of an air conditioner 100 according to Embodiment 1 of the present invention. The circuit configuration of the air conditioner 100 will be described based on FIG. 1. This air conditioner 100 is installed in a building, an apartment house and the like and capable of simultaneous supply of a cooling load and a heating load by using a refrigerating cycle (a heat-source side refrigerant circuit and a use-side refrigerant circuit) in which a refrigerant (a heat-source side refrigerant and a use-side refrigerant) is circulated. A relationship in sizes of constituent members in the following drawings including FIG. 1 can be different from actual ones.

As shown in FIG. 1, the air conditioner 100 is provided with a single outdoor unit 10, a plurality of indoor units 30, and a single relay portion 20 disposed between these units. Also, this air conditioner 100 is capable of performing a full-cooling operation mode in which all the indoor units 30 perform a cooling operation, a full-heating operation mode in which all the indoor units 30 perform a heating operation, a simultaneous cooling/heating operation mode in which a cooling load is larger than a heating load (hereinafter referred to as a cooling main operation mode), and a simultaneous cooling/heating operation mode in which the heating load is larger than the cooling load (hereinafter referred to as a heating main operation mode). The numbers of the outdoor units 10, the indoor units 30, and the relay portions 20 are not limited to the illustrated number.

The outdoor unit 10 has a function to supply cold heat to the indoor unit 30 through the relay portion 20. The indoor unit 30 is installed in a room having an area to be air-conditioned or the like and has a function to supply air for cooling or air for heating to the area to be air-conditioned. The relay portion 20 connects the outdoor unit 10 and the indoor unit 30 and has a function to transfer the cold heat supplied from the outdoor unit 10 to the indoor unit 30. That is, the outdoor unit 10 and the relay portion 20 are connected through a first intermediate heat exchanger 21 and a second intermediate heat exchanger 22 provided in the relay portion 20, and both the relay portion 20 and the indoor unit 30 are connected through the first intermediate heat exchanger 21 and the second intermediate heat exchanger 22 disposed in the relay portion 20. Configurations and functions of constituent devices will be described below.

[Outdoor Unit 10]

The outdoor unit 10 is constituted by a compressor 11, a four-way valve 12, which is a channel switching means, and an outdoor heat exchanger 13 connected in series by a heat-source side refrigerant pipeline 1. Also, a heat-source side refrigerant channel switching portion 50 constituted by a first connection pipeline 4, a second connection pipeline 5, a check valve 51, a check valve 52, a check valve 53, and a check valve 54 is disposed in the outdoor unit 10. This heat-source side refrigerant channel switching portion 50 has a function to direct a flow of the heat-source side refrigerant to flow into the relay portion 20 in a predetermined direction regardless of the operation being performed by the indoor unit 30. A configuration in which the heat-source side refrigerant channel switching portion 50 is provided is shown as an example, but the heat-source side refrigerant channel switching portion 50 does not have to be provided.

The check valve 51 is disposed in the heat-source side refrigerant pipeline 1 between the relay portion 20 and the four-way valve 12 and allows the flow of the heat-source side refrigerant only in a predetermined direction (direction from the relay portion 20 to the outdoor unit 10). The check valve 52 is disposed in the heat-source side refrigerant pipeline 1 between the outdoor heat exchanger 13 and the relay portion 20 and allows the flow of the heat-source side refrigerant only in a predetermined direction (direction from the outdoor unit 10 to the relay portion 20). The check valve 53 is disposed in the first connection pipeline 4 and allows communication of the heat-source side refrigerant only in a direction from the heat-source side refrigerant pipeline 1 connected to a first extension pipeline 41 to the heat-source side refrigerant pipeline 1 connected to a second extension pipeline 42. The check valve 54 is disposed in the second connection pipeline 5 and allows communication of the heat-source side refrigerant only in a direction from the heat-source side refrigerant pipeline 1 connected to the first extension pipeline 41 to the heat-source side refrigerant pipeline 1 connected to the second extension pipeline 42.

The first connection pipeline 4 connects the heat-source side refrigerant pipeline 1 on the upstream side of the check valve 51 and the heat-source side refrigerant pipeline 1 on the upstream side of the check valve 52 in the outdoor unit 10. The second connection pipeline 5 connects the heat-source side refrigerant pipeline 1 on the downstream side of the check valve 51 and the heat-source side refrigerant pipeline 1 on the downstream side of the check valve 52 in the outdoor unit 10. The first connection pipeline 4, the second connection pipeline 5, the check valve 51, the check valve 52, the check valve 53 disposed in the first connection pipeline 4, and the check valve 54 disposed in the second connection pipeline 5 constitute the heat-source side refrigerant channel switching portion 50.

The compressor 11 sucks the heat-source side refrigerant and compresses the heat-source side refrigerant into a high-temperature and high-pressure state and may be preferably constituted by an inverter compressor capable of volume control. The four-way valve 12 makes switching between a flow of the heat-source side refrigerant in the heating operation and the flow of the heat-source side refrigerant in the cooling operation. The outdoor heat exchanger 13 functions as an evaporator in the heating operation, functions as a condenser in the cooling operation, performs heat exchange between air supplied from a blower such as a fan, not shown, and the heat-source side refrigerant, and evaporates and gasifies or condenses and liquefies the heat-source side refrigerant. The heat-source side refrigerant channel switching portion 50 has a function to make the flow direction of the heat-source side refrigerant to flow into the relay portion 20 constant as mentioned above.

[Indoor Unit 30]

In the indoor unit 30, the indoor heat exchanger 31 is mounted. The indoor heat exchanger 31 is connected to a use-side refrigerant channel switching portion 60 disposed in the relay portion 20 through a third extension pipeline 43 and a fourth extension pipeline 44. The indoor heat exchanger 31 functions as a condenser in the heating operation, functions as an evaporator in the cooling operation, performs heat exchange between the air supplied from a blower such as a fan, not shown, and the use-side refrigerant (the use-side refrigerant will be described below in detail), and creates air for heating or air for cooling to be supplied to the area to be air-conditioned.

[Relay Portion 20]

In the relay portion 20, the first intermediate heat exchanger 21, a refrigerant flow-rate controller 25, and the second intermediate heat exchanger 22 are connected in series in order by a heat-source side refrigerant pipeline 2. Also, in the relay portion 20, a first pump 26, a second pump 27, and the use-side refrigerant channel switching portion 60 are disposed. The first intermediate heat exchanger 21, the first pump 26, and the use-side refrigerant channel switching portion 60 are connected in order by a first use-side refrigerant pipeline 3*a*, and the second intermediate heat exchanger 22, the second pump 27, and the use-side refrigerant channel switching portion 60 are connected in order by a second use-side refrigerant pipeline 3*b*. Also, the first use-side refrigerant pipeline 3*a* and the second use-side refrigerant pipeline 3*b* are connected to the third extension pipeline 43 and the fourth extension pipeline 44. In the following description, the first use-side refrigerant pipeline 3*a* and the second use-side refrigerant pipeline 3*b* might be collectively referred to as a use-side refrigerant pipeline 3 in some cases.

The first intermediate heat exchanger 21 and the second intermediate heat exchanger 22 function as a condenser or an evaporator, perform heat exchange between the heat-source side refrigerant and the use-side refrigerant, and supply cold to the indoor heat exchanger 31. The refrigerant flow-rate controller 25 functions as a decompression valve or an expansion valve and decompresses and expands the heat-source side refrigerant. The refrigerant flow-rate controller 25 may be preferably configured by a device capable of variable control of its opening degree such as an electronic expansion valve. The use-side refrigerant channel switching portion 60 supplies either one of the use-side refrigerant heat-exchanged at the first intermediate heat exchanger 21 or the use-side refrigerant heat-exchanged at the second intermediate heat exchanger 22 to the selected indoor unit 30. The use-side refrigerant channel switching portion 60 is provided with a plurality of water channel switching valves (first switching valves 61 and second switching valves 62).

The first switching valves 61 and the second switching valves 62 are disposed in the number according to the number of the indoor units 30 (here, four) connected to the relay portion 20. Also, the use-side refrigerant pipeline 3 is branched according to the number of the indoor units 30 (here, to four branches) connected to the relay portion 20 by the use-side refrigerant channel switching portion 60 and connects the use-side refrigerant channel switching portion 60 to the third extension pipeline 43 and the fourth extension pipeline 44 connected to each of the indoor units 30. That is, the first switching valves 61 and the second switching valves 62 are disposed in each of the branched use-side refrigerant pipelines 3.

The first switching valve 61 is disposed in the use-side refrigerant pipeline 3 between the first pump 26 as well as the second pump 27 and each indoor heat exchanger 31, that is, in the use-side refrigerant pipeline 3 on the inflow side of the indoor heat exchanger 31. The first switching valve 61 is configured by a three-way valve and connected to the first pump 26 and the second pump 27 through the use-side refrigerant pipeline 3 and also connected to the third extension pipeline 43 through the use-side refrigerant pipeline 3. Specifically, the first switching valve 61 connects the use-side refrigerant pipeline 3*a* and the use-side refrigerant pipeline 3*b* to the third extension pipeline 43 and switches a channel of the use-side refrigerant by being controlled.

The second switching valve 62 is disposed in the use-side refrigerant pipeline 3 between the indoor heat exchanger 31 and the first intermediate heat exchanger 21 as well as the second intermediate heat exchanger 22, that is, in the use-side refrigerant pipeline 3 on the outflow side of the indoor heat exchanger 31. The second switching valve 62 is configured by a three-way valve and is connected to the fourth extension pipeline 44 through the use-side refrigerant pipeline 3 and also connected to the first pump 26 and second pump 27 through the use-side refrigerants pipeline 3. Specifically, the second switching valve 62 connects the fourth extension pipeline 44 to the use-side refrigerant pipeline 3*a* and the use-side refrigerant pipeline 3*b* and switches the channel of the use-side refrigerant by being controlled.

The first pump 26 is disposed in the first use-side refrigerant pipeline 3*a* between the first intermediate heat exchanger 21 and the first switching valve 61 of the use-side refrigerant channel switching portion 60 and circulates the use-side refrigerant communicating through the first use-side refrigerant pipeline 3, the third extension pipeline 43, and the fourth extension pipeline 44. The second pump 27 is disposed in the second use-side refrigerant pipeline 3*b* between the second intermediate heat exchanger 22 and the first switching valve 61 of the use-side refrigerant channel switching portion 60 and circulates the use-side refrigerant communicating through the second use-side refrigerant pipeline 3*b*, the third extension pipeline 43, and the fourth extension pipeline 44. The types of the first bump 26 and the second pump 27 are not particularly limited but may be configured by those capable of volume control, for example.

In this air conditioner 100, the compressor 11, the four-way valve 12, the outdoor heat exchanger 13, the first intermediate heat exchanger 21, the refrigerant flow-rate controller 25, and the second intermediate heat exchanger 22 are connected in order in series by the heat-source side refrigerant pipeline 1, the first extension pipeline 41, the heat-source side refrigerant pipeline 2, and the second extension pipeline 42 and constitute a heat-source side refrigerant circuit A. Also, the first intermediate heat exchanger 21, the first pump 26, the first switching valve 61, the indoor heat exchanger 31, and the second switching valve 62 are connected in order in series by the first use-side refrigerant pipeline 3*a*, the third extension pipeline 43, and the fourth extension pipeline 44 and constitute a first use-side refrigerant circuit B1. Similarly, the second intermediate heat exchanger 21, the second pump 27, the first switching valve 61, the indoor heat exchanger 31, and the second switching valve 62 are connected in order in series by the second use-side refrigerant pipeline 3*b*, the third extension pipeline 43, and the fourth extension pipeline 44 and constitute a second use-side refrigerant circuit B2.

That is, in the air conditioner 100, the outdoor unit 10 and the relay portion 20 are connected through the first intermediate heat exchanger 21 and the second intermediate heat exchanger 22 disposed in the relay portion 20, and the relay portion 20 and the indoor unit 30 are connected through the use-side refrigerant channel switching portion 60 disposed in the relay portion 20 in configuration, and the heat-source side refrigerant circulating through the heat-source side refrigerant circuit A and the use-side refrigerant circulating through the first use-side refrigerant circuit B1 perform heat exchange in the first intermediate heat exchanger 21 and the heat-source side refrigerant circulating through the heat-source side refrigerant circuit A and the use-side refrigerant circulating through the second use-side refrigerant circuit B2 in the second intermediate heat exchanger 22, respectively. In the following description, the first use-side refrigerant circuit B1 and the second use-side refrigerant circuit B2 might be collectively referred to as a use-side refrigerant circuit B in some cases.

The first extension pipeline 41 and the second extension pipeline 42 connect the outdoor unit 10 and the relay portion 20 to each other through the heat-source side refrigerant pipeline 1 and the heat-source side refrigerant pipeline 2. The first extension pipeline 41 and the second extension pipeline 42 can be separated between the outdoor unit 10 and the relay portion 20 so that the outdoor unit 10 and the relay portion 20 can be separated from each other. Also, the third extension pipeline 43 and the fourth extension pipeline 44 connect the relay portion 20 and the indoor unit 30 through the use-side refrigerant pipeline 3. And the third extension pipeline 43 and the fourth extension pipeline 44 can be separated between the relay portion 20 and the indoor unit 30 so that the relay portion 20 and the indoor unit can be separated from each other.

Here, a type of the refrigerant used in the heat-source side refrigerant circuit A and the use-side refrigerant circuit B will be described. In the heat-source side refrigerant circuit A, a non-azeotropic mixed refrigerant such as R407C, a pseudo azeotropic mixed refrigerant such as R410A, or a single refrigerant such as R22 and the like can be used. Also, a natural refrigerant such as carbon dioxide, hydrocarbon and the like or a refrigerant with a global warming coefficient lower than that of R407C or R410A may be used. By using natural refrigerants or a refrigerant with a global warming coefficient is smaller than that of R407C or R410A such as a refrigerant mainly consisting of tetrafluoropropene, for example, an effect to suppress a greenhouse effect of the earth caused by refrigerant leakage can be obtained. Particularly, since carbon dioxide performs heat exchange without condensation in the supercritical state on the high pressure side, by providing the heat-source side refrigerant channel switching portion 50 as shown in FIG. 1 and arranging the heat-source side refrigerant circuit A and the use-side refrigerant circuit B in a counterflow style in the first intermediate heat exchanger 21 and the second intermediate heat exchanger 22, heat exchanger performances in heating water can be improved.

The use-side refrigerant circuit B is connected to the indoor heat exchanger 31 of the indoor unit 30 as mentioned above. Thus, in the air conditioner 100, a refrigerant with high safety is used for the use-side refrigerant, considering a situation in which the use-side refrigerant leaks into a room or the like in which the indoor unit 30 is installed. Therefore, for the use-side refrigerant, water and an antifreezing solution, a mixed liquid of water and the antifreezing solution, a mixed liquid of water and an additive with high anticorrosive effect and the like can be used. With this configuration, refrigerant leakage caused by freezing or corrosion can be prevented even at a low outside air temperature, and high reliability can be obtained. Also, if the indoor unit 30 is installed in a place where water should be avoided such as a computer room, a fluorine inactivated liquid with high thermal insulation can be used as the use-side refrigerant.

Here, each operation mode performed by the air conditioner 100 will be described. This air conditioner 100 is capable of a cooling operation or a heating operation in the indoor unit 30 on the basis of an instruction from each indoor unit 30. That is, in the air conditioner 100, all the indoor units 30 can perform the same operation and also, each of the indoor units 30 can perform a different operation. The four operation modes performed by the air conditioner 100, that is, a full-cooling operation mode, a full-heating operation mode, a cooling main operation mode, and a heating main operation mode will be described below along with the flow of the refrigerant.

[Full-cooling Operation Mode]

Figure 2:
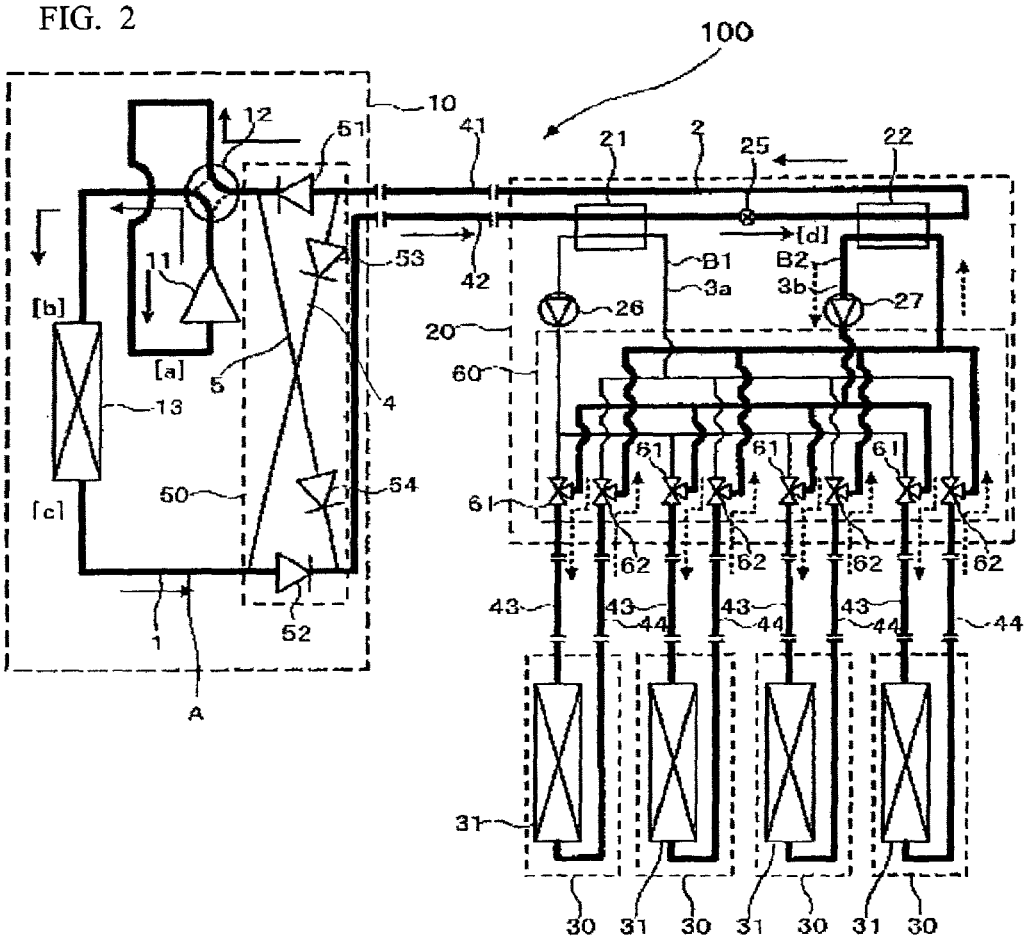
FIG. 2 is a refrigerant circuit diagram illustrating a refrigerant flow in a full-cooling operation mode of the air conditioner.
Figure 3:
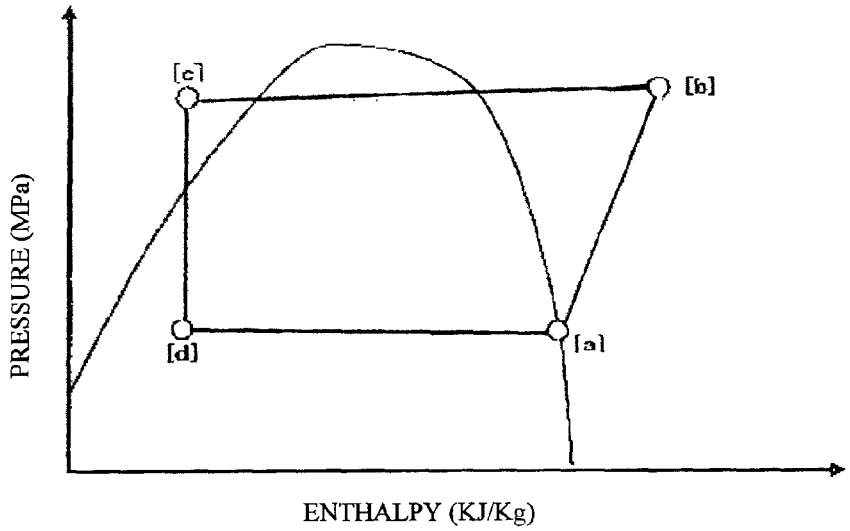
FIG. 3 is a p-h diagram illustrating a change of a heat-source side refrigerant in a cooling main operation mode.

FIG. 2 is a refrigerant circuit diagram illustrating a flow of the refrigerant in the full-cooling operation mode of the air conditioner 100. FIG. 3 is a p-h diagram (diagram illustrating a relationship between a pressure of the refrigerant and enthalpy) illustrating a change of the heat-source side refrigerant in the full-cooling operation mode. In FIG. 2, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [d] shown in FIG. 3 are refrigerant states at [a] to [d] shown in FIG. 2, respectively.

If all the indoor units 30 perform the cooling operation, in the outdoor unit 10, the four-way valve 12 is switched so that the heat-source side refrigerant discharged from the compressor 11 flows into the outdoor heat exchanger 13. In the relay portion 20, an opening degree of the refrigerant flow-rate controller 25 is throttled, the first pump 26 is stopped, the second pump 27 is driven, and the first switching valve 61 and the second switching valve 62 of the use-side refrigerant channel switching portion 60 are switched so that the use-side refrigerant circulates between the second intermediate heat exchanger 22 and each indoor unit 30. In this state, the operation of the compressor 11 is started.

First, a flow of the heat-source side refrigerant in the heat-source side refrigerant circuit A will be described. A low-temperature and low-pressure steam-state refrigerant is compressed by the compressor 11 and discharged as a high-temperature and high-pressure refrigerant.

Supposing that there is no heat coming in/going out with respect to the periphery, a refrigerant compression process of the compressor 11 is expressed by an isoentropic line shown from the point [a] to the point [b] in FIG. 3. The high-temperature and high-pressure refrigerant discharged from the compressor 11 goes through the four-way valve 12 and flows into the outdoor heat exchanger 13. Then, the refrigerant is condensed and liquefied while radiating heat to the outdoor air in the outdoor heat exchanger 13 so as to become a high-pressure liquid-state refrigerant. A change in the refrigerant in the outdoor heat exchanger 13 is made under a substantially constant pressure. The refrigerant change at this time is expressed by a slightly inclined straight line close to a horizontal line shown from the point [b] to the point [c] in FIG. 3, considering pressure loss in the outdoor heat exchanger 13.

The high-pressure liquid-state refrigerant flowing out of the outdoor heat exchanger 13 communicates through the second extension pipeline 42 via the heat-source side refrigerant channel switching portion 50 (check valve 52) and flows into the relay portion 20. The high-pressure liquid-state refrigerant having flown into the relay portion 20 goes through the first intermediate heat exchanger 21 and is throttled and expanded (decompressed) in the refrigerant flow-rate controller 25 and is brought to a gas-liquid two-phase state with low-temperature and low-pressure. The refrigerant change in the refrigerant flow-rate controller 25 is made under constant enthalpy. The refrigerant change at this time is expressed by a perpendicular line shown from the point [c] to the point [d] in FIG. 3.

The gas-liquid two-phase state refrigerant having been throttled by the refrigerant flow-rate controller 25 flows into the second intermediate heat exchanger 22. The refrigerant having flown into the second intermediate heat exchanger 22 absorbs heat from the use-side refrigerant circulating in the second use-side refrigerant circuit B2 and cools the use-side refrigerant, while the refrigerant becomes a low-temperature and low-pressure steam-state refrigerant. The refrigerant change at the second intermediate heat exchanger 22 is made under substantially constant pressure. The refrigerant change at this time is expressed by a slightly inclined straight line close to a horizontal line shown from the point [d] to the point [a] in FIG. 3, considering pressure loss in the second intermediate heat exchanger 22. The low-temperature and low-pressure steam-state refrigerant flowing out of the second intermediate heat exchanger 22 communicates through the first extension pipeline 41 and returns to the compressor 11 through the heat-source side refrigerant channel switching portion 50 (check valve 51) and the four-way valve 12.

Since the low-temperature and low-pressure steam-state refrigerant flowing into the compressor 11 communicates through the refrigerant pipeline, the pressure is slightly lowered as compared with the low-temperature and low-pressure steam-state refrigerant immediately after flowing out of the second intermediate heat exchanger 22, but it is expressed by the same point [a] in FIG. 3. Similarly, since the high-pressure liquid-state refrigerant flowing into the refrigerant flow-rate controller 25 communicates through the refrigerant pipeline, the pressure is slightly lowered as compared with the high-pressure liquid-state refrigerant flowing out of the outdoor heat exchanger 13, but it is expressed by the same point [c] in FIG. 3. Since the pressure loss of the refrigerant caused by the pipeline passage as above and the pressure loss in the outdoor heat exchanger 13, the first intermediate heat exchanger 21, and the second intermediate heat exchanger 22 are similar in the full-heating operation mode, the cooling main operation mode, and the heating main operation mode, the description will be omitted except when necessary.

Subsequently, the flow of the use-side refrigerant in the use-side refrigerant circuit B will be described. In the full-cooling operation mode, since the first pump 26 is stopped, the use-side refrigerant is circulated only in the second use-side refrigerant circuit B2. The use-side refrigerant cooled by the heat-source side refrigerant in the second intermediate heat exchanger 22 flows into the use-side refrigerant channel switching portion 60 by the second pump 27. The use-side refrigerant flowing into the use-side refrigerant channel switching portion 60 communicates through the use-side refrigerant pipeline 3, the first switching valve 61, and the third extension pipeline 43 and flows into each of the indoor heat exchangers 31. Then, the refrigerant absorbs heat from the indoor air in the indoor heat exchanger 31 and cools the area to be air-conditioned such as the inside of a room where the indoor unit 30 is installed. After that, the use-side refrigerants flowing out of the indoor heat exchangers 31 communicate through the fourth extension pipeline 44 and the second switching valve 62 and merge at the use-side refrigerant channel switching portion 60 and then flows into the second intermediate heat exchanger 22 again.

[Full-heating Operation Mode]

Figure 4:
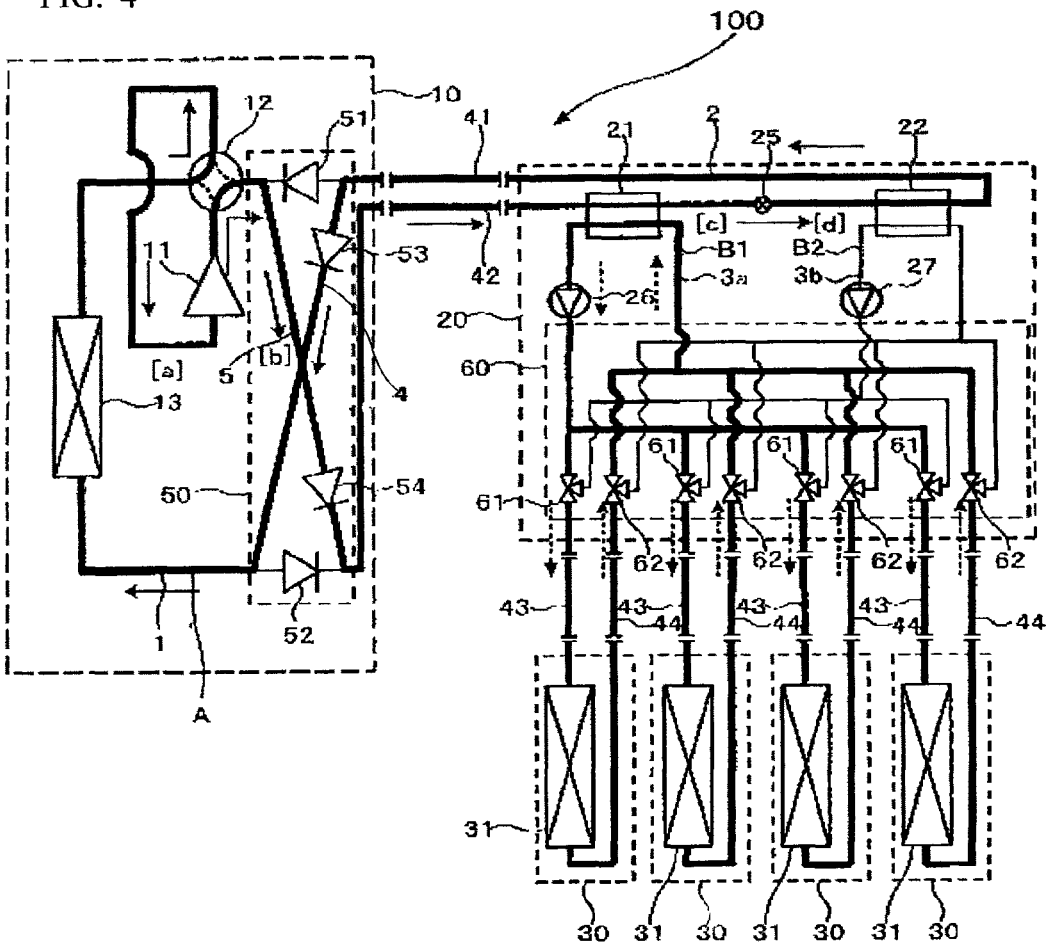
FIG. 4 is a refrigerant circuit diagram illustrating a refrigerant flow in a full-heating operation mode of the air conditioner.
Figure 5:
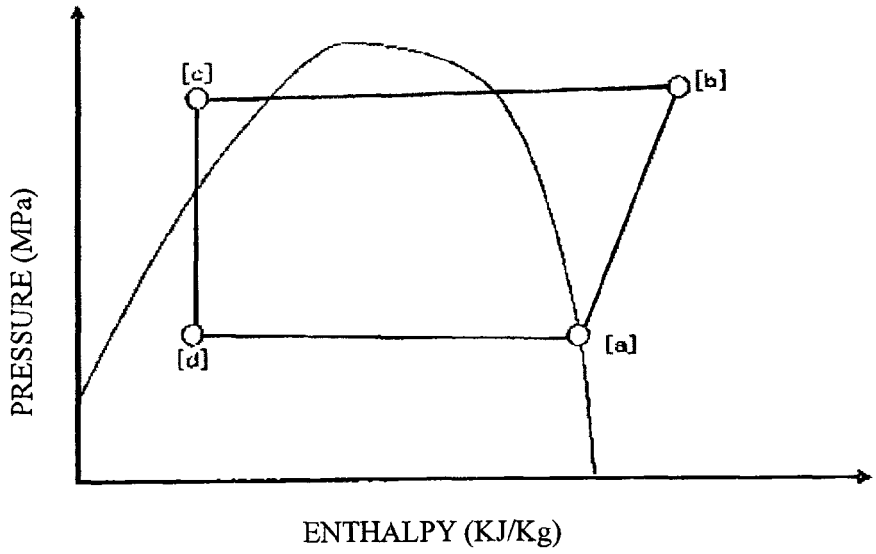
FIG. 5 is a p-h diagram illustrating a change of the heat-source side refrigerant in the full-heating operation mode.

FIG. 4 is a refrigerant circuit diagram illustrating a flow of the refrigerant in the full-heating operation mode of the air conditioner 100. FIG. 5 is a p-h diagram (a diagram illustrating a relationship between a pressure of the refrigerant and enthalpy) illustrating a change in the heat-source side refrigerant in the full-heating operation mode. In FIG. 4, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [d] shown in FIG. 5 are refrigerant states at [a] to [d] shown in FIG. 4, respectively.

If all the indoor units 30 perform the heating operation, in the outdoor unit 10, the four-way valve 12 is switched so that the heat-source side refrigerant discharged from the compressor 11 flows into the relay portion 20 without going through the outdoor heat exchanger 13. In the relay portion 20, an opening degree of the refrigerant flow-rate controller 25 is throttled, the first pump 26 is driven, the second pump 27 is stopped, and the first switching valve 61 and the second switching valve 62 of the use-side refrigerant channel switching portion 60 are switched so that the use-side refrigerant circulates between the first intermediate heat exchanger 21 and each indoor unit 30. In this state, the operation of the compressor 11 is started.

First, a flow of the heat-source side refrigerant in the heat-source side refrigerant circuit A will be described. A low-temperature and low-pressure steam-state refrigerant is compressed by the compressor 11 and discharged as a high-temperature and high-pressure refrigerant.

The refrigerant compression process of the compressor 11 is expressed by an isoentropoc line shown from the point [a] to the point [b] in FIG. 5. The high-temperature and high-pressure refrigerant discharged from the compressor 11 goes through the four-way valve 12 and the heat-source side refrigerant channel switching portion 50 (check valve 54), communicates through the second extension pipeline 42, and flows into first intermediate heat exchanger 21 of the relay portion 20. Then, the refrigerant flowing into the first intermediate heat exchanger 21 is condensed and liquefied while radiating heat to the use-side refrigerant circulating in the first use-side refrigerant circuit B1 and becomes a high-pressure liquid-state refrigerant. The refrigerant change at this time is expressed by a slightly inclined straight line close to a horizontal line shown from the point [b] to the point [c] in FIG. 5.

The high-pressure liquid-state refrigerant flowing out of the first intermediate heat exchanger 21 communicates through the heat-source side refrigerant pipeline 2, is throttled by the refrigerant flow-rate controller 25 and expanded (decompressed) and is brought into a low-temperature and low-pressure gas-liquid two-phase state. The refrigerant change at this time is expressed by a perpendicular line shown from the point [c] to the point [d] in FIG. 5. The gas-liquid two-phase refrigerant having been throttled by the refrigerant flow-rate controller 25 goes through the second intermediate heat exchanger 22, communicates through the heat-source side refrigerant pipeline 2 and the first extension pipeline 41, and flows into the outdoor unit 10. This refrigerant flows into the outdoor heat exchanger 13 through the heat-source side refrigerant channel switching portion 50 (check valve 53). Then the refrigerant absorbs heat from the outdoor air in the outdoor heat exchanger 13 and becomes a low-temperature and low-pressure steam-state refrigerant. The refrigerant change at this time is expressed by a slightly inclined straight line close to a horizontal line shown from the point [d] to the point [a] in FIG. 5. The low-temperature and low-pressure steam-state refrigerant flowing out of the outdoor heat exchanger 13 returns to the compressor 11 through the four-way valve 12.

Subsequently, a flow of the use-side refrigerant in the use-side refrigerant circuit B will be described. In the full-heating operation mode, since the second pump 27 is stopped, the use-side refrigerant is circulated only in the first use-side refrigerant circuit B1. The use-side refrigerant heated by the heat-source side refrigerant in the first intermediate heat exchanger 21 flows into the use-side refrigerant channel switching portion 60 by the first pump 26. The use-side refrigerant having flown into the use-side refrigerant channel switching portion 60 communicates through the use-side refrigerant pipeline 3, the first switching valve 61, and the third extension pipeline 43, and flows into each of the indoor heat exchangers 31. Then, the refrigerant radiates heat to the indoor air in the indoor heat exchanger 31 for heating the area to be air-conditioned such as the inside of a room where the indoor unit 30 is installed. After that, the use-side refrigerants flowing out of the indoor heat exchangers 31 communicate through the fourth extension pipeline 44 and the second switching valve 62, merge at the use-side refrigerant channel switching portion 60, and flows into the first intermediate heat exchanger 21 again.

[Cooling Main Operation Mode]

Figure 6:
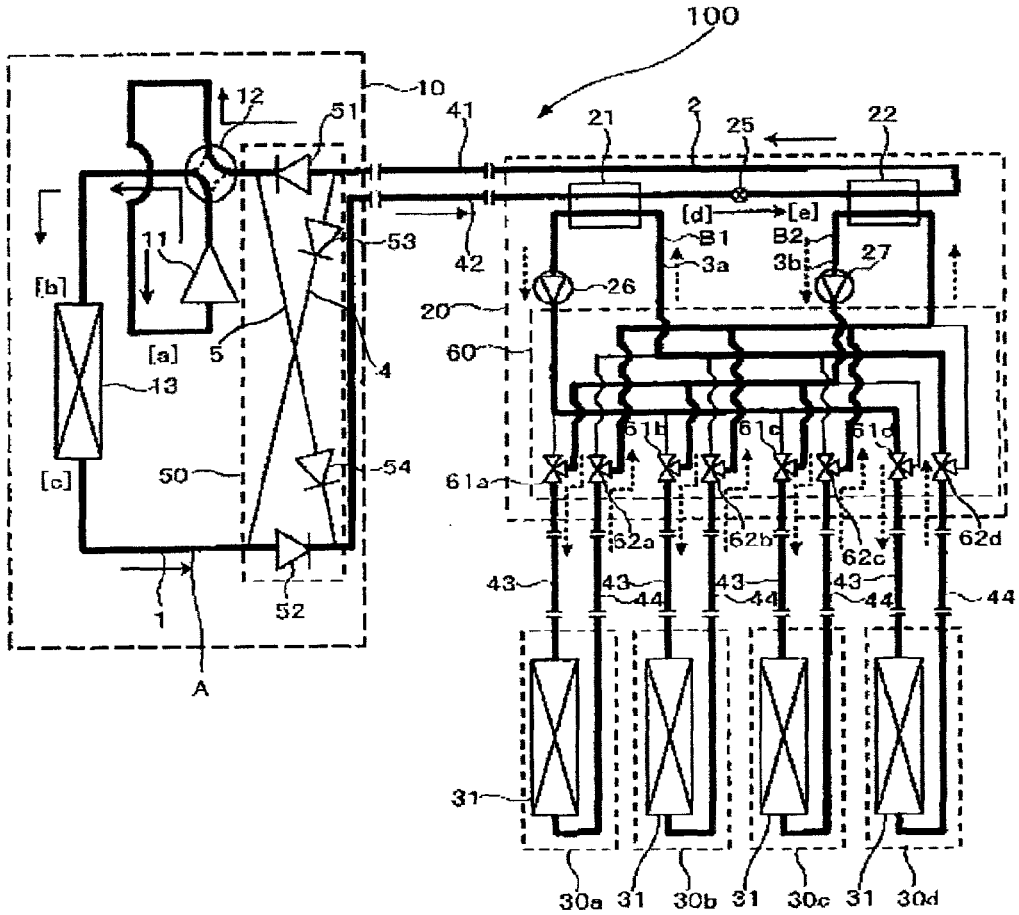
FIG. 6 is a refrigerant circuit diagram illustrating a refrigerant flow in the cooling main operation mode of the air conditioner.
Figure 7:
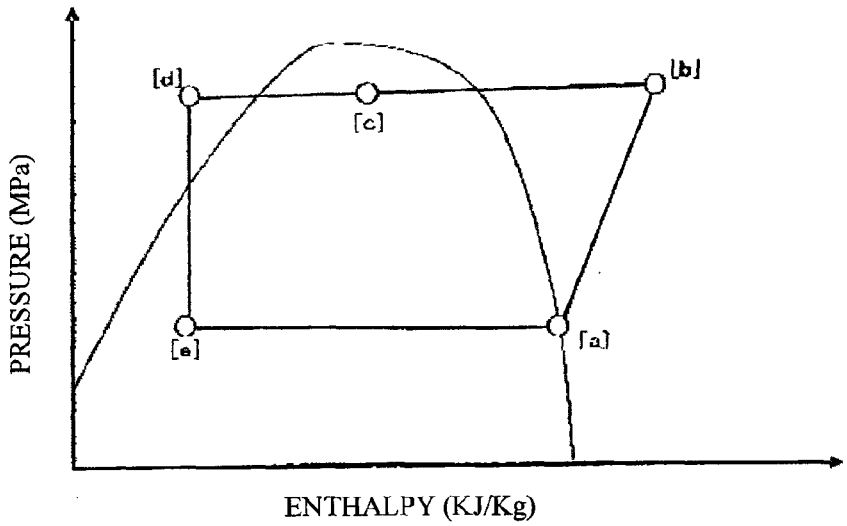
FIG. 7 is a p-h diagram illustrating a change of the heat-source side refrigerant in the cooling main operation mode.

FIG. 6 is a refrigerant circuit diagram illustrating a flow of the refrigerant in the cooling main operation mode of the air conditioner 100. FIG. 7 is a p-h diagram (diagram illustrating a relationship between a pressure of the refrigerant and enthalpy) illustrating a change of the heat-source side refrigerant in the cooling main operation mode. In FIG. 6, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [e] shown in FIG. 7 are refrigerant states at [a] to [e] shown in FIG. 6, respectively.

The cooling main operation mode is a simultaneous cooling/heating operation mode in which a cooling load is larger such that three indoor units 30 perform the cooling operation, while a single indoor unit 30 performs a heating operation. In FIG. 6, the three indoor units 30 performing the cooling operation are shown as an indoor unit 30*a*, an indoor unit 30*b*, and an indoor unit 30*c* from the left side on the drawing and the single indoor unit 30 on the right side on the drawing performing the heating operation as an indoor unit 30*d*. According to the indoor unit 30*a* to the indoor unit 30*d*, the first switching valves 61 connected to each of them are shown as a first switching valve 61*a* to a first switching valve 61*d*, and the second switching valve 62 connected to each of them as a second switching valve 62*a* to a second switching valve 62*d*.

If the indoor unit 30*a* to the indoor unit 30*c* perform the cooling operation and the indoor unit 30*d* performs the heating operation, in the outdoor unit 10, the four-way valve 12 is switched so that the heat-source side refrigerant discharged from the compressor 11 flows into the outdoor heat exchanger 13. In the relay portion 20, an opening degree of the refrigerant flow-rate controller 25 is throttled and the first pump 26 and the second pump 27 are driven. Also, in the use-side refrigerant channel switching portion 60 of the relay portion 20, the first switching valve 61*a* to the first switching valve 61*c* and the second switching valve 62*a* to the second switching valve 62*c* are switched so that the use-side refrigerant circulates between the second intermediate heat exchanger 22 and the indoor unit 30*a* to the indoor unit 30*c*, and the first switching valve 61*d* and the second switching valve 62*d* are switched so that the use-side refrigerant circulates between the first intermediate heat exchanger 21 and the indoor unit 30*d*. In this state, the operation of the compressor 11 is started.

First, a flow of the heat-source side refrigerant in the heat-source side refrigerant circuit A will be described. A low-temperature and low-pressure steam-state refrigerant is compressed by the compressor 11 and discharged as a high-temperature and high-pressure refrigerant.

The refrigerant compression process of the compressor 11 is expressed by an isoentropic line shown from the point [a] to the point [b] in FIG. 7. The high-temperature and high-pressure refrigerant discharged from the compressor 11 goes through the four-way valve 12 and flows into the outdoor heat exchanger 13. Then, the refrigerant is condensed and liquefied while radiating heat to the outdoor air in the outdoor heat exchanger 13 and becomes a high-pressure gas-liquid two-phase state refrigerant. The refrigerant change at this time is expressed by a slightly inclined straight line close to a horizontal line shown from the point [b] to the point [c] in FIG. 7.

The high-pressure gas-liquid two-phase refrigerant flowing out of the outdoor heat exchanger 13 communicates through the second extension pipeline 42 via the heat-source side refrigerant channel switching portion 50 (check valve 52) and flows into the relay portion 20. The high-pressure gas-liquid two-phase refrigerant having flown into the relay portion 20 is first condensed and liquefied while radiating heat to the use-side refrigerant circulating in the first use-side refrigerant circuit B1 in the first intermediate heat exchanger 21 and becomes a high-pressure liquid-state refrigerant. That is, the first intermediate heat exchanger 21 functions as a condenser. The refrigerant change at this time is expressed by a slightly inclined straight line close to a horizontal line shown from the point [c] to the point [d] in FIG. 7. The high-pressure liquid-state refrigerant flowing out of the first intermediate heat exchanger 21 is throttled and expanded (decompressed) by the refrigerant flow-rate controller 25 and brought into a low-temperature and low-pressure gas-liquid two-phase state. The refrigerant change at this time is expressed by a perpendicular line shown by the point [d] to the point [e] in FIG. 7.

The gas-liquid two-phase refrigerant having been throttled by the refrigerant flow-rate controller 25 flows into the second intermediate heat exchanger 22. The refrigerant having flown into the second intermediate heat exchanger 22 absorbs heat from the use-side refrigerant circulating in the second use-side refrigerant circuit B2 while cooling the use-side refrigerant and becomes a low-temperature and low-pressure steam-state refrigerant. That is, the second intermediate heat exchanger 22 functions as an evaporator. The refrigerant change at this time is expressed by a slightly inclined straight line close to a horizontal line shown from the point [e] to the point [a] in FIG. 7. The low-temperature and low-pressure steam-state refrigerant flowing out of the second intermediate heat exchanger 22 communicates through the heat-source side refrigerant pipeline 2 and the first extension pipeline 41 and returns to the compressor 11 through the heat-source side refrigerant channel switching portion 50 (check valve 51) and the four-way valve 12.

Subsequently, a flow of the use-side refrigerant in the use-side refrigerant circuit B will be described. In the cooling main operation mode, since the first pump 26 and the second pump 27 are being driven, both the first use-side refrigerant circuit B1 and the second use-side refrigerant circuit B2 circulate the use-side refrigerant. That is, both the first intermediate heat exchanger 21 and the second intermediate heat exchanger 22 are made to function. First, a flow of the use-side refrigerant in the first use-side refrigerant circuit B1 when the indoor unit 30*d* performs the heating operation will be described and then, a flow of the use-side refrigerant in the second use-side refrigerant circuit B2 when the indoor unit 30*a* to the indoor unit 30*c* perform the cooling operation will be described.

The use-side refrigerant heated by the heat-source side refrigerant in the first intermediate heat exchange 21 flows into the use-side refrigerant channel switching portion 60 by the first pump 26. The use-side refrigerant flowing into the use-side refrigerant channel switching portion 60 communicates through the first use-side refrigerant pipeline 3*a* and the third extension pipeline 43 connected to the first switching valve 61*d* and flows into the indoor heat exchanger 31 of the indoor unit 30*d*. Then, the refrigerant radiates heat to the indoor air in the indoor heat exchanger 31 and performs heating for the area to be air-conditioned such as the inside of a room where the indoor unit 30*d* is installed. After that, the use-side refrigerant flowing out of the indoor heat exchanger 31 flows out of the indoor unit 30*d*, communicates through the fourth extension pipeline 44 and the first use-side refrigerant pipeline 3*a* and flows into the first intermediate heat exchanger 21 through the use-side refrigerant channel switching portion 60 (second switching valve 62*d*) again.

On the other hand, the use-side refrigerant cooled by the heat-source side refrigerant in the second intermediate heat exchanger 22 flows into the use-side refrigerant channel switching portion 60 by the second pump 27. The use-side refrigerant flowing into the use-side refrigerant channel switching portion 60 communicates through the second use-side refrigerant pipeline 3*b* connected to the first switching valve 61*a* to the first switching valve 61*c* and the third extension pipeline 43 and flows into the indoor heat exchanger 31 of the indoor unit 30*a* to the indoor unit 30*c*. Then, the refrigerant absorbs heat from the indoor air in the indoor heat exchange 31 and performs cooling for the area to be air-conditioned such as the inside of a room where the indoor unit 30*a* to the indoor unit 30*c* are installed. After that, the use-side refrigerants flowing out of the indoor heat exchangers 31 flow out of the indoor unit 30*a* to the indoor unit 30*c*, communicate through the fourth extension pipeline 44, the second switching valve 62*a* to the second switching valve 62*c*, and the second use-side refrigerant pipeline 3*b*, and merge in the use-side refrigerant channel switching portion 60 and then, flow into the second intermediate heat exchanger 22 again.

[Heating Main Operation Mode]

Figure 8:
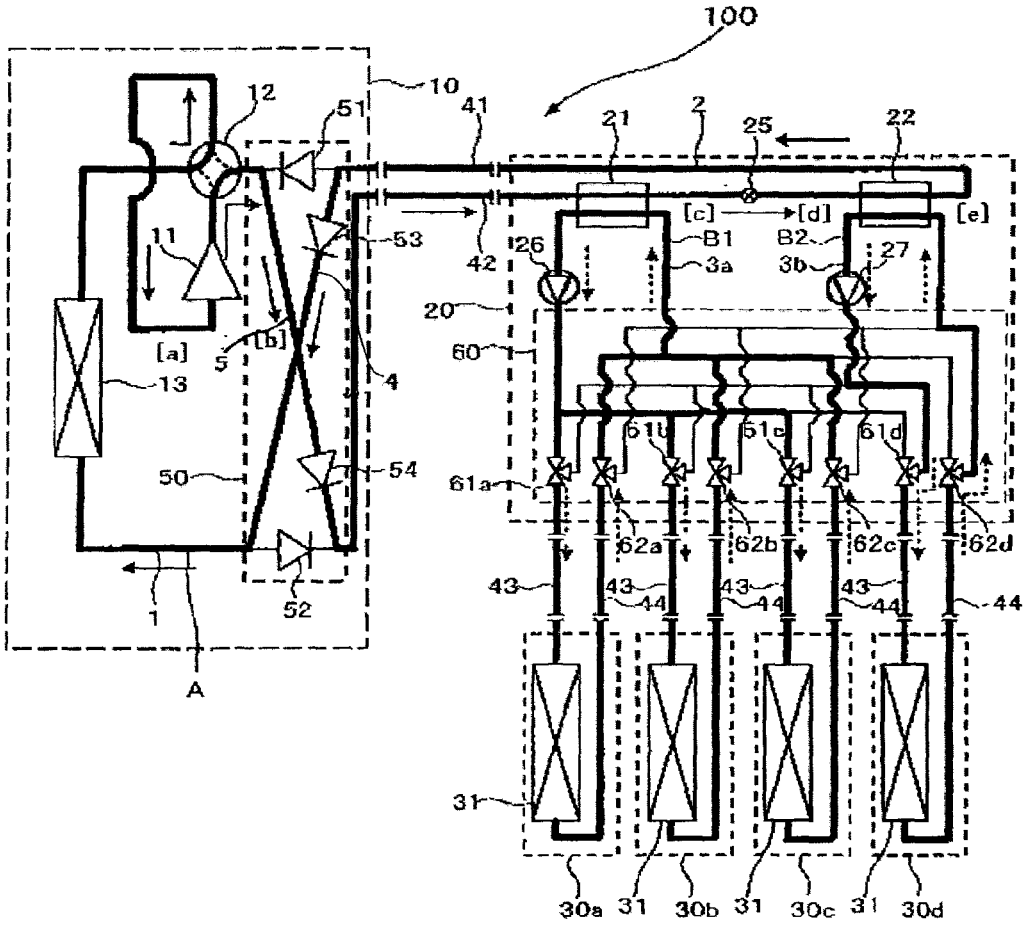
FIG. 8 is a refrigerant circuit diagram illustrating a refrigerant flow in a heating main operation mode of the air conditioner.
Figure 9:
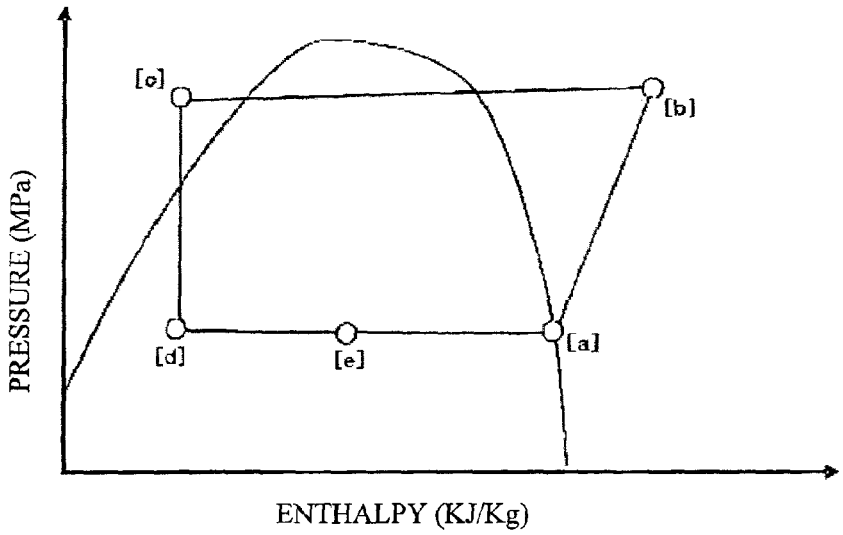
FIG. 9 is a p-h diagram illustrating a change of the heat-source side refrigerant in the heating main operation mode.

FIG. 8 is a refrigerant circuit diagram illustrating a flow of the refrigerant in the heating main operation mode of the air conditioner 100. FIG. 9 is a p-h diagram (diagram illustrating a relationship between a pressure of the refrigerant and enthalpy) illustrating a change of the heat-source side refrigerant in the heating main operation mode. In FIG. 8, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [e] shown in FIG. 9 are refrigerant states at [a] to [e] shown in FIG. 8, respectively.

The heating main operation mode is a simultaneous cooling/heating operation mode in which a heating load is larger such that three indoor units 30 perform the heating operation, while a single indoor unit 30 performs a cooling operation, for example. In FIG. 8, the three indoor units 30 performing the heating operation are shown as the indoor unit 30*a*, the indoor unit 30*b*, and the indoor unit 30*c* from the left side on the drawing and the single indoor unit 30 on the right side on the drawing performing the cooling operation as the indoor unit 30*d*. According to the indoor unit 30*a* to the indoor unit 30*d*, the first switching valves 61 connected to each of them are shown as the first switching valve 61*a* to the first switching valve 61*d*, and the second switching valves 62 connected to each of them as the second switching valve 62*a* to the second switching valve 62*d*.

If the indoor unit 30*a* to the indoor unit 30*c* perform the heating operation and the indoor unit 30*d* performs the cooling operation, in the outdoor unit 10, the four-way valve 12 is switched so that the heat-source side refrigerant discharged from the compressor 11 flows into the relay portion 20 without going through the outdoor heat exchanger 13. In the relay portion 20, an opening degree of the refrigerant flow-rate controller 25 is throttled, and the first pump 26 and the second pump 27 are driven. Also, in the use-side refrigerant channel switching portion 60 of the relay portion 20, the first switching valve 61*a* to the first switching valve 61*c* and the second switching valve 62*a* to the second switching valve 62*c* are switched so that the use-side refrigerant circulates between the first intermediate heat exchanger 21, and the indoor unit 30*a* to the indoor unit 30*c* and the first switching valve 61*d* and the second switching valve 62*d* are switched so that the use-side refrigerant circulates between the second intermediate heat exchanger 22 and the indoor unit 30*d*. In this state, the operation of the compressor 11 is started.

First, a flow of the heat-source side refrigerant in the heat-source side refrigerant circuit A will be described. A low-temperature and low-pressure steam-state refrigerant is compressed by the compressor 11 and discharged as a high-temperature and high-pressure refrigerant.

The refrigerant compression process of the compressor 11 is expressed by an isoentropic line shown from the point [a] to the point [b] in FIG. 9. The high-temperature and high-pressure refrigerant discharged from the compressor 11 goes through the four-way valve 12 and the heat-source side refrigerant channel switching portion 50 (check valve 54), communicates through the second extension pipeline 42, and flows into the first intermediate heat exchanger 21 of the relay portion 20. Then, the refrigerant having flown into the first intermediate heat exchanger 21 is condensed and liquefied while radiating heat to the use-side refrigerant circulating in the first use-side refrigerant circuit B1 and becomes a high-pressure liquid-state refrigerant. That is, the first intermediate heat exchanger 21 functions as a condenser. The refrigerant change at this time is expressed by a slightly inclined straight line close to a horizontal line shown from the point [b] to the point [c] in FIG. 9.

The high-pressure liquid-state refrigerant flowing out of the first intermediate heat exchanger 21 is throttled by the refrigerant flow-rate controller 25 and expanded (decompressed) and is brought to a low-temperature and low-pressure gas-liquid two-phase state. The refrigerant change at this time is expressed by a perpendicular line shown from the point [c] to the point [d] in FIG. 9. The gas-liquid two-phase refrigerant throttled by the refrigerant flow-rate controller 25 flows into the second intermediate heat exchanger 22. The refrigerant having flown into the second intermediate heat exchanger 22 absorbs heat from the use-side refrigerant circulating in the second use-side refrigerant circuit B2 while cooling the use-side refrigerant and becomes a low-temperature and low-pressure gas-liquid two-phase refrigerant. That is, the second intermediate heat exchanger 22 functions as an evaporator. The refrigerant change at this time is expressed by a slightly inclined straight line close to a horizontal line shown from the point [d] to the point [e] in FIG. 9.

The low-temperature and low-pressure gas-liquid two-phase refrigerant flowing out of the second intermediate heat exchanger 22 communicates through the heat-source side refrigerant pipeline 2 and the first extension pipeline 41 and flows into the outdoor unit 10. This refrigerant flows into the outdoor heat exchanger 13 through the heat-source side refrigerant channel switching portion 50 (check valve 53). Then, the refrigerant absorbs heat from the outdoor air in the outdoor heat exchanger 13 and becomes a low-temperature and low-pressure steam-state refrigerant. The refrigerant change at this time is expressed by a slightly inclined straight line close to a horizontal line shown from the point [e] to the point [a] in FIG. 9. The low-temperature and low-pressure steam-state refrigerant flowing out of the outdoor heat exchanger 13 returns to the compressor 11 through the four-way valve 12.

Subsequently, a flow of the use-side refrigerant in the use-side refrigerant circuit B will be described. In the heating main operation mode, since the first pump 26 and the second pump 27 are being driven, both the first use-side refrigerant circuit B1 and the second use-side refrigerant circuit B2 circulate the use-side refrigerant. That is, both the first intermediate heat exchanger 21 and the second intermediate heat exchanger 22 are made to function. First, a flow of the use-side refrigerant in the first use-side refrigerant circuit B1 when the indoor unit 30*a* to the indoor unit 30*c* perform the heating operation will be described and then, a flow of the use-side refrigerant in the second use-side refrigerant circuit B2 when the indoor unit 30*d* performs the cooling operation will be described.

The use-side refrigerant heated by the heat-source side refrigerant in the first intermediate heat exchange 21 flows into the use-side refrigerant channel switching portion 60 by the first pump 26. The use-side refrigerant flowing into the use-side refrigerant channel switching portion 60 communicates through the first use-side refrigerant pipeline 3*a* connected to the first switching valve 61*a* to the first switching valve 61*c* and the third extension pipeline 43 and flows into the indoor heat exchanger 31 of the indoor unit 30*a* to the indoor unit 30*c*. Then, the refrigerant radiates heat to the indoor air in the indoor heat exchanger 31 and performs heating for the area to be air-conditioned such as the inside of a room where the indoor unit 30*a* to the indoor unit 30*c* are installed. After that, the use-side refrigerants flowing out of the indoor heat exchangers 31 flow out of the indoor unit 30*a* to the indoor unit 30*c*, communicate through the fourth extension pipeline 44, the second switching valve 62*a* to the second switching valve 62*c*, and the first use-side refrigerant pipeline 3*a*, merge in the use-side refrigerant channel switching portion 60, and flow into the first intermediate heat exchanger 21 again.

On the other hand, the use-side refrigerant cooled by the heat-source side refrigerant in the second intermediate heat exchanger 22 flows into the use-side refrigerant channel switching portion 60 by the second pump 27. The use-side refrigerant flowing into the use-side refrigerant channel switching portion 60 communicates through the second use-side refrigerant pipeline 3*b* connected to the first switching valve 61*d* and the third extension pipeline 43 and flows into the indoor heat exchanger 31 of the indoor unit 30*d*. Then, the refrigerant absorbs heat from the indoor air in the indoor heat exchange 31 and performs cooling for the area to be air-conditioned such as the inside of a room where the indoor unit 30*d* is installed. After that, the use-side refrigerant flowing out of the indoor heat exchanger 31 flows out of the indoor unit 30*d*, communicates through the fourth extension pipeline 44, the second switching valve 62*d*, and the second use-side refrigerant pipeline 3*b* and flows into the second intermediate heat exchanger 22 through the use-side refrigerant channel switching portion 60 again.

According to the air conditioner 100 configured as above, since the use-side refrigerant such as water or an antifreezing solution circulates in the first use-side refrigerant circuit B1 and the second use-side refrigerant circuit B2 connected to the indoor unit 30 installed in a space where a human being is present (a living space, a space where a human goes in/out and the like), for example, the refrigerant for which an adverse effect on the human body or safety is concerned is prevented from leaking into the space where the human is present. Also, according to the air conditioner 100, since a circuit configuration which makes a simultaneous cooling/heating operation possible is disposed in the relay portion 20, the outdoor unit 10 and the relay portion 20 can be connected by two extension pipelines (the first extension pipeline 41 and the second extension pipeline 42) and the relay portion 20 and the indoor unit 30 by two extension pipelines (the third extension pipeline 43 and the fourth extension pipeline 44).

That is, it is only necessary to connect the outdoor unit 10 to the relay portion 20 and the relay portion 20 to the indoor unit 30 by the two extension pipelines, respectively, and costs of pipeline materials and the number of installation processes can be drastically reduced. In general, the outdoor unit is connected to the relay portion, and the relay portion is connected to the indoor unit by four extension pipelines, respectively, but according to the air conditioner 100 of Embodiment 1, since the number of extension pipelines can be reduced to the half, the costs of the pipelines can be drastically reduced. Also, particularly in the case of installation in a structure such as a building, a cost caused by a pipeline length can also be drastically reduced.

Moreover, since the refrigerant channel switching portion 50 is disposed in the outdoor unit 10, the heat-source side refrigerant discharged from the compressor 11 flows into the relay portion 20 through the second extension pipeline 42 all the time, and the heat-source side refrigerant flowing out of the relay portion 20 flows into the outdoor unit 10 through the first extension pipeline 41 all the time. Thus, in the first intermediate heat exchanger 21 and the second intermediate heat exchanger 22, since the heat-source side refrigerant circuit A and the use-side refrigerant circuit B are counterflows all the time, heat exchange efficiency is improved. Also, since the refrigerant channel switching portion 50 is disposed in the outdoor unit 10, the heat-source side refrigerant flowing out of the relay portion 20 goes through the first extension pipeline 41 all the time, a thickness of the first extension pipeline 41 can be reduced, and the cost of the pipeline can be further reduced.

According to the air conditioner 100, since the relay portion 20 and the indoor unit 30 can be separated in the configuration, conventional facilities using a water refrigerant can be reused. That is, by using existing indoor units and extension pipelines (extension pipelines corresponding to the third extension pipeline 43 and the fourth extension pipeline 44 according to Embodiment 1) and by connecting the relay portion 20 to them, the air conditioner 100 according to Embodiment 1 can be easily configured. Also, since the existing indoor units and extension pipelines can be reused, it is only necessary to install and connect only the relay portion 20 to become a common portion, and the inside of a room where the indoor unit is installed and the like is not affected.

That is, the relay portion 20 can be connected without restriction in construction.

According to the air conditioner 100 of Embodiment 1, since the refrigerant flow-rate controller 25 is disposed not in the indoor unit 30 but in the relay portion 20, vibration caused by an increase in the flow rate of the refrigerant flowing into the refrigerant flow-rate controller 25 and a refrigerant noise generated at this time is not transmitted into a room in which the indoor unit 30 is installed, and the silent indoor unit 30 can be provided. As a result, the air conditioner 100 does not give a sense of discomfort to a user in the room or the like where the indoor unit 30 is installed.

Figure 10:
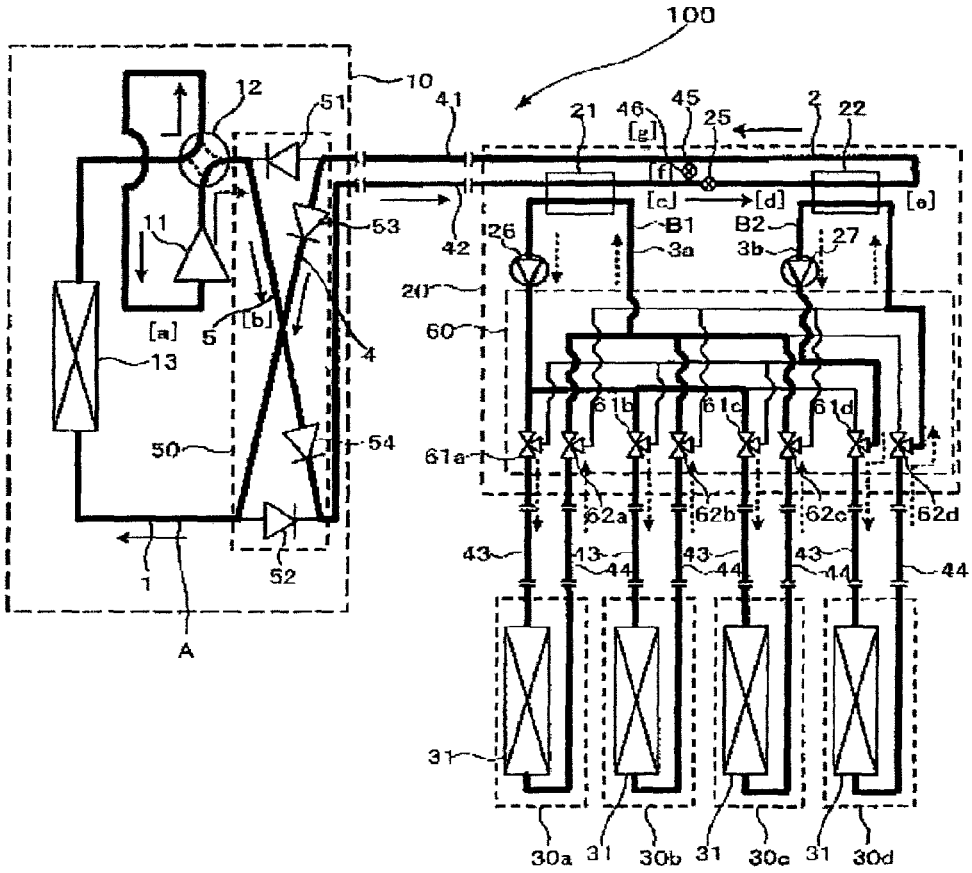
FIG. 10 is a circuit diagram illustrating another circuit configuration of the air conditioner.

FIG. 10 is a circuit diagram illustrating another circuit configuration of the air conditioner 100. On the basis of FIG. 10, another circuit configuration of the air conditioner 100 will be described. The air conditioner 100 shown in FIGS. 1 to 9 is configured such that all the heat-source side refrigerant having gone through the refrigerant flow-rate controller 25 flows into the second intermediate heat exchanger 22, but the air conditioner 100 shown in FIG. 10 is configured such that not all the heat-source side refrigerant flows into the second intermediate heat exchanger 22 but a part thereof is bypassed. FIG. 10 also shows a flow of the refrigerant in the heating main operation mode of the air conditioner 100. Also, in FIG. 10, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows.

As shown in FIG. 10, in the relay portion 20 of the air conditioner 100, a bypass pipeline 45 for bypassing the second intermediate heat exchanger 22 and a bypass refrigerant flow-rate controller 46 for controlling a flow rate of the heat-source side refrigerant communicating through the bypass pipeline 45 are disposed. The bypass pipeline 45 is disposed to connect the heat-source side refrigerant pipeline 2 between the first intermediate heat exchanger 21 and the refrigerant flow-rate controller 25 to the heat-source side refrigerant pipeline 2 between the second intermediate heat exchanger 22 and the outdoor unit 10. Also, the bypass refrigerant flow-rate controller 46 is disposed in the bypass pipeline 45. The heating main operation mode of the air conditioner 100 configured as above will be described together with the flow of the refrigerant.

Figure 11:
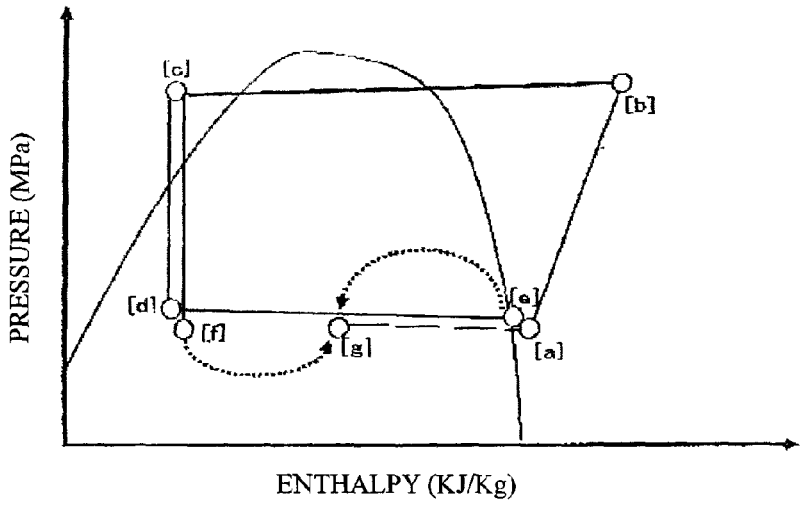
FIG. 11 is a p-h diagram illustrating a change of the heat-source side refrigerant in the heating main operation mode.

FIG. 11 is a p-h diagram (diagram illustrating a relationship between a pressure of the refrigerant and enthalpy) illustrating a change of the heat-source side refrigerant in the heating main operation mode. The refrigerant states at the point [a] to the point [g] shown in FIG. 11 are refrigerant states at [a] to [g] shown in FIG. 10, respectively. In FIG. 10, the three indoor units 30 performing the heating operation are shown as the indoor unit 30*a*, the indoor unit 30*b*, and the indoor unit 30*c* from the left side on the drawing and the single indoor unit 30 on the right side on the drawing performing the cooling operation as the indoor unit 30*d*. Moreover, according to the indoor unit 30*a* to the indoor unit 30*d*, the first switching valves 61 connected to each of them are shown as the first switching valve 61*a* to the first switching valve 61*d*, and the second switching valves 62 as the second switching valve 62*a* to the second switching valve 62*d*.

If the indoor unit 30*a* to the indoor unit 30*c* perform the heating operation and the indoor unit 30*d* performs the cooling operation, in the outdoor unit 10, the four-way valve 12 is switched similarly to the heating main operation mode described in FIG. 8. In the relay portion 20, similarly to the heating main operation mode described in FIG. 8, the refrigerant flow-rate controller 25, the first pump 26, the second pump 27, and the use-side refrigerant channel switching portion 60 (each of the first switching valves 61 and each of the second switching valves 62) are controlled, and the bypass refrigerant flow-rate controller 46 is controlled so as to throttle the opening degree. In this state, the operation of the compressor 11 is started.

With regard to the similar operation to the heating main operation mode described in FIG. 8, the description will be omitted.

A flow of the heat-source side refrigerant in the heat-source side refrigerant circuit A will be described. A part of the high-pressure liquid-state refrigerant flowing out of the first intermediate heat exchanger 21 is throttled by the refrigerant flow-rate controller 25 and expanded (decompressed) and brought into a low-temperature and low-pressure gas-liquid two-phase state. The refrigerant change at this time is expressed by a perpendicular line shown from the point [c] to the point [d] in FIG. 11. The gas-liquid two-phase refrigerant having been throttled by the refrigerant flow-rate controller 25 flows into the second intermediate heat exchanger 22, absorbs heat from the use-side refrigerant circulating in the second use-side refrigerant circuit B2 and becomes the low-temperature and low-pressure steam-state refrigerant while cooling the use-side refrigerant. The refrigerant change at this time is expressed by a slightly inclined straight line close to a horizontal line shown from the point [d] to the point [e] in FIG. 11.

On the other hand, the rest of the high-pressure liquid-state refrigerant flowing out of the first intermediate heat exchanger 21 flows into the bypass pipeline 45 and is throttled by the bypass refrigerant flow-rate controller 46 and expanded (decompressed). The refrigerant change at this time is expressed by a perpendicular line shown from the point [c] to the point [f] in FIG. 11. The refrigerant having been throttled by the bypass refrigerant flow-rate controller 46 merges with the steam-state refrigerant flowing out of the second intermediate heat exchanger 22, becomes a gas-liquid two-phase refrigerant and flows out of the relay portion 20. The gas-liquid two-phase refrigerant flows into the outdoor unit 10 and returns to the compressor 11 through the heat-source side refrigerant channel switching portion 50, the outdoor heat exchanger 13, and the four-way valve 12.

By configuring the air conditioner 100 as above, in addition to the effect of the air conditioner 100 described in FIGS. 1 to 9, pressure loss of the heat-source side refrigerant in the second intermediate heat exchanger 22 can be reduced in the heating main operation mode. Also, since the heat-source side refrigerant is brought into an overheated state on the outlet side of the second intermediate heat exchanger 22, by providing an overheat detector for measuring an overheat degree on the outlet side of the second intermediate heat exchanger 22 such as a temperature sensor and a pressure sensor for measuring a temperature and a pressure of the refrigerant, for example, or two temperature sensors for measuring the temperatures of the refrigerant at an inlet/an outlet of the second intermediate heat exchanger 22 and an overheat calculator for calculating the overheat degree, a flow rate of the heat-source side refrigerant flowing into the second intermediate heat exchanger 22 can be controlled by the overheat degree of the heat-source side refrigerant on the outlet side of the second intermediate heat exchanger 22, which is an effect that can be obtained.

Figure 13:
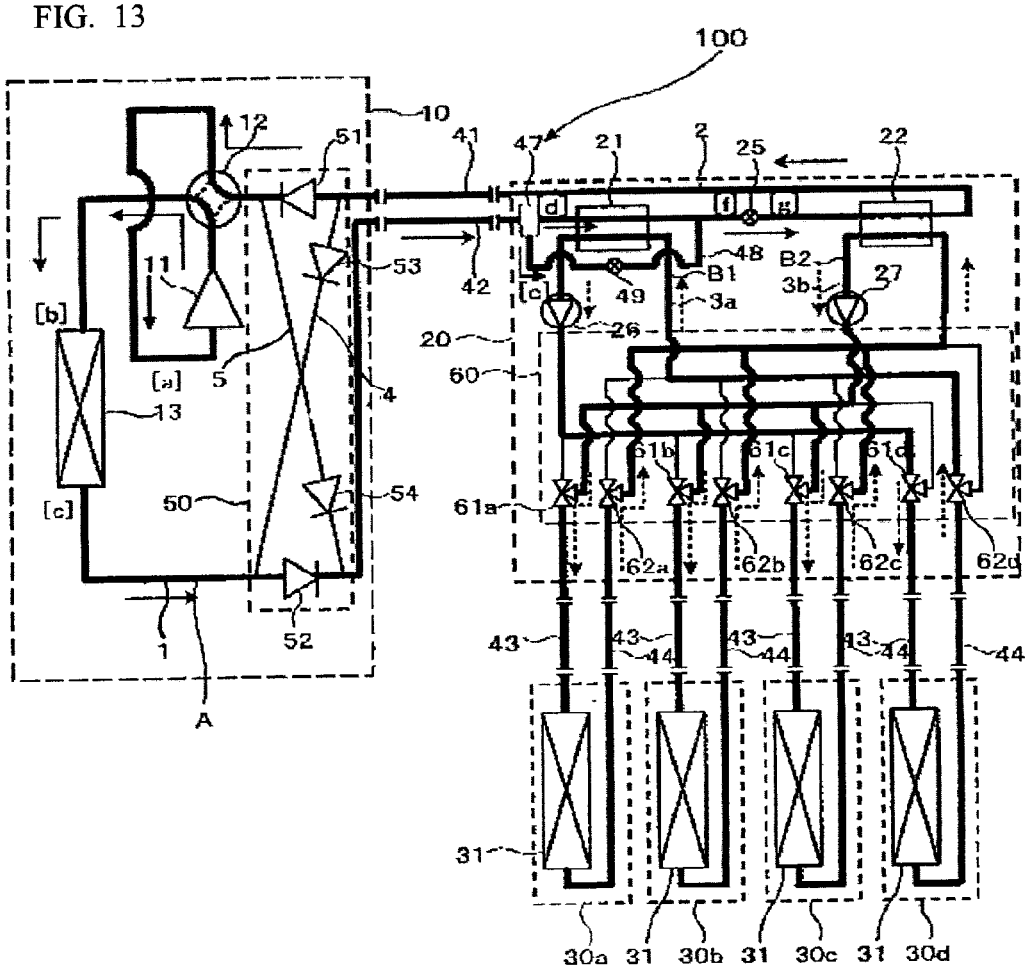
FIG. 13 is a circuit diagram illustrating still another circuit configuration of the air conditioner.

Also, in FIG. 10, it is configured such that all the heat-source side refrigerant flowing into the relay portion 20 flows into the first intermediate heat exchanger 21, but as shown in FIG. 13, it may be so configured that not all the heat-source side refrigerant flowing into the relay portion 20 is made to flow into the first intermediate heat exchanger 21 but a part thereof is made to bypass. That is, in the relay portion 20, a bypass pipeline 48A bypass the first intermediate heat exchanger 21 and a bypass refrigerant flow-rate controller 49A for controlling the flow rate of the heat-source side refrigerant communicating through the bypass pipeline 48A may be provided.

With such configuration, in the cooling main operation mode, the pressure loss of the refrigerant in the first intermediate heat exchanger 21 can be reduced, and the heat exchange efficiency is improved. Also, in the full-cooling operation mode, the first intermediate heat exchanger 21 not performing heat exchange with the use-side refrigerant can be bypassed, by which the pressure loss of the refrigerant can be reduced and the efficiency is improved. In FIG. 13, a configuration example in which a gas-liquid separator 47 is not provided in the configuration shown in FIG. 12 is shown, and the other configurations will be described in FIG. 12.

With regard to the air conditioner 100 according to the Embodiment 1, a configuration in which the refrigerant radiating heat while being liquefied by the condenser is used as the heat-source side refrigerant was described as an example, but not limited to that, and the same effect can be also obtained by using a refrigerant radiating heat while lowering the temperature in the supercritical state (carbon dioxide, which is one of natural refrigerants, for example) as a heat-source side refrigerant. If such refrigerant is used as the heat-source side refrigerant, the above-mentioned condenser operates as a radiator.

Figure 12:
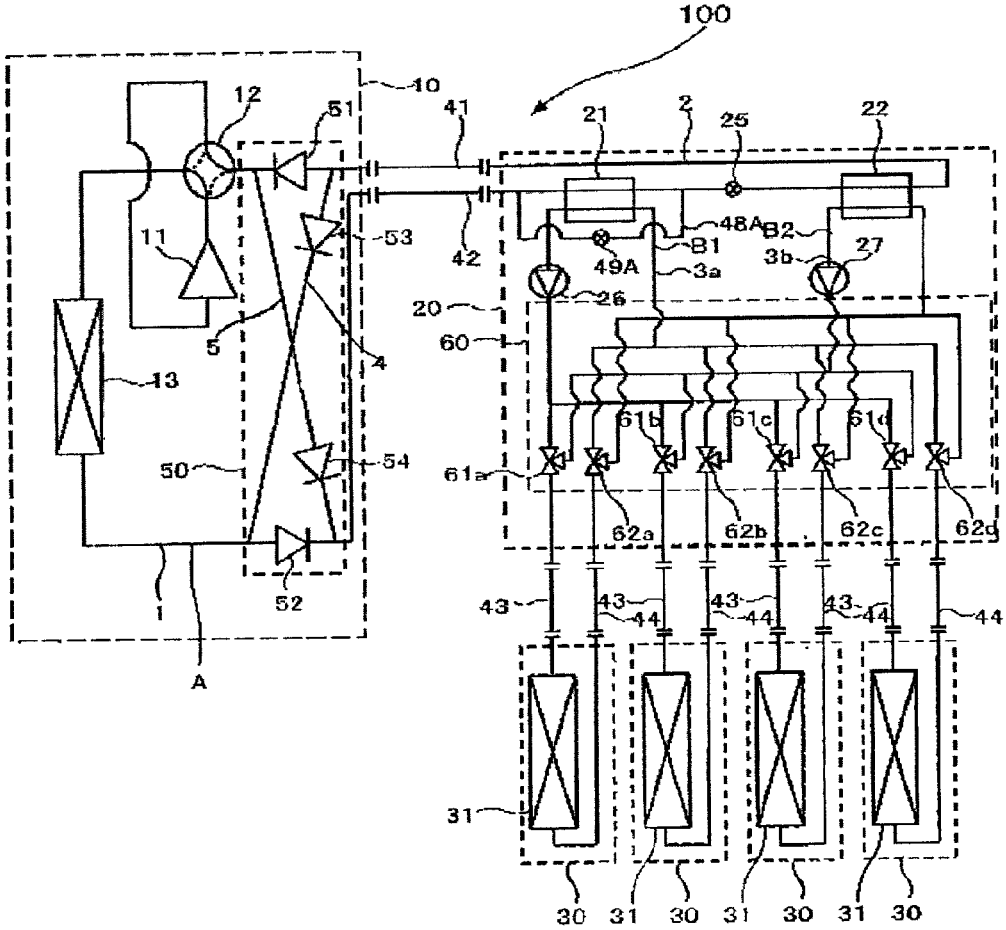
FIG. 12 is a circuit diagram illustrating still another circuit configuration of the air conditioner.

FIG. 12 is a circuit diagram illustrating still another circuit configuration of the air conditioner 100. On the basis of FIG. 12, still another circuit configuration of the air conditioner 100 will be described. In the air conditioner 100 shown in FIG. 12, the gas-liquid separator 47 is disposed on the upstream side of the first intermediate heat exchanger 21 and is configured such that in the cooling main operation mode, the steam-state refrigerant flows into the first intermediate heat exchanger 21 and the liquid-state refrigerant does not flow into the first intermediate heat exchanger 21. FIG. 12 also shows a flow of the refrigerant in the cooling main operation mode of the air conditioner 100. Also, in FIG. 12, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows.

As shown in FIG. 12, in the relay portion 20 of the air conditioner 100, the gas-liquid separator 47 for separating the heat-source side refrigerant to the steam-state refrigerant and the liquid-state refrigerant and a liquid-state refrigerant bypass pipeline 48 for bypassing the liquid-state refrigerant separated in the gas-liquid separator 47 to between the first intermediate heat exchanger 21 and the refrigerant flow-rate controller 25 are disposed. The gas-liquid separator 47 is disposed on the upstream side of the first intermediate heat exchanger 21. The liquid-state refrigerant bypass pipeline 48 is disposed to connect the gas-liquid separator 47 to between the first intermediate heat exchanger 21 and the refrigerant flow-rate controller 25. Also, in the liquid-state refrigerant bypass pipeline 48, a liquid-state refrigerant flow-rate controller 49 for controlling the flow rate of the heat-source side refrigerant communicating through the liquid-state refrigerant bypass pipeline 48 is disposed. The cooling main operation mode of the air conditioner 100 configured as above will be described together with the flow of the refrigerant.

Figure 14:
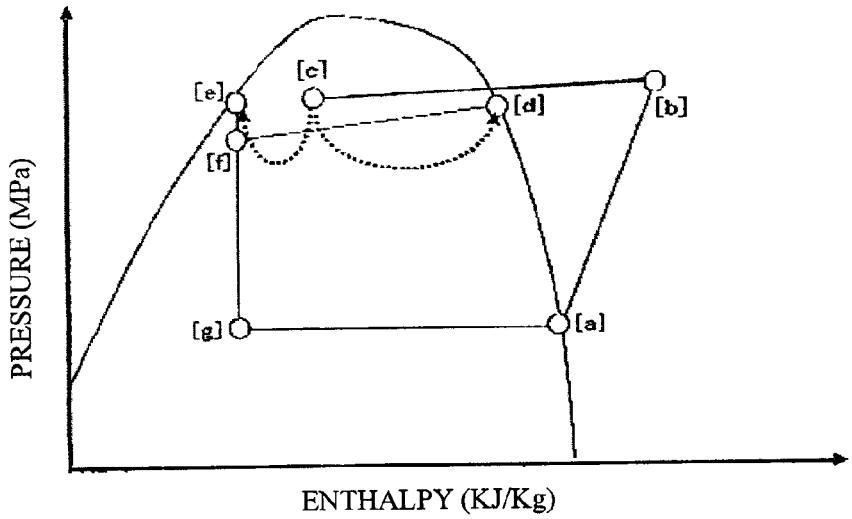
FIG. 14 is a p-h diagram illustrating a change of the heat-source side refrigerant in the cooling main operation mode.

FIG. 14 is a p-h diagram (diagram illustrating a relationship between a pressure of the refrigerant and enthalpy) illustrating a change of the heat-source side refrigerant in the heating main operation mode. The refrigerant states at the point [a] to the point [g] shown in FIG. 14 are refrigerant states at [a] to [g] shown in FIG. 12, respectively. In FIG. 12, the three indoor units 30 performing the cooling operation are shown as the indoor unit 30*a*, the indoor unit 30*b*, and the indoor unit 30*c* from the left side on the drawing and the single indoor unit 30 on the right side on the drawing performing the heating operation as the indoor unit 30*d*. Moreover, according to the indoor unit 30*a* to the indoor unit 30*d*, the first switching valves 61 are shown as the first switching valve 61*a* to the first switching valve 61*d*, and the second switching valves 62 as the second switching valve 62*a* to the second switching valve 62*d*.

If the indoor unit 30*a* to the indoor unit 30*c* perform the cooling operation and the indoor unit 30*d* performs the heating operation, in the outdoor unit 10, the four-way valve 12 is switched similarly to the cooling main operation mode described in FIG. 6. In the relay portion 20, similarly to the cooling main operation mode described in FIG. 6, the refrigerant flow-rate controller 25, the first pump 26, the second pump 27, and the use-side refrigerant channel switching portion 60 (each of the first switching valves 61 and each of the second switching valves 62) are controlled, and the opening degree of the liquid-state refrigerant flow-rate controller 49 is controlled to be throttled so that the steam-state refrigerant and the liquid-state refrigerant are separated by the gas-liquid separator 47. In this state, the operation of the compressor 11 is started.

A flow of the heat-source side refrigerant in the heat-source side refrigerant circuit A will be described. A low-temperature and low-pressure steam-state refrigerant is compressed by the compressor 11 and discharged as a high-temperature and high-pressure refrigerant. The refrigerant compression process of the compressor 11 is expressed by an isoentropic line shown from the point [a] to the point [b] in FIG. 14.

The high-temperature and high-pressure refrigerant discharged from the compressor 11 goes through the four-way valve 12 and flows into the outdoor heat exchanger 13. The refrigerant is condensed and liquefied while radiating heat to the outdoor air in the outdoor heat exchanger 13 and becomes a high-pressure gas-liquid two-phase state refrigerant. The refrigerant change at this time is expressed by a slightly inclined straight line close to a horizontal line shown from the point [a] to the point [c] in FIG. 14.

The high-pressure gas-liquid two-phase refrigerant flowing out of the outdoor heat exchanger 13 communicates through the second extension pipeline 42 via the heat-source side refrigerant channel switching portion 50 and flows into the relay portion 20. The high-pressure gas-liquid two-phase refrigerant having flown into the relay portion 20 flows into the gas-liquid separator 47 and is separated to the steam-state refrigerant and the liquid-state refrigerant. The refrigerant change at this time is expressed by broken-line arrows to become the saturated steam at the point [d] in FIG. 14 from the gas-liquid two-phase state at the point [c] and broken-line arrows to become the saturated liquid at the point [e] from the gas-liquid two-phase state at the point [c], respectively. The steam-state refrigerant flows into the first intermediate heat exchanger 21, while the liquid-state refrigerant communicates through the liquid-state refrigerant bypass pipeline 48.

The refrigerant having flown into the first intermediate heat exchanger 21 is condensed while radiating heat to the use-side refrigerant circulating in the first use-side refrigerant circuit B1 in the first intermediate heat exchanger 21. The refrigerant change at this time is expressed by a slightly inclined straight line close to a horizontal line shown from the point [d] to the point [f] in FIG. 14. On the other hand, the liquid-state refrigerant communicating through the liquid-state refrigerant bypass pipeline 48 is slightly decompressed by the liquid-state refrigerant flow-rate controller 49. The refrigerant change at this time is expressed by a perpendicular line shown from the point [e] to the point [f] in FIG. 14. The refrigerant slightly decompressed by the liquid-state refrigerant flow-rate controller 49 merges with the refrigerant having radiated heat in the first intermediate heat exchanger 21 after that. The merged refrigerant is throttled by the refrigerant flow-rate controller 25 and expanded (decompressed) and brought into a low-temperature and low-pressure gas-liquid two-phase state. The refrigerant change at this time is expressed by a perpendicular line shown from the point [f] to the point [g] in FIG. 14.

The low-temperature and low-pressure gas-liquid two-phase refrigerant throttled by the refrigerant flow-rate controller 25 flows into the second intermediate heat exchanger 22. The refrigerant having flown into the second intermediate heat exchanger 22 absorbs heat from the use-side refrigerant circulating in the second use-side refrigerant circuit B2 and becomes the low-temperature and low-pressure steam-state refrigerant while cooling the use-side refrigerant. The refrigerant change at this time is expressed by a slightly inclined straight line close to a horizontal line shown from the point [g] to the point [a] in FIG. 14. The low-temperature and low-pressure steam-state refrigerant flowing out of the second intermediate heat exchanger 22 communicates through the heat-source side refrigerant pipeline 2 and the first extension pipeline 41 and returns to the compressor 11 through the heat-source side refrigerant channel switching portion 50 and the four-way valve 12.

By configuring the air conditioner as above, in addition to the effect of the air conditioner 100 described in FIGS. 1 to 9, if the refrigerant radiating heat while being condensed on the high pressure side is filled, since the liquid-state refrigerant bypasses the first intermediate heat exchanger 21 and the gas refrigerant that can be used for heat radiation in the first intermediate heat exchanger 21 flows into the first intermediate heat exchanger 21, after the refrigerant after having radiated heat in the first intermediate heat exchanger 21 and the refrigerant flowing through the liquid-state refrigerant bypass pipeline 48 merge, that is, enthalpy of the refrigerant at the inlet of the refrigerant flow-rate controller 25 can be lowered, and efficiency of the air conditioner 100 is improved.

In Embodiment 1, a form in which the refrigerant radiating heat while being condensed as the heat-source side refrigerant is filled in the heat-source side refrigerant circuit A was described, but not limited to that, and a refrigerant radiating heat in the supercritical state may be filled in the heat-source side refrigerant circuit A as the heat-source side refrigerant. If such refrigerant is to be filled in the heat-source side refrigerant circuit A, a heat exchanger operating as a condenser (the first intermediate heat exchanger 21 or the second intermediate heat exchanger 22) operates as a radiator, and the refrigerant lowers its temperature while radiating heat.

Embodiment 2

Figure 15:
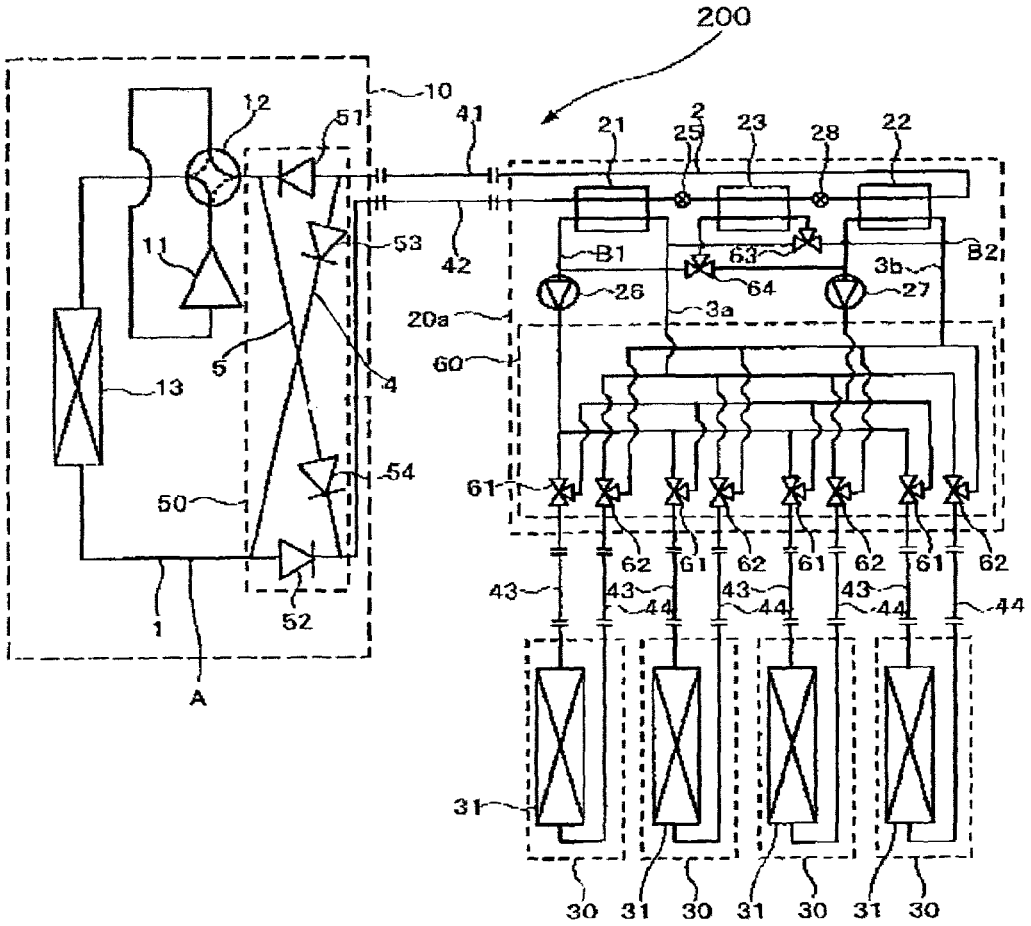
FIG. 15 is a circuit diagram illustrating a circuit configuration of an air conditioner according to Embodiment 2.

FIG. 15 is a circuit diagram illustrating a circuit configuration of an air conditioner 200 according to Embodiment 2 of the present invention. On the basis of FIG. 15, the circuit configuration of the air conditioner 200 will be described. This air conditioner 200 is installed in a building, an apartment house and the like and capable of simultaneous supply of a cooling load and a heating load by using a refrigerating cycle (a heat-source side refrigerant circuit and a use-side refrigerant circuit) in which a refrigerant (a heat-source side refrigerant and a use-side refrigerant) is circulated similarly to the air conditioner 100. In Embodiment 2, differences from Embodiment 1 will be mainly described, and the same portions as those in Embodiment 1 are given the same reference numerals and the description will be omitted.

The air conditioner 200 according to Embodiment 2 is provided with a relay portion 20*a* in which a third intermediate heat exchanger 23 and a second refrigerant flow-rate controller 28 are disposed between the refrigerant flow-rate controller 25 and the second intermediate heat exchanger 21 based on the configuration of the air conditioner 100 according to Embodiment 1. That is, in the air conditioner 200, the first intermediate heat exchanger 21, the refrigerant flow-rate controller 25, the third intermediate heat exchanger 23, the second refrigerant flow-rate controller 28, and the second intermediate heat exchanger 22 are disposed in order in the relay portion 20*a*, connected in series by the heat-source side refrigerant pipeline 2. The third intermediate heat exchanger 23 functions as a condenser or an evaporator similarly to the first intermediate heat exchanger 21 and the second intermediate heat exchanger 22. The second refrigerant flow-rate controller 28 decompresses and expands the heat-source side refrigerant similarly to the refrigerant flow-rate controller 25.

In the relay portion 20*a*, the first use-side refrigerant pipeline 3*a* and the second use-side refrigerant pipeline 3*b* are branched and go through the third intermediate heat exchanger 23. Also, a third switching valve 63 is disposed in the first use-side refrigerant pipeline 3*a* connected to the third intermediate heat exchanger 23 and a fourth switching valve 64 in the second use-side refrigerant pipeline 3*b*. The third switching valve 63 and the fourth switching valve 64 are constituted by three-way valves and make adjustment of inflow of the use-side refrigerant into the third intermediate heat exchanger 23 possible by switching the flow of the use-side refrigerant communicating through the first use-side refrigerant pipeline 3*a* or the second use-side refrigerant pipeline 3*b*.

That is, in the air conditioner 200, either one of a path in which the use-side refrigerant having performed heat exchange with the heat-source side refrigerant in the third intermediate heat exchanger 23 is sucked by the first pump 26 and then, circulates to the indoor unit 30 or a path in which the use-side refrigerant having performed heat exchange with the heat-source side refrigerant in the third intermediate heat exchanger 23 is sucked by the second pump 27 and then, circulates to the indoor unit 30 can be selectively switched by the third switching valve 63 and the fourth switching valve 64. The third switching valve 63 and the fourth switching valve 64 constitute a second use-side refrigerant channel switching portion 65.

Therefore, in this air conditioner 100, in the full-cooling operation mode and the cooling main operation mode, the third intermediate heat exchanger 23 can be operated as an evaporator for cooling the use-side refrigerant similarly to the second intermediate heat exchanger 22, while in the full-heating operation mode and the heating main operation mode, the third intermediate heat exchanger 23 can be operated as a condenser for heating the use-side refrigerant similarly to the first intermediate heat exchanger 21. That is, according to a size of the load in the indoor unit 30, the third intermediate heat exchanger 23 can be made to function.

According to Embodiment 2, in addition to the same effect as that in Embodiment 1, if a heat load of heating is large in the indoor unit 30, the third intermediate heat exchanger 23 can be used as a condenser, while a heat load of cooling is large in the indoor unit 30, the third intermediate heat exchanger 23 can be used as an evaporator. Thus, full capacity of the heat exchanger in the relay portion 20*a* (total capacity of the first intermediate heat exchanger 21, the second intermediate heat exchanger 22, and the third intermediate heat exchanger 23)

can be reduced, and a size reduction of a heat exchanger disposed in the relay portion 20*a* can be realized.

That is, contribution can be made to size reduction of the relay portion 20*a*.

Embodiment 3

Figure 16:
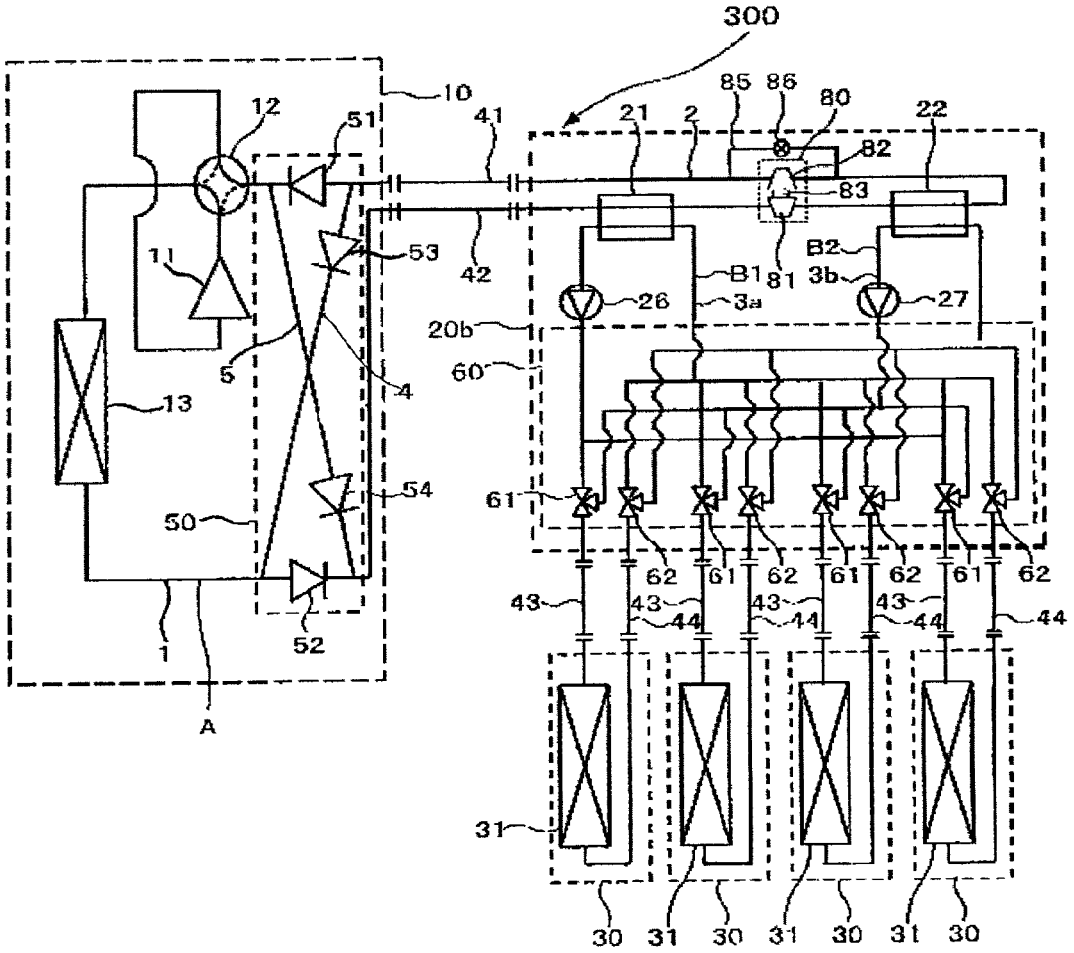
FIG. 16 is a circuit diagram illustrating a circuit configuration of an air conditioner according to Embodiment 3.

FIG. 16 is a circuit diagram illustrating a circuit configuration of an air conditioner 300 according to Embodiment 3 of the present invention. On the basis of FIG. 16, the circuit configuration of the air conditioner 300 will be described. This air conditioner 300 is installed in a building, an apartment house and the like and capable of simultaneous supply of a cooling load and a heating load by using a refrigerating cycle (a heat-source side refrigerant circuit and a use-side refrigerant circuit) in which a refrigerant (a heat-source side refrigerant and a use-side refrigerant) is circulated similarly to the air conditioner 100 and the air conditioner 200. In Embodiment 3, differences from Embodiment 1 and Embodiment 2 will be mainly described, and the same portions as those in Embodiment 1 and Embodiment 2 are given the same reference numerals and the description will be omitted.

The air conditioner 300 according to Embodiment 3 is provided with a relay portion 20*b* in which an expanding device 80 instead of the refrigerant flow-rate controller 25 is provided based on the configuration of the air conditioner 100 according to Embodiment 1. The expanding device 80 is configured by an expansion power recovery portion 81 for recovering expansion power in decompression of the heat-source refrigerant, a power transfer portion 83 for transferring the expansion power to a compression portion 82, and the compression portion 82 for compressing the heat-source side refrigerant using the expansion power transferred from the power transfer portion 63. The expansion power recovery portion 81 of the expanding device 80 is installed in the heat-source side refrigerant pipeline 2 between the first intermediate heat exchanger 21 and the refrigerant flow-rate controller 25. Also, the compression portion 82 of the expanding device is installed in the heat-source side refrigerant pipeline 2 between the second intermediate heat exchanger 22 and the outdoor unit 10.

That is, in the air conditioner 300, the first intermediate heat exchanger 21, the expansion power recovery portion 81 of the expanding device 80, the second intermediate heat exchanger 22, and the compression portion 82 of the expanding device 80 are connected in order by the heat-source side refrigerant pipeline 2 in series. Also, in the relay portion 20*b*, a compression-portion bypass pipe 85 for bypassing the compression portion 82 of the expanding device 80 is disposed. The compression-portion bypass pipe 85 connects the heat-source side refrigerant pipeline 2 on the upstream side of the compression portion 82 to the heat-source side refrigerant pipeline 2 on the downstream side of the compression portion 82 so as to bypass the compression portion 82 of the expanding device 80.

In the compression-portion bypass pipe 85, a refrigerant flow-rate controller 86 for controlling a flow rate of the heat-source side refrigerant communicating through the compression-portion bypass pipe 85 is disposed.

Here, each operation mode executed by the air conditioner 300 will be described. The air conditioner 300 is capable of the cooling operation or the heating operation in the indoor unit 30 on the basis of an instruction from each indoor unit 30. That is, the air conditioner 300 can perform the four operation modes (the full-cooling operation mode, full-heating operation mode, the cooling main operation mode, and the heating main operation mode) similarly to the air conditioner 100 and the air conditioner 200. The full-cooling operation mode, the full-heating operation mode, the cooling main operation mode, and the heating main operation mode performed by the air conditioner 300 will be described below together with the flow of the refrigerant.

[Full-cooling Operation Mode]

Figure 17:
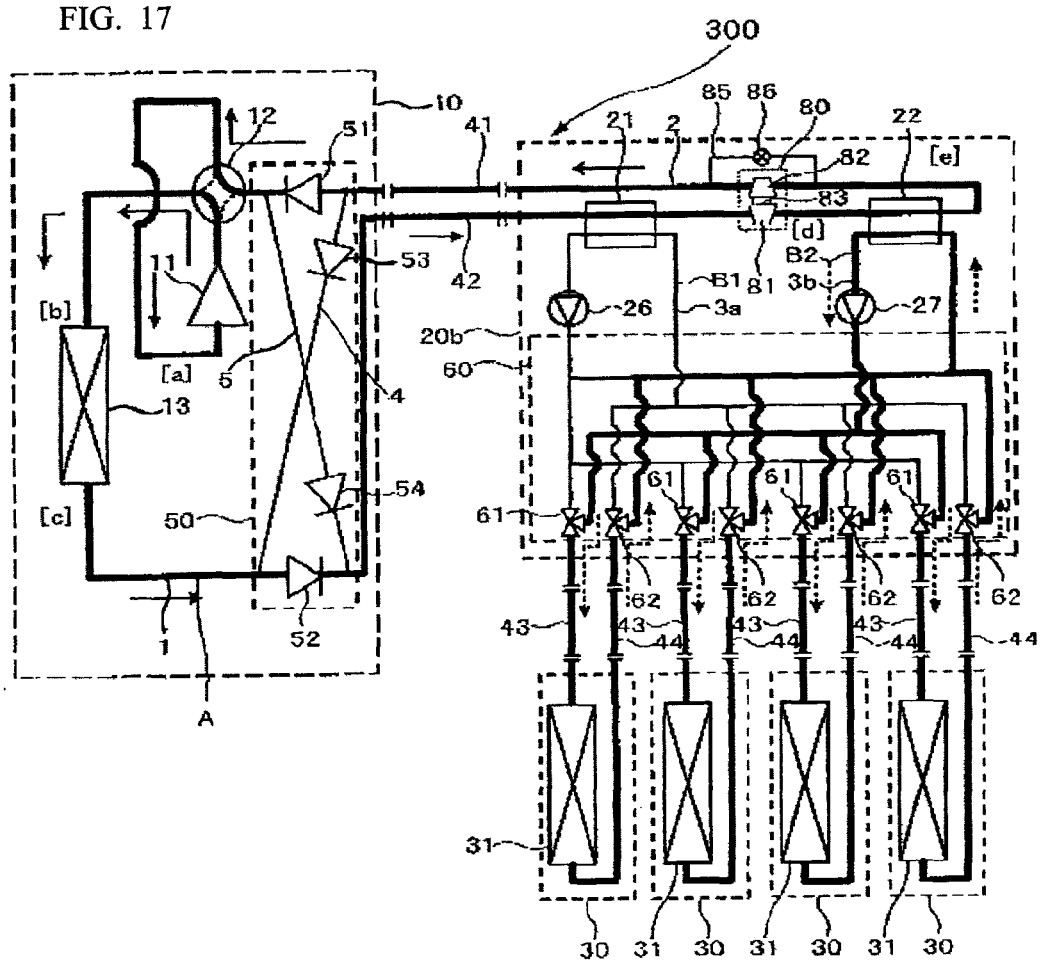
FIG. 17 is a refrigerant circuit diagram illustrating refrigerant flow in the full-cooling operation mode of the air conditioner.
Figure 18:
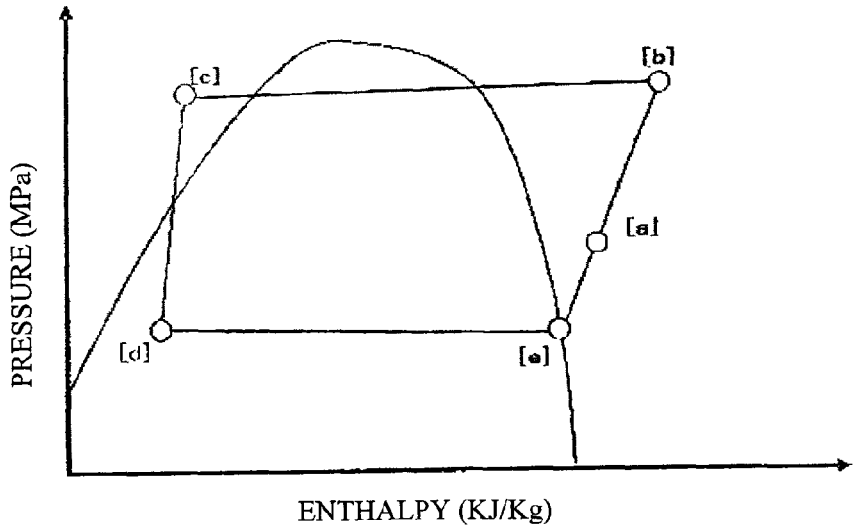
FIG. 18 is a p-h diagram illustrating a change of the heat-source side refrigerant in the cooling main operation mode.

FIG. 17 is a refrigerant circuit diagram illustrating a flow of the refrigerant in the full-cooling operation mode of the air conditioner 300. FIG. 18 is a p-h diagram (diagram illustrating a relationship between a pressure of the refrigerant and enthalpy) illustrating a change of the heat-source side refrigerant in the full-cooling operation mode. In FIG. 7, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [e] shown in FIG. 18 are refrigerant states at [a] to [d] shown in FIG. 17, respectively. Description of the flow of the use-side refrigerant in the use-side refrigerant circuit B in the full-cooling operation mode will be omitted due to similarity to Embodiment 1.

If all the indoor units 30 perform the cooling operation, in the outdoor unit 10, the four-way valve 12 is switched so that the heat-source side refrigerant discharged from the compressor 11 flows into the outdoor heat exchanger 13. In the relay portion 20*b*, the refrigerant flow-rate controller 86 is closed, the first pump 26 is stopped, the second pump 27 is driven, and the first switching valve 61 and the second switching valve 62 of the use-side refrigerant channel switching portion 60 are switched so that the use-side refrigerant circulates between the second intermediate heat exchanger 22 and each indoor unit 30. In this state, the operation of the compressor 11 is started.

A flow of the heat-source side refrigerant in the heat-source side refrigerant circuit A will be described. A low-temperature and low-pressure steam-state refrigerant is compressed by the compressor 11 and discharged as a high-temperature and high-pressure refrigerant. The refrigerant compression process of the compressor 11 is expressed by an isoentropic line shown from the point [a] to the point [b] in FIG. 18.

The high-temperature and high-pressure refrigerant discharged from the compressor 11 goes through the four-way valve 12 and flows into the outdoor heat exchanger 13. The refrigerant is condensed and liquefied while radiating heat to the outdoor air in the outdoor heat exchanger 13 and becomes a high-pressure liquid-state refrigerant. The refrigerant change at this time is expressed by a slightly inclined straight line close to a horizontal line shown from the point [b] to the point [c] in FIG. 10, considering the pressure loss of the outdoor heat exchanger 13.

The high-pressure liquid-state refrigerant flowing out of the outdoor heat exchanger 13 communicates through the second extension pipeline 42 via the heat-source side refrigerant channel switching portion 50 (check valve 52) and flows into the relay portion 20*b*. The high-pressure liquid-state refrigerant having flown into the relay portion 20*b* goes through the first intermediate heat exchanger 21 and its expansion power is recovered and decompressed in the expansion power recovery portion 81 of the expanding device 80 and is brought to a low-temperature and low-pressure gas-liquid two-phase state. In the refrigerant change in the expansion power recovery portion 81, the enthalpy is declined since the expansion power is recovered. The refrigerant change at this time is expressed by a slightly inclined perpendicular line shown from the point [c] to the point [d] in FIG. 18. The gas-liquid two-phase state refrigerant having the expansion power recovered and throttled in the expansion power recovery portion 81 flows into the second intermediate heat exchanger 22.

The refrigerant having flown into the second intermediate heat exchanger 22 absorbs heat from the use-side refrigerant circulating in the second use-side refrigerant circuit B2 and becomes the low-temperature and low-pressure steam-state refrigerant while cooling the use-side refrigerant. The refrigerant change at this time is expressed by a slightly inclined straight line close to a horizontal line shown from the point [d] to the point [d] in FIG. 18. The low-temperature and low-pressure steam-state refrigerant flowing out of the second intermediate heat exchanger 22 communicates through the heat-source side refrigerant pipeline 2, flows into the compression portion 82 of the expanding device 80, is compressed by the power recovered in the expansion power recovery portion 81 and transferred through the power transfer portion 83 and then, discharged. The refrigerant change at this time is expressed by the isoentropic line shown from the point [e] to the point [a] in FIG. 18. The refrigerant compressed in the compression portion 82 communicates through the first extension pipeline 41 and returns to the compressor 11 through the heat-source side refrigerant channel switching portion 50 (check valve 51) and the four-way valve 12.

[Full-heating Operation Mode]

Figure 19:
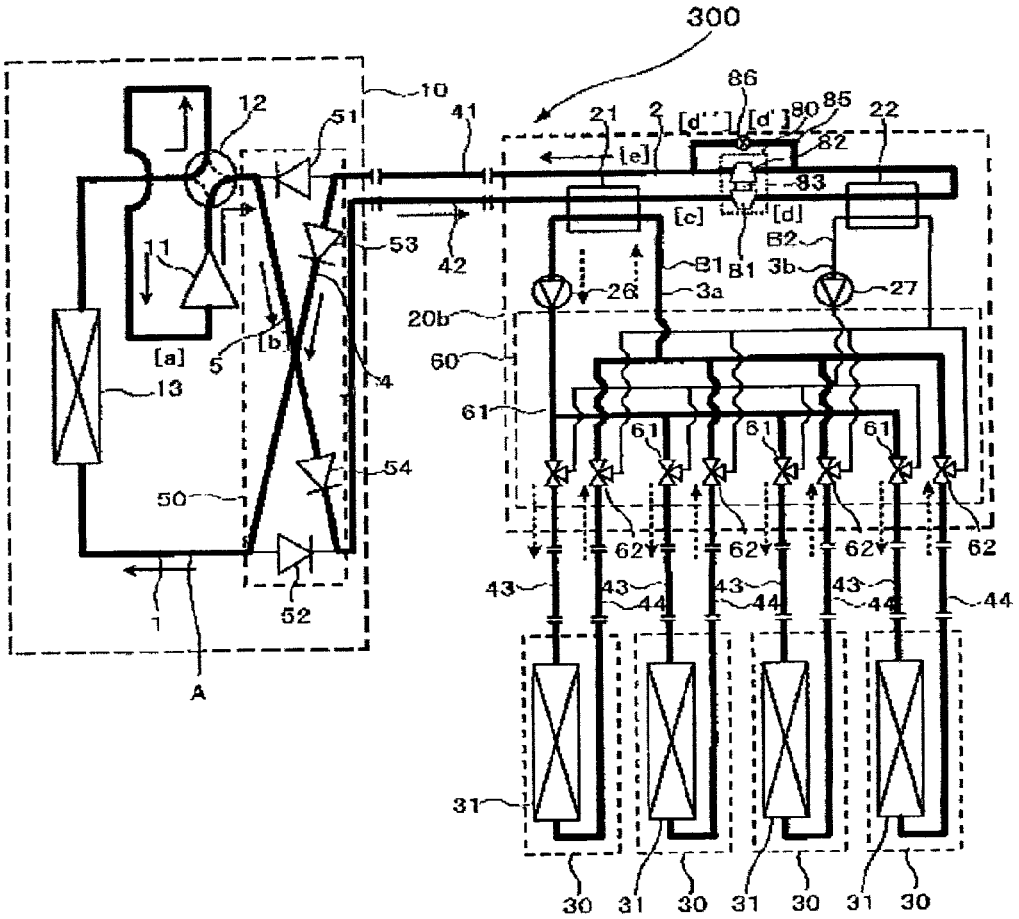
FIG. 19 is a refrigerant circuit diagram illustrating a refrigerant flow in the full-heating operation mode of the air conditioner.
Figure 20:
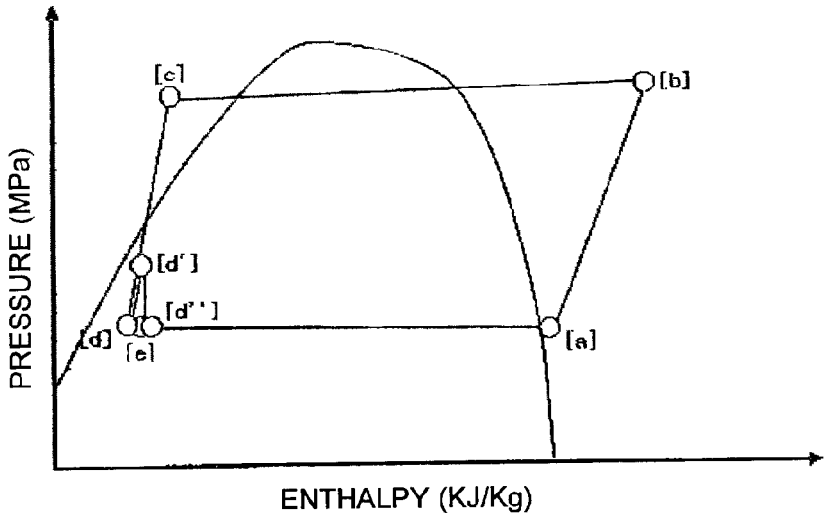
FIG. 20 is a p-h diagram illustrating a change of the heat-source side refrigerant in the full-heating operation mode.

FIG. 19 is a refrigerant circuit diagram illustrating a flow of the refrigerant in the full-heating operation mode of the air conditioner 300. FIG. 20 is a p-h diagram (diagram illustrating a relationship between a pressure of The refrigerant and enthalpy) illustrating a change of the heat-source side refrigerant in the full-heating operation mode. In FIG. 19, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [e] shown in FIG. 20 are refrigerant states at [a] to [e] shown in FIG. 19, respectively. Description of the flow of the use-side refrigerant in the use-side refrigerant circuit B in the full-heating operation mode will be omitted due to similarity to Embodiment 1.

If all the indoor units 30 perform the heating operation, in the outdoor unit 10, the four-way valve 12 is switched so that the heat-source side refrigerant discharged from the compressor 11 flows into the relay portion 20 without going through the outdoor heat exchanger 13. In the relay portion 20, an opening degree of the refrigerant flow-rate controller 86 is fully opened, the first pump 26 is driven, the second pump 27 is stopped, and the first switching valve 61 and the second switching valve 62 of the use-side refrigerant channel switching portion 60 are switched so that the use-side refrigerant circulates between the first intermediate heat exchanger 21 and each indoor unit 30. In this state, the operation of the compressor 11 is started.

A flow of the heat-source side refrigerant in the heat-source side refrigerant circuit A will be described. A low-temperature and low-pressure steam-state refrigerant is compressed by the compressor 11 and discharged as a high-temperature and high-pressure refrigerant. The refrigerant compression process of the compressor 11 is expressed by an isoentropic line shown from the point [a] to the point [b] in FIG. 20.

The high-temperature and high-pressure refrigerant discharged from the compressor 11 goes through the four-way valve 12 and the heat-source side refrigerant channel switching portion 50 (check valve 54), communicates through the second extension pipeline 42, and flows into the first intermediate heat exchanger 21. The refrigerant having flown into the first intermediate heat exchanger 21 is condensed and liquefied while radiating heat to the use-side refrigerant circulating in the first use-side refrigerant circuit B1 and becomes a high-pressure liquid-state refrigerant. The refrigerant change at this time is expressed by a slightly inclined straight line close to a horizontal line shown from the point [b] to the point [c] in FIG. 20.

The high-pressure liquid-state refrigerant flowing out of the first intermediate heat exchanger 21 has the expansion power recovered and decompressed in the expansion power recovery portion 81 of the expanding device 80 and brought into a low-temperature and low-pressure gas-liquid two-phase state. The refrigerant change at this time is expressed by a slightly inclined perpendicular line shown from the point [c] to the point [d] in FIG. 20. The gas-liquid two-phase state refrigerant having the expansion power recovered and decompressed in the expansion power recovery portion 81 goes through the second intermediate heat exchanger 22, while a part of the refrigerant flows into the compression portion 82 of the expanding device 80. The refrigerant having flown into the compression portion 82 is compressed by the power recovered in the expansion power recovery portion 81 and transferred through the power transfer portion 83. The refrigerant change at this time is expressed by an isoentropic line shown from the point [d] to a point [d'] in FIG. 20.

The refrigerant compressed by the compression portion 82 is decompressed to a pressure of the remaining refrigerant passing through the compression-portion bypass pipe 85 inside the compression portion 82. This refrigerant chance is expressed by an isoentropic line shown from the point [d'] to a point [d"] in FIG. 20. The refrigerant merges with the remaining refrigerant flowing through the compression-portion bypass pipe 85. The refrigerant change at this time is expressed by a horizontal line shown from the point [d"] to the point [e] in FIG. 20.

The rest of the refrigerant having gone through the second intermediate heat exchanger 22 communicates through the compression-portion bypass pipe 85 and flows into the heat-source side refrigerant pipeline 2 on the downstream side of the compression portion 82 through the refrigerant flow-rate controller 86. That is, the refrigerant compressed in the compression portion 82 is mixed with the remaining refrigerant flowing from the compression-portion bypass pipe 85 and decompressed. The refrigerant change at this time is expressed by a horizontal line shown from the point [d] to the point [e] in FIG. 20. The mixed refrigerant communicates through the heat-source side refrigerant pipeline 2 and the first extension pipeline 41 and flows into the outdoor unit 10. This refrigerant flows into the outdoor heat exchanger 13 through the heat-source side refrigerant channel switching portion 50 (check valve 53). Then, the refrigerant absorbs heat from the outdoor air in the outdoor heat exchanger 13 and becomes a low-temperature and low-pressure steam-state refrigerant. The refrigerant change at this time is expressed by a slightly inclined straight line close to a horizontal line shown from the point [e] to the point [a] in FIG. 20. The low-temperature and low-pressure steam-state refrigerant flowing out of the outdoor heat exchanger 13 returns to the compressor 11 through the four-way valve 12.

[Cooling Main Operation Mode]

Figure 21:
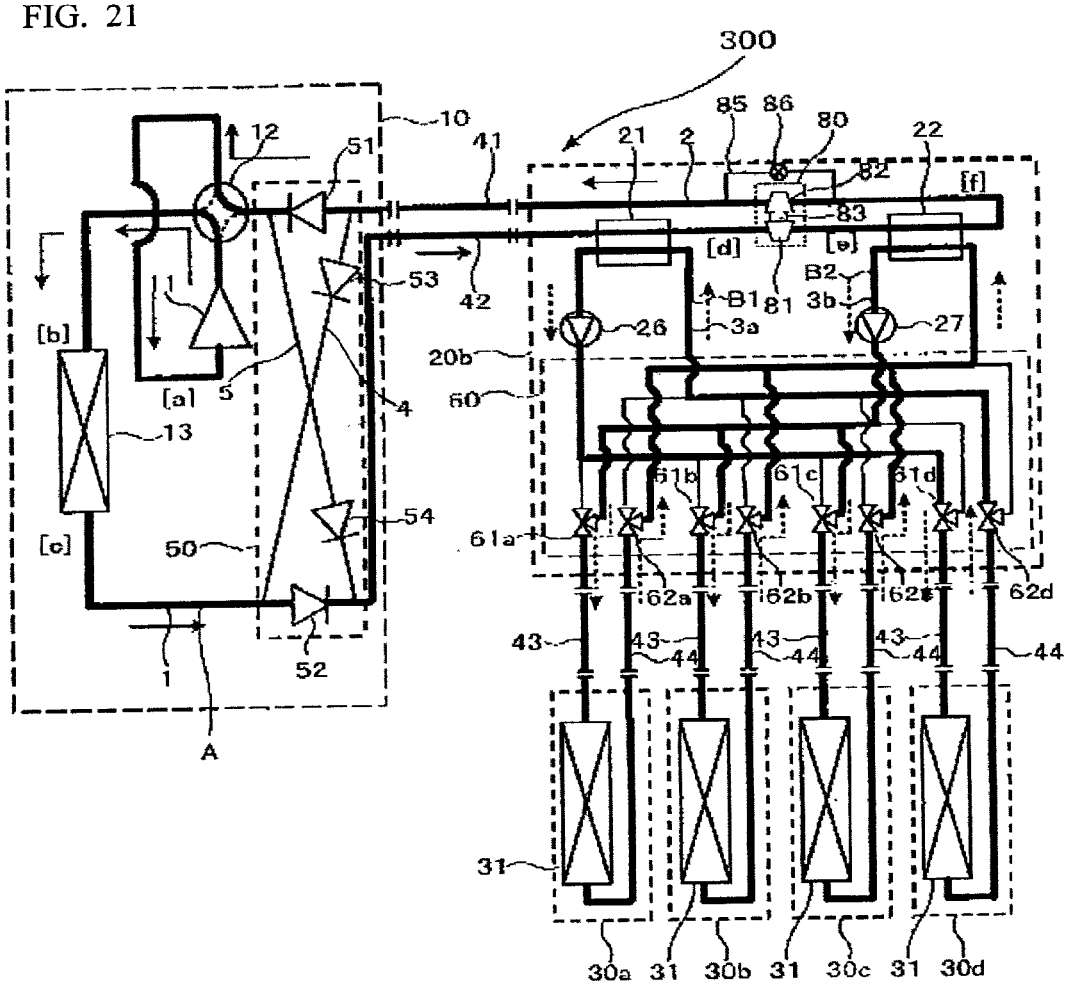
FIG. 21 is a refrigerant circuit diagram illustrating a refrigerant flow in the cooling main operation mode of the air conditioner.
Figure 22:
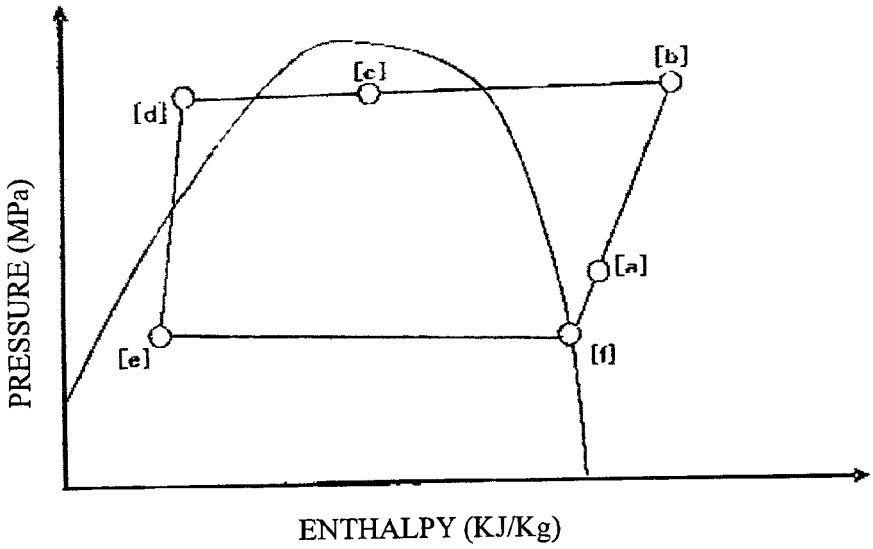
FIG. 22 is a p-h diagram illustrating a change of the heat-source side refrigerant in the cooling main operation mode.

FIG. 21 is a refrigerant circuit diagram illustrating a flow of the refrigerant in the cooling main operation mode of the air conditioner 300. FIG. 22 is a p-h diagram (diagram illustrating a relationship between a pressure of the refrigerant and enthalpy) illustrating a change of the heat-source side refrigerant in the cooling main operation mode. In FIG. 21, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [f] shown in FIG. 22 are refrigerant states at [a] to [f] shown in FIG. 21, respectively.

In FIG. 21, the three indoor units 30 performing the cooling operation are shown as an indoor unit 30*a*, an indoor unit 30*b*, and an indoor unit 30*c* from the left side on the drawing and the single indoor unit 30 on the right side on the drawing performing the heating operation as an indoor unit 30*d*. Also, according to the indoor unit 30*a* to the indoor unit 30*d*, the first switching valves 61 connected to each of them are shown as a first switching valve 61*a* to a first switching valve 61*d*, and the second switching valves 62 connected to each of them as a second switching valve 62*a* to a second switching valve 62*d*. Since the flow of the use-side refrigerant in the use-side refrigerant circuit B in the cooling main operation mode is similar to that in Embodiment 1, the description will be omitted.

If the indoor unit 30*a* to the indoor unit 30*c* perform the cooling operation and the indoor unit 30*d* performs the heating operation, in the outdoor unit 10, the four-way valve 12 is switched so that the heat-source side refrigerant discharged from the compressor 11 flows into the outdoor heat exchanger 13. In the relay portion 20, an opening degree of the refrigerant flow-rate controller 86 is fully opened and the first pump 26 and the second pump 27 are driven. Also, in the use-side refrigerant channel switching portion 60 of the relay portion 20, the first switching valve 61*a* to the first switching valve 61*c* as well as the second switching valve 62*a* to the second switching valve 62*c* are switched so that the use-side refrigerant circulates between the second intermediate heat exchanger 22 and the indoor unit 30*a* to the indoor unit 30*c*, and the first switching valve 61*d* and the second switching valve 62*d* are switched so that the use-side refrigerant circulates between the first intermediate heat exchanger 21 and the indoor unit 30*d*. In this state, the operation of the compressor 11 is started.

A flow of the heat-source side refrigerant in the heat-source side refrigerant circuit A will be described. A low-temperature and low-pressure steam-state refrigerant is compressed by the compressor 11 and discharged as a high-temperature and high-pressure refrigerant. The refrigerant compression process of the compressor 11 is expressed by an isoentropic line shown from the point [a] to the point [b] in FIG. 22.

The high-temperature and high-pressure refrigerant discharged from the compressor 11 goes through the four-way valve 12 and flows into the outdoor heat exchanger 13. Then, the refrigerant is condensed and liquefied while radiating heat to the outdoor air in the outdoor heat exchanger 13 so as to become a high-pressure gas-liquid two-phase state refrigerant. The refrigerant change at this time is expressed by a slightly inclined straight line close to a horizontal line shown from the point [b] to the point [c] in FIG. 22.

The high-pressure gas-liquid two-phase refrigerant flowing out of the outdoor heat exchanger 13 communicates through the second extension pipeline 42 via the heat-source side refrigerant channel switching portion 50 (check valve 52) and flows into the relay portion 20. The high-pressure gas-liquid two-phase refrigerant having flown into the relay portion 20 is first condensed and liquefied while radiating heat to the use-side refrigerant circulating in the first use-side refrigerant circuit B1 in the first intermediate heat exchanger 21 and becomes a high-pressure liquid-state refrigerant. The refrigerant change at this time is expressed by a slightly inclined straight line close to a horizontal line shown from the point [c] to the point [d] in FIG. 22. The high-pressure liquid-state refrigerant flowing out of the first intermediate heat exchanger 21 has expansion power recovered and decompressed in the expansion power recovery portion 81 of the expanding device 80 and brought into a low-temperature and low-pressure gas-liquid two-phase state. The refrigerant change at this time is expressed by a perpendicular line shown by the point [d] to the point [e] in FIG. 22. The gas-liquid two-phase state refrigerant having the expansion power recovered and throttled in the expansion power recovery portion 81 flows into the second intermediate heat exchanger 22.

The refrigerant having flown into the second intermediate heat exchanger 22 absorbs heat from the use-side refrigerant circulating in the second use-side refrigerant circuit B2 and becomes the low-temperature and low-pressure steam-state refrigerant while cooling the use-side refrigerant. The refrigerant change at this time is expressed by a slightly inclined straight line close to a horizontal line shown from the point [e] to the point [f] in FIG. 22. The low-temperature and low-pressure steam-state refrigerant flowing out of the second intermediate heat exchanger 22 communicates through the heat-source side refrigerant pipeline 2, flows into the compression portion 82 of the expanding device 80, compressed by the power recovered in the expansion power recovery portion 81 and transferred through the power transfer portion 83 and then, discharged. The refrigerant change at this time is expressed by the isoentropic line shown from the point [f] to the point [a] in FIG. 22. The refrigerant compressed in The compression portion 82 communicates through the first extension pipeline 41 and returns to the compressor 11 through the heat-source side refrigerant channel switching portion 50 (check valve 51) and the four-way valve 12.

[Heating Main Operation Mode]

Figure 23:
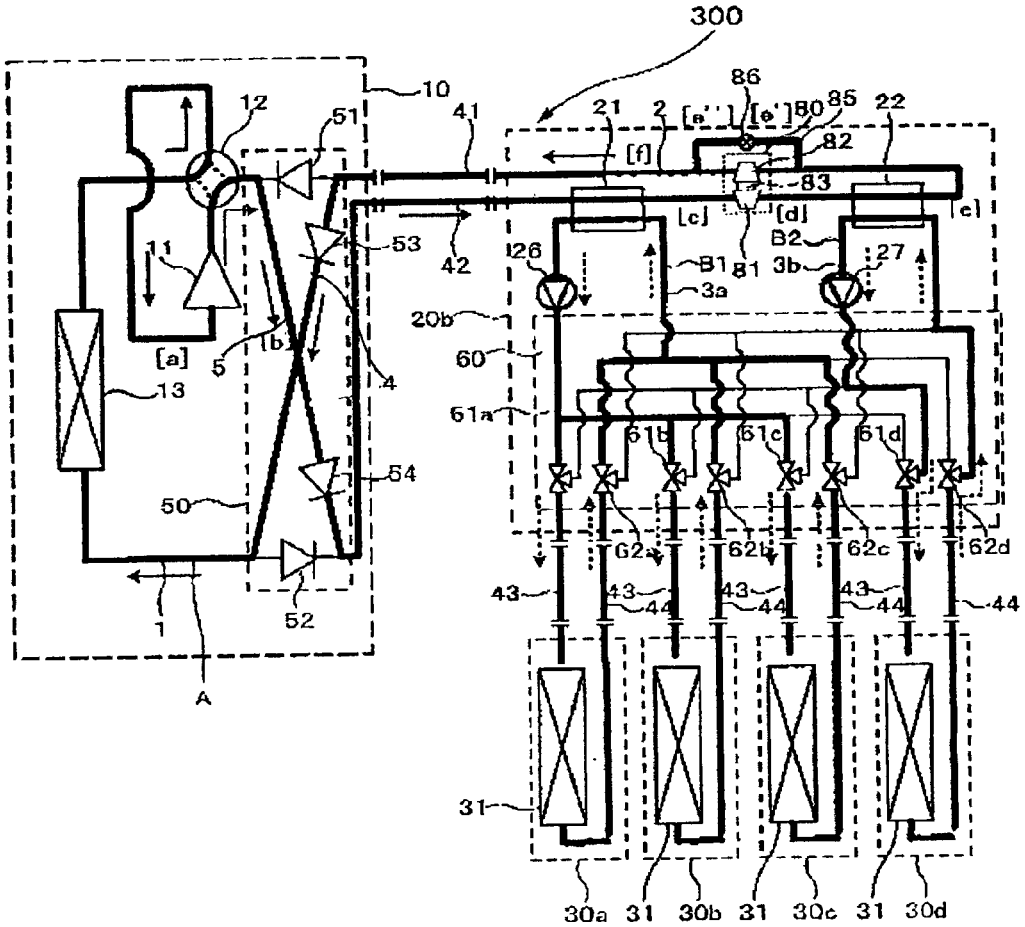
FIG. 23 is a refrigerant circuit diagram illustrating a refrigerant flow in the heating main operation mode of the air conditioner.
Figure 24:
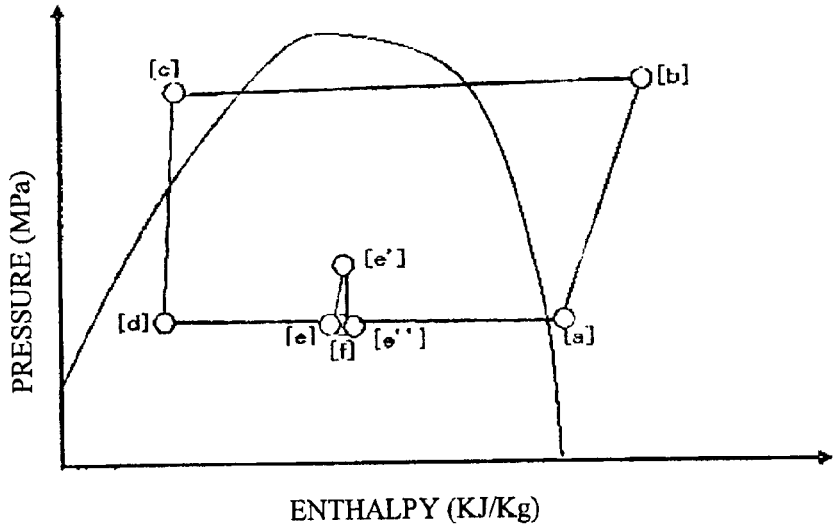
FIG. 24 is a p-h diagram illustrating a change of the heat-source side refrigerant in the heating main operation mode.

FIG. 23 is a refrigerant circuit diagram illustrating a flow of the refrigerant in the cooling main operation mode of the air conditioner 300. FIG. 24 is a p-h diagram (diagram illustrating a relationship between a pressure of the refrigerant and enthalpy) illustrating a change of the heat-source side refrigerant in the heating main operation mode. In FIG. 23, a pipeline shown by a bold line indicates a pipeline through which the refrigerant (a heat-source side refrigerant and a use-side refrigerant) circulates. Also, a flow direction of the heat-source side refrigerant is shown by solid-line arrows and a flow direction of the use-side refrigerant is shown by broken-line arrows. Moreover, refrigerant states at a point [a] to a point [e] shown in FIG. 24 are refrigerant states at [a] to [e] shown in FIG. 23, respectively.

In FIG. 23, the three indoor units 30 performing the heating operation are shown as the indoor unit 30*a*, the indoor unit 30*b*, and the indoor unit 30*c* from the left side on the drawing and the single indoor unit 30 on the right side on the drawing performing the cooling operation as the indoor unit 30*d*. Also, according to the indoor unit 30*a* to the indoor unit 30*d*, the first switching valves 61 connected to each of them are shown as the first switching valve 61*a* to the first switching valve 61*d*, and the second switching valves 62 connected to each of them as the second switching valve 62*a* to the second switching valve 62*d*. Description of the flow of the use-side refrigerant in the use-side refrigerant circuit B in the cooling main operation mode will be omitted due to similarity to Embodiment 1.

If the indoor unit 30*a* to the indoor unit 30*c* perform the heating operation and the indoor unit 30*d* performs the cooling operation, in the outdoor unit 10, the four-way valve 12 is switched so that the heat-source side refrigerant discharged from the compressor 11 flows into the relay portion 20 without going through the outdoor heat exchanger 13. In the relay portion 20, an opening degree of the refrigerant flow-rate controller 86 is fully opened, and the first pump 26 and the second pump 27 are driven. Also, in the use-side refrigerant channel switching portion 60 of the relay portion 20, the first switching valve 61*a* to the first switching valve 61*c* as well as the second switching valve 62*a* to the second switching valve 62*c* are switched so that the use-side refrigerant circulates between the first intermediate heat exchanger 21 and the indoor unit 30*a* to the indoor unit 30*c* and the first switching valve 61*d* and the second switching valve 62*d* are switched so that the use-side refrigerant circulates between the second intermediate heat exchanger 22 and the indoor unit 30*d*. In this state, the operation of the compressor 11 is started.

A flow of the heat-source side refrigerant in the heat-source side refrigerant circuit A will be described. A low-temperature and low-pressure steam-state refrigerant is compressed by the compressor 11 and discharged as a high-temperature and high-pressure refrigerant. The refrigerant compression process of the compressor 11 is expressed by an isoentropic line shown from the point [a] to the point [b] in FIG. 24.

The high-temperature and high-pressure refrigerant discharged from the compressor 11 goes through the four-way valve 12 and the heat-source side refrigerant channel switching portion 50 (check valve 52), communicates through the second extension pipeline 42, and flows into the first intermediate heat exchanger 21 of the relay portion 20. Then, the refrigerant having flown into the first intermediate heat exchanger 21 is condensed and liquefied while radiating heat to the use-side refrigerant circulating in the first use-side refrigerant circuit B1 and becomes a high-pressure liquid-state refrigerant. The refrigerant change at this time is expressed by a slightly inclined straight line close to a horizontal line shown from the point [b] to the point [c] in FIG. 24.

The high-pressure liquid-state refrigerant flowing out of the first intermediate heat exchanger 21 has expansion power recovered and decompressed in the expansion power recovery portion 81 of the expanding device 80 and is brought to a low-temperature and low-pressure gas-liquid two-phase state. The refrigerant change at this time is expressed by a perpendicular line shown from the point [c] to the point [d] in FIG. 24. The gas-liquid two-phase state refrigerant having the expansion power recovered and throttled in the expansion power recovery portion 81 flows into the second intermediate heat exchanger 22. The refrigerant having flown into the second intermediate heat exchanger 22 absorbs heat from the use-side refrigerant circulating in the second use-side refrigerant circuit B2 while cooling the use-side refrigerant and becomes a low-temperature and low-pressure gas-liquid two-phase state refrigerant. The refrigerant change at this time is expressed by a slightly inclined straight line close to a horizontal line shown from the point [d] to the point [e] in FIG. 24.

A part of the refrigerant heated in the second intermediate heat exchanger 22 flows into the compression portion 82 of the expanding device 80 and is compressed and then, decompressed at an outlet of the compression portion 82. The refrigerant change at this time is expressed by the isoentropic line shown from the point [e] to a point [e'] and the isoentropic line shown from the point [e'] to a point [e"] in FIG. 24. The rest of the refrigerant heated by the second intermediate heat exchanger 22 communicates through the compression-portion bypass pipe 85 and flows into the heat-source side refrigerant pipeline 2 on the downstream side of the compression portion 82 through the refrigerant flow-rate controller 86. That is, the refrigerant compressed in the compression portion 82 is mixed with the remaining refrigerant flowing from the compression-portion bypass pipe 85 and decompressed.

The mixed refrigerant communicates through the heat-source side refrigerant pipeline 2 and the first extension pipeline 41 and flows into the outdoor unit 10. This refrigerant flows into the outdoor heat exchanger 13 through the heat-source side refrigerant channel switching portion 50 (check valve 51). Then, the refrigerant absorbs heat from the outdoor air in the outdoor heat exchanger 13 and becomes a low-temperature and low-pressure steam-state refrigerant. The refrigerant change at this time is expressed by a slightly inclined straight line close to a horizontal line shown from the point [f] to the point [a] in FIG. 24. The low-temperature and low-pressure steam-state refrigerant flowing out of the outdoor heat exchanger 13 returns to the compressor 11 through the four-way valve 12.

According to the air conditioner 300 configured as above, in addition to the effect of the air conditioner 100 according to Embodiment 1, the power generated in expansion of the heat-source side refrigerant in the full-cooling operation mode and the cooling main operation mode can be used for compression (pressure rising) of the heat-source side refrigerant, and the refrigerating cycle efficiency is improved. Also, by applying the configuration of the air conditioner 300 to the air conditioner 200 according to Embodiment 2, the refrigerating cycle efficiency can be further improved in addition to the effect of the air conditioner 200.

In Embodiment 3, a case in which the compression portion 82 of the expanding device 80 is disposed at the outlet side of the second intermediate heat exchanger 22 is shown as an example, but in order to compress the refrigerant flowing into the first intermediate heat exchanger 21 in the full-heating operation mode and the heating main operation mode, the compression portion 82 may be disposed at the inlet side of the first intermediate heat exchanger 21. With such a form, the refrigerant flowing into the first intermediate heat exchanger 21 can be compressed in the full-heating operation mode and the heating main operation mode, and the refrigerating cycle efficiency can be improved in the full-heating operation mode and the heating main operation mode.

Embodiment 4

Figure 25:
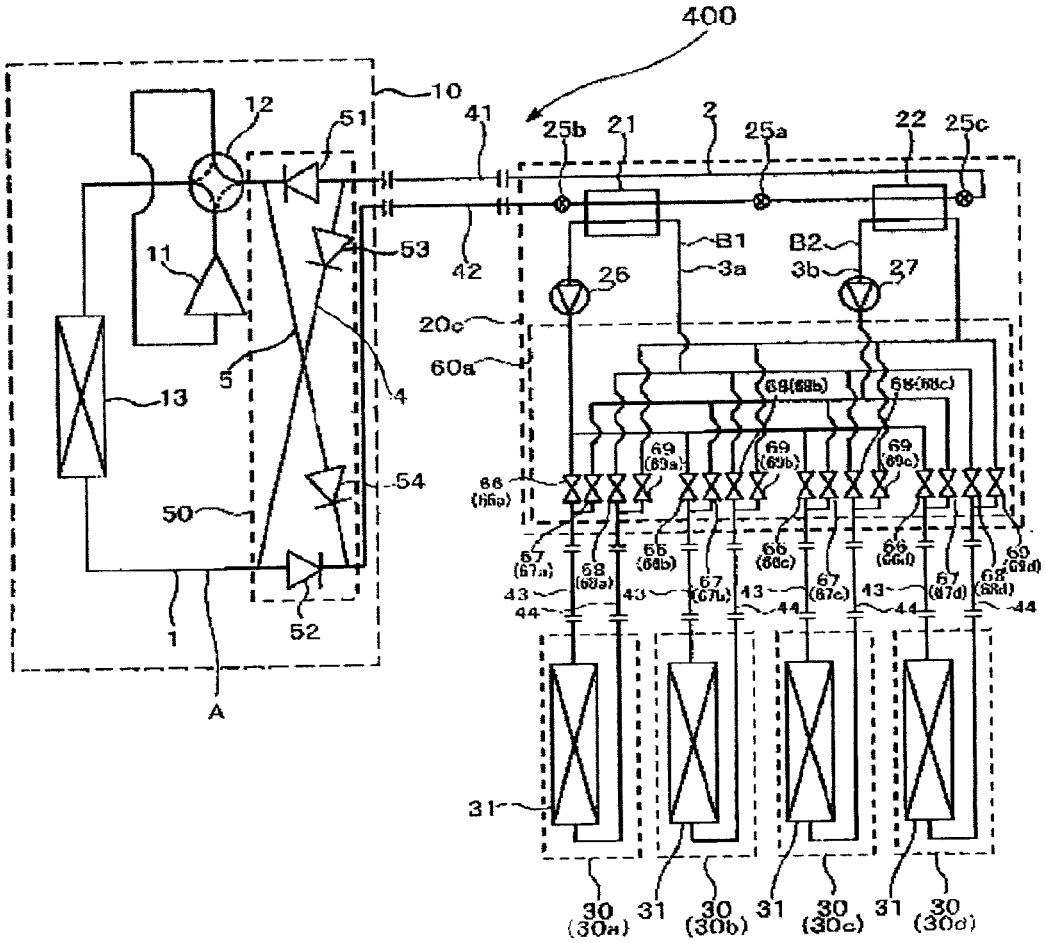
FIG. 25 is a circuit diagram illustrating a circuit configuration of an air conditioner 400 according to Embodiment 4.

FIG. 25 is a circuit diagram illustrating a circuit configuration of an air conditioner 400 according to Embodiment 4 of the present invention. On the basis of FIG. 25, the circuit configuration of the air conditioner 400 will be described. This air conditioner 400 is installed in a building, an apartment house and the like and capable of simultaneous supply of a cooling load and a heating load by using a refrigerating cycle (a heat-source side refrigerant circuit and a use-side refrigerant circuit) in which a refrigerant (a heat-source side refrigerant and a use-side refrigerant) is circulated similarly to the air conditioner 100, the air conditioner 200, and the air conditioner 300. In Embodiment 4, differences from Embodiment 1 to Embodiment 3 will be mainly described, and the same portions as those in Embodiment 1 to Embodiment 3 are given the same reference numerals and the description will be omitted.

As shown in FIG. 25, the air conditioner 400 according to Embodiment 4 is provided with a relay portion 20*c* in which a second refrigerant flow-rate controller 25*b* is disposed on the upstream side of the first intermediate heat exchanger 21 in the heat-source side refrigerant circuit A and a third refrigerant flow-rate controller 25*c* is disposed on the downstream side of the second intermediate heat exchanger 22 based on the configuration of the air conditioner 100 according to Embodiment 1. Also, in the relay portion 20*c*, a use-side refrigerant channel switching portion 60*a* for supplying either one of or both of the use side refrigerant having performed heat-exchange in the first intermediate heat exchanger 21 or the use-side refrigerant having performed heat-exchange in the second intermediate heat exchanger 22 to the selected indoor unit 30 is disposed.

That is, in the relay portion 20*c*, the second refrigerant flow-rate controller 25*b*, the first intermediate heat exchanger 21, the refrigerant flow-rate controller 25 (hereinafter referred to as a first refrigerant flow-rate controller 25*a* for convenience in the following description), the second intermediate heat exchanger 22, and the third refrigerant flow-rate controller 25*c* are connected in order in series by the heat-source side refrigerant pipeline 2 and disposed in the relay portion 20*c*. The second refrigerant flow-rate controller 25*b* and the third refrigerant flow-rate controller 25*c* function as a decompression valve or an expansion valve similarly to the first refrigerant flow-rate controller 25*a* and decompress and expand the heat-source side refrigerant. The second refrigerant flow-rate controller 25*b* and the third refrigerant flow-rate controller 25*c* are preferably configured by a device capable of variable control of its opening degree such as an electronic expansion valve.

The use-side refrigerant channel switching portion 60*a* is provided with a plurality of water channel switching valves (a fifth switching valve 66, a sixth switching valve 67, a seventh switching valve 68, and an eighth switching valve 69). The fifth switching valve 66, the sixth switching valve 67, the seventh switching valve 69, and the eighth switching valve 69 are disposed in the number (here, four each) according to the number of indoor units 30 connected to the relay portion 20*c*. Also, the use-side refrigerant pipeline 3 is branched (here, branched into four each) in the use-side refrigerant channel switching portion 60*a* according to the number of indoor units 30 connected to the relay portion 20*c* and connects the use-side refrigerant channel switching portion 60*a* to the third extension pipeline 43 and the fourth extension pipeline 44 connected to each of the indoor units 30. That is, the fifth switching valve 66, the sixth switching valve 67, the seventh switching valve 68, and the eighth switching valve 69 are disposed in each of the branched use-side refrigerant pipeline 3.

The fifth switching valve 66 is disposed in a use-side refrigerant pipeline 3*a* between the first pump 26 and each indoor heat exchanger 31, that is, in the use-side refrigerant pipeline 3*a* on the inflow side of the indoor heat exchanger 31. The fifth switching valve 66 is configured by a two-way valve and is connected to the first pump 26 through the use-side refrigerant pipeline 3*a* and also connected to the third extension pipeline 43 through the use-side refrigerant pipeline 3*a*. The sixth switching valve 67 is disposed in a use-side refrigerant pipeline 3*b* between the second pump 27 and each indoor heat exchanger 31, that is, in the use-side refrigerant pipeline 3*b* on the inflow side of the indoor heat exchanger 31. The sixth switching valve 67 is configured by a two-way valve and is connected to the second pump 27 through the use-side refrigerant pipeline 3*b* and also connected to the third extension pipeline 43 through the use-side refrigerant pipeline 3*b*.

The seventh switching valve 68 is disposed in a use-side refrigerant pipeline 3*a* between the indoor heat exchanger 31 and the first intermediate heat exchanger 21, that is, in the use-side refrigerant pipeline 3*a* on the outflow side of the indoor heat exchanger 31. The seventh switching valve 68 is configured by a two-way valve and is connected to the fourth extension pipeline 44 through the use-side refrigerant pipeline 3*a* and also connected to the first pump 26 through the use-side refrigerant pipeline 3*a*. The eighth switching valve 69 is disposed in a use-side refrigerant pipeline 3*b* between the indoor heat exchanger 31 and the second intermediate heat exchanger 22, that is, in the use-side refrigerant pipeline 3*b* on the outflow side of the indoor heat exchanger 31. The eighth switching valve 69 is configured by a two-way valve and is connected to the fourth extension pipeline 44 through the use-side refrigerant pipeline 3*b* and also connected to the second pump 27 through the use-side refrigerant pipeline 3*a*.

Here, each operation mode performed by the air conditioner 400 will be described. This air conditioner 400 is capable of the cooling operation or the heating operation with the indoor unit 30 on the basis of an instruction from each indoor unit 30. That is, the air conditioner 400 can perform four operation modes (a full-cooling operation mode, a full-heating operation mode, a cooling main operation mode, and a heating main operation mode) similarly to the air conditioner 100, the air conditioner 200, and the air conditioner 300. The full-cooling operation mode, the full-heating operation mode, the cooling main operation mode, and the heating main operation mode performed by the air conditioner 300 will be described below together with a flow of the refrigerant.

[Full-cooling Operation Mode]

Figure 26:
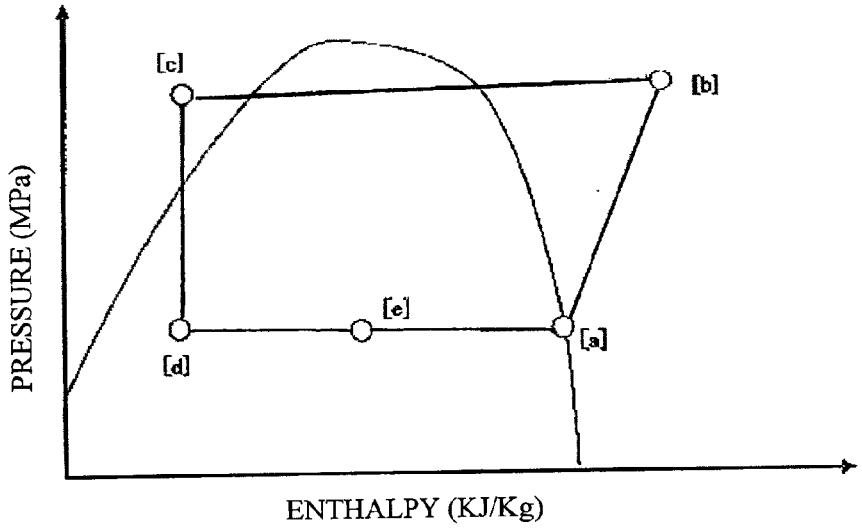
FIG. 26 is a p-h diagram illustrating a change of the heat-source side refrigerant in the full-cooling operation mode.

FIG. 26 is a p-h diagram (diagram illustrating a relationship between a pressure of the refrigerant and enthalpy) illustrating a change of the heat-source side refrigerant in the full-cooling operation mode of the air conditioner 400. On the basis of FIGS. 25 and 26, the full-cooling operation mode performed by the air conditioner 400 will be described together with a flow of the refrigerant (a heat-source refrigerant and a use-side refrigerant) in the full-coiling operation mode.

If all the indoor units 30 perform the cooling operation, in the outdoor unit 10, the four-way valve 12 is switched so that the heat-source side refrigerant discharged from the compressor 11 flows into the outdoor heat exchanger 13. In the relay portion 20*c*, the opening degrees of the first refrigerant flow-rate controller 25*a* and the third refrigerant flow-rate controller 25*c* are fully opened, the opening degree of the second refrigerant flow-rate controller 25*b* is throttled, the first pump 26 and the second pump 27 are driven, and the fifth switching valve 66, the sixth switching valve 67, the seventh switching valve 68, and the eighth switching valve 69 of the use-side refrigerant channel switching portion 60*a* are fully opened so that the use-side refrigerant circulates between the first intermediate heat exchanger 21 and each indoor unit 30 and between the second intermediate heat exchanger 22 and each indoor unit 30. In this state, the operation of the compressor 11 is started.

First, a flow of the heat-source side refrigerant in the heat-source side refrigerant circuit A will be described. A low-temperature and high-pressure steam-state refrigerant is compressed by the compressor 11 and discharged as a high-temperature and high-pressure refrigerant.

Supposing that there is no heat coming in going out with respect to the periphery, a refrigerant compression process of the compressor 11 is expressed by an isoentropic line shown from the point [a] to the point [b] in FIG. 26. The high-temperature and high-pressure refrigerant discharged from the compressor 11 goes through the four-way valve 12 and flows into the outdoor heat exchanger 13. Then, the refrigerant is condensed and liquefied while radiating heat to the outdoor air in the outdoor heat exchanger 13 and becomes a high-pressure liquid-state refrigerant. A change in the refrigerant in the outdoor heat exchanger 13 is made under a substantially constant pressure. The refrigerant change at this time is expressed by a slightly inclined straight line close to a horizontal line shown from the point [b] to the point [c] in FIG. 26, considering pressure loss of the outdoor heat exchanger 13.

The high-pressure liquid-state refrigerant flowing out of the outdoor heat exchanger 13 communicates through the second extension pipeline 42 via the heat-source side refrigerant channel switching portion 50 (check valve 52) and flows into the relay portion 20*c*. The high-pressure liquid-state refrigerant having flown into the relay portion 20*e* is throttled by the second refrigerant flow-rate controller 25*b* and expanded (decompressed) and brought into a low-temperature and low-pressure gas-liquid two-phase state. The refrigerant change in the second refrigerant flow-rate controller 25*b* is made under constant enthalpy. The refrigerant change at this time is expressed by a perpendicular line shown from the point [c] to the point [d] in FIG. 26.

The gas-liquid two-phase state refrigerant throttled in the second refrigerant flow-rate controller 25*b* flows into the first intermediate heat exchanger 21. The refrigerant having flown into the first intermediate heat exchanger 21 absorbs heat from the use-side refrigerant circulating in the first use-side refrigerant circuit B1 while cooling the use-side refrigerant and becomes a gas-liquid two-phase state refrigerant. A change in the refrigerant in the first intermediate heat exchanger 21 is made under a substantially constant pressure. The refrigerant change at this time is expressed by a slightly inclined straight line close to a horizontal line shown from the point [d] to the point [e] in FIG. 26, considering pressure loss of the first intermediate heat exchanger 21.

The heat-source side refrigerant flowing out of the first intermediate heat exchanger 21 goes through the first flow-rate controller 25*a*, flows into the second intermediate heat exchanger 22 and absorbs heal from the use-side refrigerant circulating in the second use-side refrigerant circuit B2 while cooling the use-side refrigerant and becomes a low-temperature and low-pressure steam-state refrigerant. A change in the refrigerant in the second intermediate heat exchanger 22 is made under a substantially constant pressure. The refrigerant change at this time is expressed by a slightly inclined straight line close to a horizontal line shown from the point [e] to the point [a] in FIG. 25, considering pressure loss of the second intermediate heat exchanger 22. The low-temperature and low-pressure steam-state refrigerant flowing out of the second intermediate heat exchanger 22 communicates through the first extension pipeline 41 and returns to the compressor 11 through the heat-source side refrigerant channel switching portion 50 (check valve 51) and the four-way valve 12.

Subsequently, the flow of the use-side refrigerant in the use-side refrigerant circuit B will be described. In the full-cooling operation mode, both the first pump 26 and the second pump 27 are driven. The use-side refrigerant cooled by the heat-source side refrigerant in the first intermediate heat exchanger 21 and the second intermediate heat exchanger 22 flows into the use-side refrigerant channel switching portion 60*a* by the first pump 26 and the second pump 27. The use-side refrigerant having flown into the use-side refrigerant channel switching portion 60*a* goes through the fifth switching valve 66 and the sixth switching valve 67, communicates through the use-side refrigerant pipeline 3 and the third extension pipeline 43 and flows into each of the indoor heat exchangers 31. Then, the refrigerant absorbs heat from the indoor air in the indoor heat exchanger 31 and cools the area to be air-conditioned such as the inside of a room where the indoor unit 30 is installed. After that, the use-side refrigerants flowing out of the indoor heat exchanger 31 communicate through the fourth extension pipeline 44, go through the seventh switching valve 68 and the eighth switching valve 69, merge in the use-side refrigerant channel switching portion 60*a* and branched and then, flow into the first intermediate heat exchanger 21 and the second intermediate heat exchanger 22 again.

[Full-heating Operation Mode]

Figure 27:
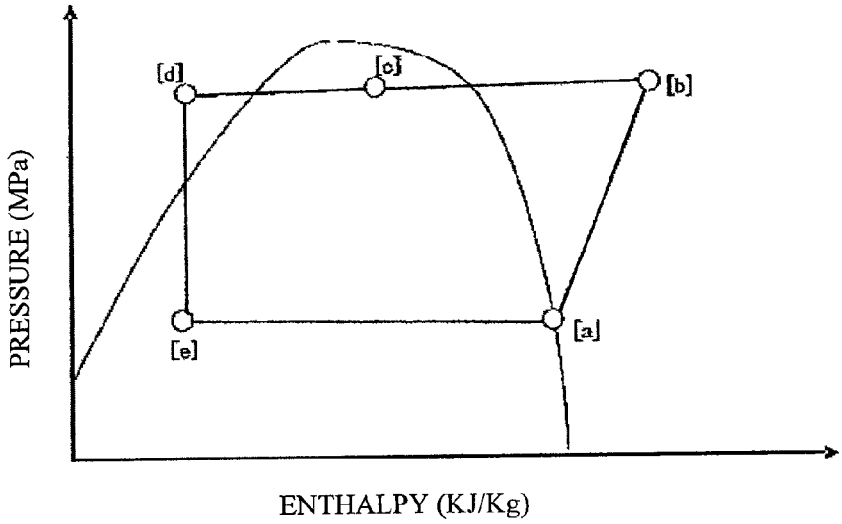
FIG. 27 is a p-h diagram illustrating a change of the heat-source side refrigerant in the full-heating operation mode.

FIG. 27 is a p-h diagram (diagram illustrating a relationship between a pressure of the refrigerant and enthalpy) illustrating a change of the heat-source side refrigerant in the full-cooling operation mode of the air conditioner 400. On the basis of FIGS. 25 and 27, the full-heating operation mode performed by the air conditioner 400 will be described together with a flow of the refrigerant (a heat-source refrigerant and a use-side refrigerant) in the full-heating operation mode.

If all the indoor units 30 perform the heating operation, in the outdoor unit 10, the four-way valve 12 is switched so that the heat-source side refrigerant discharged from the compressor 11 flows into the relay portion 20*c* without going through the outdoor heat exchanger 13. In the relay portion 20*c*, the first refrigerant flow-rate controller 25*a* and the second refrigerant flow-rate controller 25*b* are fully opened, the opening degree of the third refrigerant flow-rate controller 25*c* is throttled, the first pump 26 and the second pump 27 are driven, and the fifth switching valve 66, the sixth switching valve 67, the seventh switching valve 68, and the eighth switching valve 69 of the use-side refrigerant channel switching portion 60*a* are fully opened so that the use-side refrigerant circulates between the first intermediate heat exchanger 21 and each indoor unit 30 and between the second intermediate heat exchanger 22 and each indoor unit 30. In this state, the operation of the compressor 11 is started.

First, a flow of the heat-source side refrigerant in the heat-source side refrigerant circuit A will be described. A low-temperature and low-pressure steam-state refrigerant is compressed by the compressor 11 and discharged as a high-temperature and high-pressure refrigerant.

The refrigerant compression process of the compressor 11 is expressed by an isoentropic line shown from the point [a] to the point [b] in FIG. 27. The high-temperature and high-pressure refrigerant discharged from the compressor 11 goes through the four-way valve 12 and the heat-source side refrigerant channel switching portion 50 (check valve 54), communicates through the second extension pipeline 42 and flows into the first intermediate heat exchanger 21 through the second refrigerant flow-rate controller 25*b* in the relay portion 20*c*. Then, the refrigerant having flown into the first intermediate heat exchanger 21 is condensed and liquefied while radiating heat to the use-side refrigerant circulating in the first use-side refrigerant circuit B1 and becomes a high-pressure gas-liquid two-phase state refrigerant. The refrigerant change at this time is expressed by a slightly inclined straight line close to a horizontal line shown from the point [b] to the point [c] in FIG. 27.

The high-pressure refrigerant flowing out of the first intermediate heat exchanger 21 flows into the second intermediate heat exchanger 22 through the first refrigerant flow-rate controller 25*a*. The refrigerant having flown into the second intermediate heat exchanger 22 is further condensed while radiating heat to the use-side refrigerant circulating in the second use-side refrigerant circuit B2 and becomes a high-pressure liquid-state refrigerant. The refrigerant change at this time is expressed by a slightly inclined straight line close to a horizontal line shown from the point [c] to the point [d] in FIG. 27. The refrigerant flowing out of the second intermediate heat exchanger 22 is throttled by the third refrigerant flow-rate controller 25*c* and expanded (decompressed) and brought into a low-temperature and low-pressure gas-liquid two-phase state. The refrigerant change at this time is expressed by a perpendicular line shown from the point [d] to the point [e] in FIG. 27.

The gas-liquid two-phase state refrigerant throttled by the third refrigerant flow-rate controller 25*c* communicates through the heat-source side refrigerant pipeline 2 and the first extension pipeline 41 and flows into the outdoor unit 10. This refrigerant flows into the outdoor heat exchanger 13 through the heat-source side refrigerant channel switching portion 50 (check valve 53). Then, the refrigerant absorbs heat from the outdoor air in the outdoor heat exchanger 13 and becomes a low-temperature and low-pressure steam-state refrigerant. The refrigerant change at this time is expressed by a slightly inclined straight line close to a horizontal line shown from the point [e] to the point [a] in FIG. 27. The low-temperature and low-pressure steam-state refrigerant flowing out of the outdoor heat exchanger 13 returns to the compressor 11 through the four-way valve 12.

Subsequently, the flow of the use-side refrigerant in the use-side refrigerant circuit B will be described. In the full-heating operation mode, both the first pump 26 and the second pump 27 are driven. The use-side refrigerant heated by the heat-source side refrigerant in the first intermediate heat exchanger 21 and the second intermediate heat exchanger 22 flows into the use-side refrigerant channel switching portion 60*a* by the first pump 26 and the second pump 27. The use-side refrigerant having flown into the use-side refrigerant channel switching portion 60*a* goes through the fifth switching valve 66 and the sixth switching valve 67, communicates through the use-side refrigerant pipeline 3 and the third extension pipeline 43 flows into each of the indoor heat exchangers 31. Then, the refrigerant radiates heat to the indoor air in the indoor heat exchanger 31 and heats the area to be air-conditioned such as the inside of a room where the indoor unit 30 is installed. After that, the use-side refrigerants flowing out of the indoor heat exchanger 31 communicate through the fourth extension pipeline 44, go through the seventh switching valve 68 and the eighth switching valve 69, merge in the use-side refrigerant channel switching portion 60*a* and branched and then, flows into the first intermediate heat exchanger 21 and the second intermediate heat exchanger 22 again.

[Cooling Main Operation Mode]

This cooling main operation mode is a simultaneous cooling/heating operation mode in which a cooling load is larger such that three indoor units 30 perform the cooling operation and the single indoor unit 30 performs the heating operation, for example. In FIG. 25, the three indoor units 30 performing the cooling operation are shown as the indoor unit 30*a*, the indoor unit 30*b*, and the indoor unit 30*c* from the left side on the drawing and the single indoor unit 30 on the right side on the drawing performing the heating operation as the indoor unit 30*d*. Also, according to the indoor unit 30*a* to the indoor unit 30*d*, the fifth switching valves 66 connected to each of them are shown as the fifth switching valve 66*a* to the fifth switching valve 66*d*, the sixth switching valves 67 connected to each of them as the sixth switching valve 67*a* to the sixth switching valve 67*d*, the seventh switching valves 68 connected to each of them as the seventh switching valve 68*a* to the seventh switching valve 68*d*, and the eighth switching valves 69 connected to each of them as the eighth switching valve 69*a* to the eighth switching valve 69*d*.

If the indoor unit 30*a* to the indoor unit 30*c* performs the cooling operation and the indoor unit 30*d* performs the heating operation, in the outdoor unit 10, the four-way valve 12 is switched so that the heat-source side refrigerant discharged from the compressor 11 flows into the outdoor heat exchanger 13. In the relay portion 20*c*, the opening degree of the first refrigerant flow-rate controller 25*a* is throttled, the second refrigerant flow-rate controller 25*b* and the third refrigerant flow-rate controller 25*c* are fully opened, and the first pump 26 and the second pump 27 are driven.

Also, in the use-side refrigerant channel switching portion 60*a* of the relay portion 20*c*, the fifth switching valve 66*a* to the fifth switching valve 61*c* and the seventh switching valve 68*a* to the seventh switching valve 68*c* are closed, the sixth switching valve 67*a* to the sixth switching valve 67*c* and the eighth switching valve 69*a* to the eighth switching valve 69*c* are opened so that the use-side refrigerant circulates between the second intermediate heat exchanger 22 and the indoor unit 30*a* to the indoor unit 30*c*. Also, the fifth switching valve 66*d* and the seventh switching valve 68*d* are opened, and the sixth switching valve 67*d* and the eighth switching valve 69*d* are closed so that the use-side refrigerant circulates between the first intermediate heat exchanger 21 and the indoor unit 30*d*. In this state, the operation of the compressor 11 is started. Since the flows of the heat-source refrigerant and the use-side refrigerant are the same as those in Embodiment 1, the description will be omitted.

[Heating Main Operation Mode]

The heating main operation mode is a simultaneous cooling/heating operation mode in which a heating load is larger such that three indoor units 30 perform the heating operation, while a single indoor unit 30 performs a cooling operation. In FIG. 25, the three indoor units 30 performing the heating operation are shown as the indoor unit 30*a*, the indoor unit 30*b*, and the indoor unit 30*c* from the left side on the drawing and the single indoor unit 30 on the right side on the drawing performing the cooling operation as the indoor unit 30*d*. Also, according to the indoor unit 30*a* to the indoor unit 30*d*, the fifth switching valves 66 connected to each of them are shown as the fifth switching valve 66*a* to the fifth switching valve 66*d*, the sixth switching valves 67 connected to each of them as the sixth switching valve 67*a* to the sixth switching valve 67*d*, the seventh switching valves 68 connected to each of them as the seventh switching valve 68*a* to the seventh switching valve 68*d*, and the eighth switching valves 69 connected to each of them as the eighth switching valve 69*a* to the eighth switching valve 69*d*.

If the indoor unit 30*a* to the indoor unit 30*c* perform the heating operation and the indoor unit 30*d* performs the cooling operation, in the outdoor unit 10, the four-way valve 12 is switched so that the heat-source side refrigerant discharged from the compressor 11 flows into the relay portion 20*c* without going through the outdoor heat exchanger 13. In the relay portion 20*c*, an opening degree of the first refrigerant flow-rate controller 25*a* is throttled, the second refrigerant flow-rate controller 25*b* and the third refrigerant flow-rate controller 25*c* are fully opened, and the first pump 26 and the second pump 27 are driven.

Also, in the use-side refrigerant channel switching portion 60*a* of the relay portion 20*c*, the fifth switching valve 66*a* to the fifth switching valve 61*c* and the seventh switching valve 68*a* to the seventh switching valve 68*c* are opened, the sixth switching valve 67*a* to the sixth switching valve 67*c* and the eighth switching valve 69*a* to the eighth switching valve 69*c* are closed so that the use-side refrigerant circulates between the first intermediate heat exchanger 21 and the indoor unit 30*a* to the indoor unit 30*c*. Also, the fifth switching valve 66*d* and the seventh switching valve 68*d* are closed, and the sixth switching valve 67*d* and the eighth switching valve 69*d* are opened so that the use-side refrigerant circulates between the second intermediate heat exchanger 22 and the indoor unit 30*d*. In this state, the operation of the compressor 11 is started. Since the flows of the heat-source refrigerant and the use-side refrigerant are the same as those in Embodiment 1, the description will be omitted.

According to the air conditioner 400 configured as above, in addition to the effect of the air conditioner 100 according to Embodiment 1, the first intermediate heat exchanger 21 and the second intermediate heat exchanger 22 as well as the first pump 26 and the second pump 27 can be used in the full-cooling operation mode and the full-heating operation mode, and the sizes of the first intermediate heat exchanger 21, the second intermediate heat exchanger 22, the first pump 26, and the second pump 27 can be reduced, which is an effect to be obtained. That is, contribution can be made to size reduction of the relay portion 20*c*.

Embodiment 5

Figure 28:
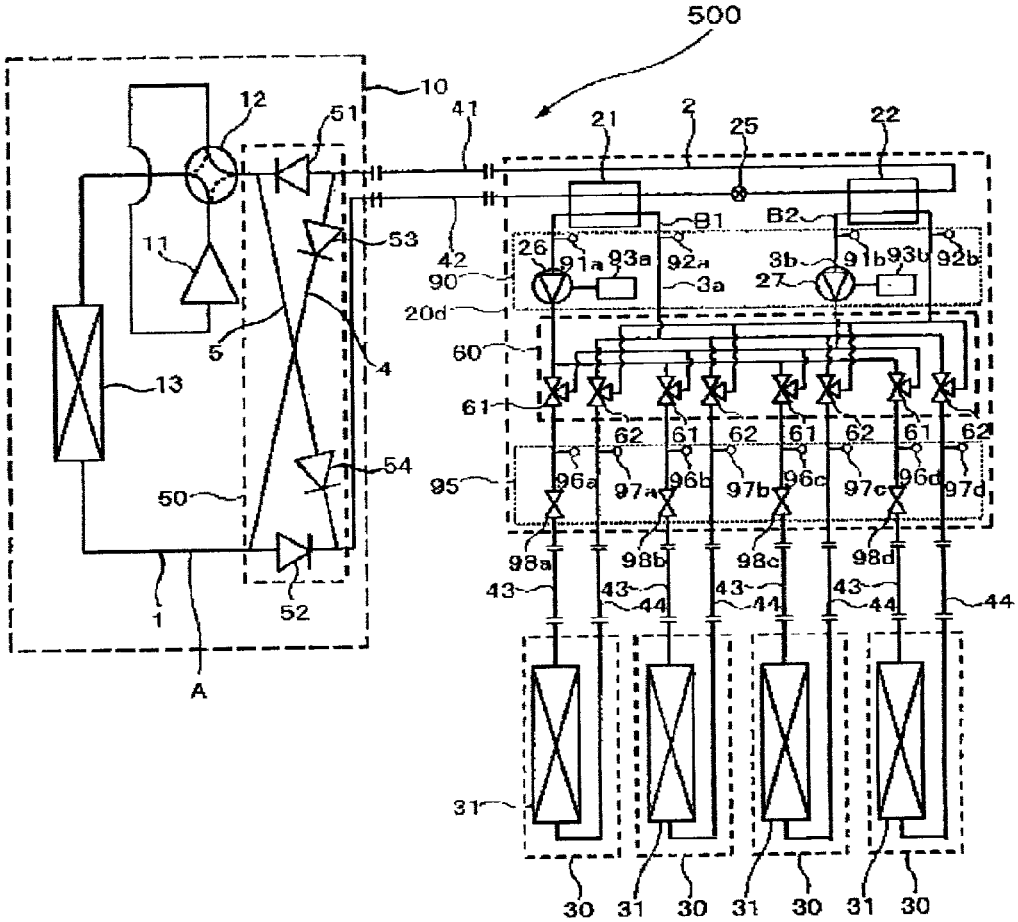
FIG. 28 is a circuit diagram illustrating a circuit configuration of an air conditioner according to Embodiment 5 of the present invention.

FIG. 28 is a circuit diagram illustrating a circuit configuration of an air conditioner 500 according to Embodiment 5 of the present invention. On the basis of FIG. 28, the configuration of the air conditioner 500 and a control operation of the use-side refrigerant circuit B will be described. This air conditioner 500 is installed in a building, an apartment house and the like and capable of simultaneous supply of a cooling load and a heating load by using a refrigerating cycle (a heat-source side refrigerant circuit and a use-side refrigerant circuit) in which a refrigerant (a heat-source side refrigerant and a use-side refrigerant) is circulated similarly to the air conditioner 100, the air conditioner 200, the air conditioner 300, and the air conditioner 400. In Embodiment 5, differences from Embodiment 1 to Embodiment 4 will be mainly described, and the same portions as those in Embodiment 1 to Embodiment 4 are given the same reference numerals and the description will be omitted.

The air conditioner 500 according to Embodiment 5 is provided with a relay portion 20*d* in which a first use-side refrigerant flow-rate control portion 90 and a second use-side flow-rate control portion 95 for controlling a flow rate of the use-side refrigerant circulating in the use-side refrigerant circuit B based on the configuration of the air conditioner 100 according to Embodiment 1. The first use-side refrigerant flow-rate control portion 90 is disposed between the first intermediate heat exchanger 21 as well as the second intermediate heat exchanger 22 and the use-side refrigerant channel switching portion 60 and particularly controls a flow rate of the use-side refrigerant flowing into the first intermediate heat exchanger 22 and the second intermediate heat exchanger 22. The second use-side refrigerant flow-rate control portion 95 is disposed between the use-side refrigerant channel switching portion 60 and the indoor unit 30 and particularly controls a flow rate of the use-side refrigerant supplied to the indoor unit 30.

The first use-side refrigerant flow-rate control portion 90 is configured by two first temperature sensors 91 (a first temperature sensor 91*a* and a first temperature sensor 91*b*), two second temperature sensors 92 (a second temperature sensor 92*a* and a second temperature sensor 92*b*), and two inverters 93 (an inverter 93*a* and an inverter 93*b*). The second use-side refrigerant flow-rate control portion 95 is configured by indoor inflow-side temperature sensors 96 in the same number of units as that of the indoor units 30 (an indoor inflow-side temperature sensor 96*a* to an indoor inflow-side temperature sensor 96*d*), indoor outflow-side temperature sensors 97 in the same number of units as that of the indoor units 30 (an indoor outflow-side temperature sensor 97*a* to an indoor outflow-side temperature sensor 97*d*), and flow-rate control valves 98 in the same number of units as that of the indoor units 30 (a flow-rate control valve 98*a* to a flow-rate control valve 98*d*). Description will be made supposing that the second use-side refrigerant flow-rate control portion 95 is also controlled by the inverter 93.

The first temperature sensor 91*a* is disposed in the first use-side refrigerant pipeline 3*a* between the first intermediate heat exchanger 21 and the first pump 26 and detects a temperature of the use-side refrigerant communicating through the first use-side refrigerant pipeline 3*a* at this position. The first temperature sensor 91*b* is disposed in the second use-side refrigerant pipeline 3*b* between the second intermediate heat exchanger 22 and the second pump 27 and detects a temperature of the use-side refrigerant communicating through the second use-side refrigerant pipeline 3*b* at this position. Temperature information detected by the first temperature sensor 91 is sent to the inverter 93. It is only necessary that the first temperature sensor 91 can detect a temperature of the use-side refrigerant communicating through the use-side refrigerant pipeline 3 and may be preferably configured by a thermometer or thermistor, for example.

The second temperature sensor 92*a* is disposed in the first use-side refrigerant pipeline 3*a* between the use-side refrigerant channel switching portion 60 and the first intermediate heat exchanger 21 and detects a temperature of the use-side refrigerant communicating through the first use-side refrigerant pipeline 3*a* at this position. The second temperature sensor 92*b* is disposed in the second use-side refrigerant pipeline 3*b* between the use-side refrigerant switching portion 60 and the second intermediate heat exchanger 22 and detects a temperature of the use-side refrigerant communicating through the second use-side refrigerant pipeline 3*b* at this position. Temperature information detected by the second temperature sensor 92 is sent to the inverter 93. It is only necessary that the second temperature sensor 92 can detect a temperature of the use-side refrigerant communicating through the use-side refrigerant pipeline 3 and may be preferably configured by a thermometer or thermistor.

The inverter 93*a* is connected to the first pump 26 and adjusts driving of the first pump 26 and controls a flow rate of the use-side refrigerant circulating in the first use-side refrigerant circuit B1. The inverter 93*b* is connected to the second pump 27 and adjusts driving of the second pump 27 and controls a flow rate of the use-side refrigerant circulating in the second use-side refrigerant circuit B2. That is, the inverter 93 adjusts the driving of the first pump 26 and the second pump 27 and controls the flow rate of the use-side refrigerant flowing into the indoor unit 30 on the basis of temperature information from the first temperature sensor 91 and the second temperature sensor 92.

The indoor inflow-side temperature sensor 96*a* to the indoor inflow-side temperature sensor 96*d* are disposed in the use-side refrigerant pipeline 3 between the first switching valve 61 and the flow-rate control valve 98*a* to the flow-rate control valve 98*d* and detects a temperature of the use-side refrigerant flowing into the indoor unit 30. The temperature information detected by the indoor inflow-side temperature sensor 96*a* to the indoor inflow-side temperature sensor 96*d* is sent to a controller, not shown. It is only necessary that the indoor inflow-side temperature sensor 96*a* to the indoor inflow-side temperature sensor 96*d* can detect the temperature of the use-side refrigerant communicating through the use-side refrigerant pipeline 3 and may be preferably configured by a thermometer or thermistor, for example.

The indoor outflow-side temperature sensor 97*a* to the indoor outflow-side temperature sensor 97*d* are disposed in the use-side refrigerant pipeline 3 between the indoor heat exchanger 31 and the second switching valve 62 and detects a temperature of the use-side refrigerant flowing out of the indoor unit 30. The temperature information detected by the indoor outflow-side temperature sensor 97*a* to the indoor outflow-side temperature sensor 97*d* is sent to a controller, not shown. It is only necessary that the indoor outflow-side temperature sensor 97*a* to the indoor outflow-side temperature sensor 97*d* can detect the temperature of the use-side refrigerant communicating through the use-side refrigerant pipeline 3 and may be preferably configured by a thermometer or thermistor, for example.

The flow-rate control valve 98*a* to the flow-rate control valve 98*d* are disposed in the use-side refrigerant pipeline 3 between the indoor inflow-side temperature sensor 96*a* to the indoor inflow-side temperature sensor 96*d* and the indoor heat exchanger 31 and adjusts the flow rate of the use-side refrigerant flowing into the indoor heat exchanger 31 through opening/closing controlled by the controller, not shown. The controller may be mounted on the inverter 93*a* and the inverter 93*b* or may be provided separately from the inverter 93*a* and the inverter 93*b*. Also, a configuration in which the inverter 93*a* and the inverter 93*b* control the driving of the first pump 26 and the second pump 27 has been described as an example, but it may be so configured that the inverter 93*a* and the inverter 93*b* are also controlled by the controller so as to adjust the driving of the first pump 26 and the second pump 27.

Here, an example of a control operation of the use-side refrigerant circuit B executed by the air conditioner 500 will be described. The inverter 93*a* and the inverter 93*b* control the first pump 26 and the second pump 27 on the basis of the information from each temperature sensor and adjust the flow rate of the use-side refrigerant circulating in the use-side refrigerant circuit B. Also, the inverter 93 adjusts an air amount of a blower disposed in the indoor unit 30, for example, so as to control the use-side refrigerant circuit B. Also, a bypass pipe bypassing the first pump 26 and the second pump 27 and a valve device for controlling a flow rate of the use-side refrigerant communicating through the bypass pipe may be provided in order to control the use-side refrigerant circuit B. Moreover, a plurality of pumps may be provided in order to control the use-side refrigerant circuit B according to the number of pumps to be operated.

If an instruction of the cooling operation or the heating operation is given to the indoor unit 30 from a user through a remote controller or the like, the inverter 93 starts a control operation according to the instruction. First, the inverter 93 grasps an atmosphere situation of the inside of a room where the indoor unit which was given the instruction is installed or the like on the basis of the temperature information detected by the indoor inflow-side temperature sensor 96 and the indoor outflow-side temperature sensor 97. Then, the inverter 93 determines flow rates of the use-side refrigerants to be discharged from the first pump 26 and the second pump 27 so as to compensate a difference between the temperature information and a predetermined temperature.

Then, the inverter 93 monitors the temperature information detected by the indoor inflow-side temperature sensor 96 and the indoor outflow-side temperature sensor 97 and adjusts the operations of the first pump 26 and the second pump 27 as appropriate on the basis of the temperature information detected by the first temperature sensor 91 and the second temperature sensor 92.

[Control Operation of the First Use-side Refrigerant Flow-rate Control Portion 90 in the Cooling Operation]

First, the inverter 93 specifies the indoor unit 30 to perform the cooling operation and controls driving of the first pump 26 and the second pump 27 according to the number of the indoor units 30 to be operated. Here, the use-side refrigerant circuit B in the above-mentioned full-cooling operation mode will be described. In the full-cooling operation mode, the first pump 26 is stopped, the second pump 27 is driven, and a circulating amount of the use-side refrigerant in the second use-side refrigerant circuit B2 is adjusted (See FIG. 2 shown in Embodiment 1 and FIG. 17 shown in Embodiment 3).

In the full-cooling operation, if the temperature information detected by the indoor outflow-side temperature sensor 97 is higher than a predetermined temperature T1, the inverter 93*b* determines that more cooling air needs to be supplied into the room or the like and controls the driving of the second pump 27 so as to increase the circulation amount of the use-side refrigerant in the second use-side refrigerant circuit B2. On the other hand, if the temperature information detected by the indoor outflow-side temperature sensor 97 is lower than the predetermined temperature T1, the inverter 93*b* determines that the cooling air does not need to be supplied into the room or the like any more and controls the driving of the second pump 27 so as to decrease the circulation amount of the use-side refrigerant in the second use-side refrigerant circuit B2.

Also, if the temperature information detected by the indoor inflow-side temperature sensor 96 is higher than a predetermined temperature T2, the inverter 93*b* determines that more cooling air needs to be supplied into the room or the like and controls the driving of the second pump 27 so as to increase the circulation amount of the use-side refrigerant in the second use-side refrigerant circuit B2. On the other hand, if the temperature information detected by the indoor inflow-side temperature sensor 96 is lower than the predetermined temperature T2, the inverter 93*b* determines that the cooling air does not need to be supplied into the room or the like any more and controls the driving of the second pump 27 so as to decrease the circulation amount of the use-side refrigerant in the second use-side refrigerant circuit B2.

[Control Operation of the First Use-side Refrigerant Flow-rate Control Portion 90 in the Heating Operation]

First, the inverter 93 specifies the indoor unit 30 to perform the heating operation and controls driving of the first pump 26 and the second pump 27 according to the number of the indoor units 30 to be operated. Here, the use-side refrigerant circuit B in the above-mentioned full-heating operation mode will be described. In the full-heating operation mode, the first pump 26 is driven, the second pump 27 is stopped, and a circulating amount of the use-side refrigerant in the first use-side refrigerant circuit B1 is adjusted (See FIG. 4 shown in Embodiment 1 and FIG. 19 shown in Embodiment 3).

In the full-heating operation, if the temperature information detected by the indoor outflow-side temperature sensor 97 is higher than a predetermined temperature T3, the inverter 93*a* determines that heating air does not need to be supplied into the room or the like any more and controls the driving of the first pump 26 so as to decrease the circulation amount of the use-side refrigerant in the first use-side refrigerant circuit B1. On the other hand, if the temperature information detected by the indoor outflow-side temperature sensor 97 is lower than the predetermined temperature T3, the inverter 93*a* determines that more heating air needs to be supplied into the room or the like and controls the driving of the first pump 26 so as to increase the circulation amount of the use-side refrigerant in the first use-side refrigerant circuit B1.

Also, if the temperature information detected by the indoor inflow-side temperature sensor 96 is higher than a predetermined temperature T4, the inverter 93*a* determines that the heating air does not need to be supplied into the room or the like any more and controls the driving of the first pump 26 so as to decrease the circulation amount of the use-side refrigerant in the first use-side refrigerant circuit B1. On the other hand, if the temperature information detected by the indoor inflow-side temperature sensor 96 is lower than the predetermined temperature T4, the inverter 93*a* determines that more heating air needs to be supplied into the room or the like and controls the driving of the second pump 27 so as to decrease the circulation amount of the use-side refrigerant in the first use-side refrigerant circuit B1.

[Control Operation of the Second Use-side Refrigerant Flow-rate Control Portion 95 in the Simultaneous Cooling/Heating Operation]

First, the inverter 93 specifies the indoor unit 30 to perform the cooling operation or the heating operation and controls driving of the first pump 26 and the second pump 27 according to the number of the indoor units 30 to be operated. Here, a case in which the use-side refrigerant is circulated in the first intermediate heat exchanger 21 (at least a single indoor unit 30 is performing the heating operation) and a case in which the use-side refrigerant is circulated in the second intermediate heat exchanger 22 (at least a single indoor unit 30 is performing the cooling operation) will be described.

In the operation mode in which the first intermediate heat exchanger 21 is functioning, if the inverter 93*a* determines that the temperature information from the second temperature sensor 92*a* is higher than a predetermined temperature T5, the inverter 93*a* determines that the heating air does not need to be supplied into the room or the like any more and controls the first pump 26 so as to decrease the circulation amount of the use-side refrigerant in the first use-side refrigerant circuit B1. On the other hand, if the inverter 93*a* determines that the temperature information from the second temperature sensor 92*a* is lower than the predetermined temperature T5, the inverter 93*a* determines that more heating air needs to be supplied into the room or the like and controls the first pump 26 so as to increase the circulation amount of the use-side refrigerant in the first use-side refrigerant circuit B1.

In the operation mode in which the second intermediate heat exchanger 22 is functioning, if the inverter 93 determines that the temperature information from the second temperature sensor 92*b* is higher than a predetermined temperature T6, the inverter 93 determines that more cooling air needs to be supplied into the room or the like and controls the second pump 27 so as to increase the circulation amount of the use-side refrigerant in the second use-side refrigerant circuit B2. On the other hand, if the inverter 93 determines that the temperature information from the second temperature sensor 92*b* is lower than the predetermined temperature T6, the inverter 93 determines that the cooling air does not need to be supplied into the room or the like any more and controls the second pump 27 so as to decrease the circulation amount of the use-side refrigerant in the second use-side refrigerant circuit B2.

Subsequently, an example of the control operation of the heat-source side refrigerant circuit A performed by the air conditioner 500 will be described in brief. The inverter 93 controls the use-side refrigerant circuit B and also is capable of controlling the heat-source side refrigerant circuit A. The inverter 93 adjusts the flow rate of the heat-source side refrigerant circulating in the heat-source side refrigerant circuit A by controlling a driving frequency of the compressor 11 on the basis of the temperature information from the first temperature sensor 91 and the second temperature sensor 92, switching of the four-way valve 12, an opening degree of the refrigerant flow-rate controller 25 (or the refrigerant flow-rate controller 86), an opening degree of a blower, not shown, for supplying air to the outdoor heat exchanger 13 and the like.

Upon an instruction of the cooling operation or the heating operation from a user to the indoor unit 30 through a remote controller or the like, the inverter 93 starts a control operation according to the instruction. First, the inverter 93 controls switching of the four-way valve 12 and determines a channel for the heat-source side refrigerant. Then, the inverter 93 determines the driving frequency of the compressor 11, the rotation of the blower, and the opening degree of the refrigerant flow-rate controller 25 and starts the operation according to the instruction. After that, the inverter 93 adjusts the flow rate of the use-side refrigerant circulating in the use-side refrigerant circuit B by controlling the first use-side refrigerant flow-rate control portion 90 and the second use-side refrigerant flow-rate control portion 95 and adjusts the flow rate of the heat-source side refrigerant made to flow into the first intermediate heat exchanger 21 and the second intermediate heat exchanger 22 by controlling the heat-source side refrigerant circuit A.

As mentioned above, in the air conditioner 500, since the flow rate of the use-side refrigerant can be controlled according to a thermal load of the indoor unit 30, the power of the first pump 26 and the second pump 27 can be reduced. Also, in the air conditioner 500, unlike the prior-art multi-chamber type air conditioners, there is no need to provide a refrigerant flow-rate controller (such as a throttle device in Patent Document 2, for example) in the indoor unit 30. Thus, in control of the flow rate of the use-side refrigerant by the refrigerant flow-rate controller, a noise and vibration generated from the indoor unit 30 can be reduced, and convenience for users can be improved.

Moreover, in the prior-art multi-chamber type air conditioners, a temperature of the refrigerant flowing into the indoor heat exchanger and a temperature of the refrigerant flowing out of the outdoor heat exchanger are detected, and an indoor temperature is adjusted by controlling the refrigerant flow-rate controller on the basis of these temperatures. Thus, in order to adjust the indoor temperature, in addition to communication between the outdoor unit and the relay portion, communication between the relay portion and the indoor unit needs to be conducted. However, in the air conditioner 500, the indoor temperature control can be made by controlling the use-side refrigerant circuit B on the basis of a detected temperature of each temperature sensor disposed in the relay portion 20*d*. Therefore, the communication between the relay portion 20*d* and the indoor unit 30 is not needed for the indoor temperature control, and control can be simplified.

In Embodiment 5, the case in which the inverter 93 executes various controls was described as an example, but not limited to that. For example, it may be so configured that a controller is provided separately from the inverter 93 and the controller executes various controls. Also, a controller may be provided in each of the outdoor unit 10, the relay portion 20*d*, and the indoor unit 30 so that each device is controlled by communication of each controller. Moreover, a temperature sensor for detecting a temperature of the heat-source side refrigerant may be provided in the heat-source side refrigerant circuit A so that a flow rate of the heat-source side refrigerant circulating in the heat-source side refrigerant circuit A is adjusted.

The predetermined temperature shown in Embodiment 5 (the predetermined temperature T1 to the predetermined temperature T6) is a temperature specified by a user, a temperature set in the air conditioner 500 in advance or a value determined by a correction temperature or the like calculated from those temperatures and a value such as a rotation number of the blower disposed in the indoor unit 30, for example. Also, the case in which the inverter 93 controls the use-side refrigerant circuit B on the basis of both the temperature information detected by the indoor outflow-side temperature sensor 97 and the indoor inflow-side temperature sensor 96 was described as an example, but the use-side refrigerant circuit B may be controlled on the basis of either one of the temperature information. Moreover, the use-side refrigerant circuit B may be controlled on the basis of a temperature specified in the indoor unit 30, a temperature set in the air conditioner 500 in advance, a value calculated on the basis of the temperature information (a differential temperature, for example) or a correction temperature calculated from those temperatures and a value of a rotation number of the blower disposed in the indoor unit 30 or the like.

In Embodiment 5, the case in which the flow-rate control valve 98 is disposed in the second use-side refrigerant flow-rate control portion 95 was described as an example, but not limited to that. For example, the second use-side refrigerant flow-rate control portion 95 may be configured by disposing a bypass pipeline connecting a pipeline on the refrigerant inflow side of the indoor heat exchanger 31 to a pipeline on the refrigerant outflow side and a valve device controlling a flow rate of the use-side refrigerant communicating through the bypass pipeline instead of the flow-rate control valve 98. The flow rate of the use-side refrigerant flowing into the indoor heat exchanger 31 can be also adjusted in this way. Also, the control operation described in Embodiment 5 can be applied to Embodiment 1 to Embodiment 4. Also, in the above Embodiment, the configuration in which the pump and the flow-rate control valve are controlled using the temperature information was described, but the similar effect can be obtained by providing a pressure sensor instead of the temperature sensor and by controlling a flow rate according to a pressure difference between an inlet and an outlet of a pump.

Embodiment 6

Figure 29:
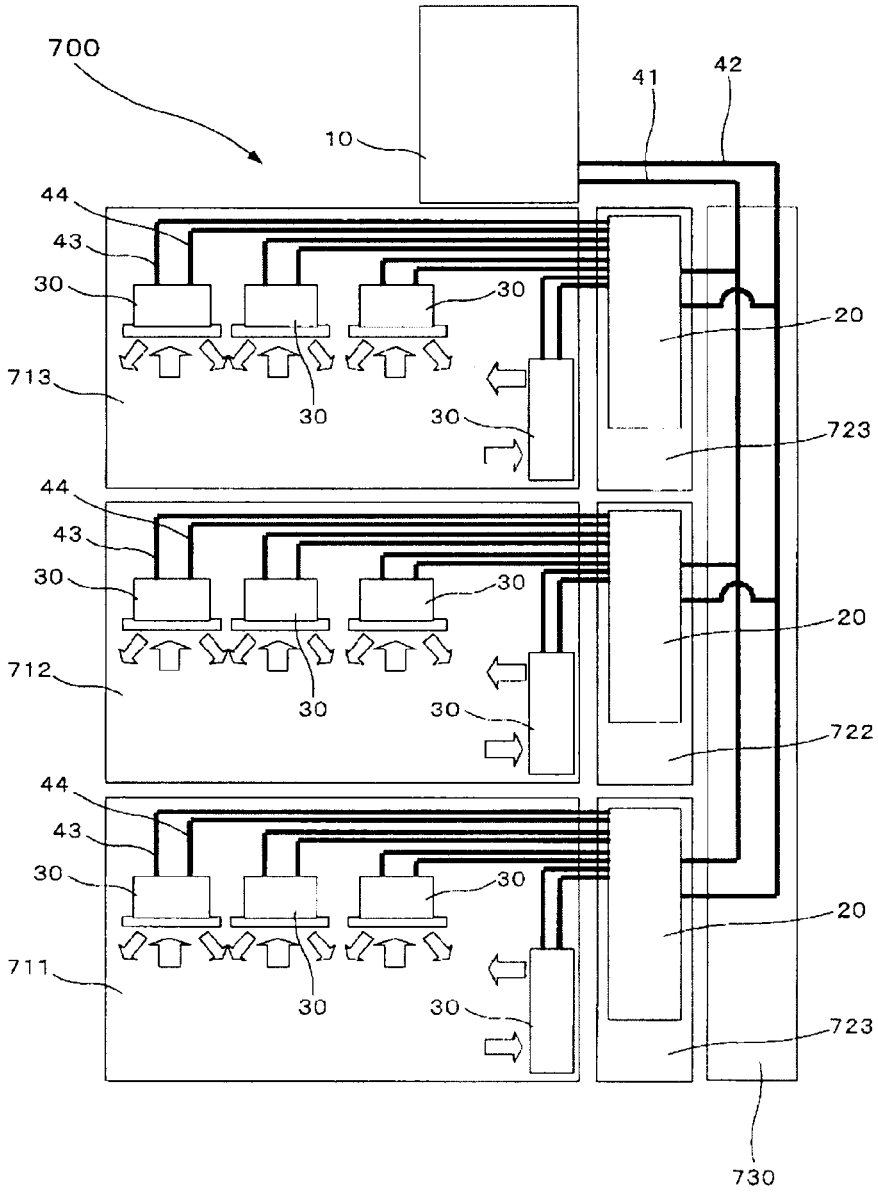
FIG. 29 is an installation outline diagram of an air conditioner according to Embodiment 6.

FIG. 29 is an installation outline diagram of an air conditioner in Embodiment 6. In Embodiment 6, an example of an installing method of the air conditioner shown in Embodiment 1 to Embodiment 5 in a building is shown. As shown in FIG. 29, the outdoor unit 10 is installed on the rooftop of a building 700. In a common space 721 provided on the first floor of the building 700, the relay portion 20 (also including the relay portion 20*a*, the relay portion 20*b*, the relay portion 20*c*, and the relay portion 20*d*) is installed. Also, four indoor units 30 are installed in a living space 711 provided on the first floor of the building 700.

Also, on the second floor and the third floor of the building 700, the relay portion 20 is installed in a common space 722 and a common space 723, and the four indoor units 30 are installed in a living space 712 and a living space 713. Here, the common space 721 to the common space 723 refer to a machine room, an open corridor, a lobby and the like provided on each floor of the building 700. That is, the common space 721 to the common space 723 are spaces other than the living space 711 to the living space 713 provided on each floor of the building 700.

The relay portion 20 installed in the common space on each floor (the common space 721 to the common space 723) is connected to the outdoor unit 10 by the first extension pipeline 41 and the second extension pipeline 42 disposed in a pipeline installation space 730. Also, the indoor units 30 installed in the living space on each floor (the living space 711 to the living space 713) are connected to the relay portion 20 installed in the common space on each floor, respectively, by the third extension pipeline 43 and the fourth extension pipeline 44.

In the air conditioner installed as above (the air conditioner 100, the air conditioner 200, the air conditioner 300, the air conditioner 400 or the air conditioner 500), since the use-side refrigerant such as water flows through the pipeline installed in the living space 711 to the living space 713, leakage of the heat-source side refrigerant whose allowable concentration of leakage into the space is regulated can be prevented from leaking into the living space 711 to the living space 713. Also, the indoor unit 30 on each floor becomes capable of the simultaneous cooling/heating operation.

Also, since the outdoor unit 10 and the relay portion 20 are provided at a location other than the living space, maintenance is facilitated. Also, since the relay portion 20 and the indoor unit 30 are structured capable of being separated, when the air conditioner is to be installed in place of the prior-art facility using a water refrigerant, the indoor unit 30, the third extension pipeline 43, and the fourth extension pipeline 44 can be reused. The outdoor unit 10 does not necessarily have to be installed on the rooftop of the building 700 but may be installed in a basement, a machine room on each floor and the like.

In the above, specific embodiments of the present invention have been described, but not limited to them, the present invention is capable of various variations or changes without departing from the scope and spirit of the present invention. Also, it may be so configured that two two-way switching valves are provided instead of the four-way valve 12 disposed in the outdoor unit 10. In Embodiment 1, the term "unit" in the outdoor unit 10 and the indoor unit 30 does not necessarily mean that all the constituent elements are disposed in the same housing or on the housing outer wall. For example, even if the heat-source side refrigerant channel switching portion 50 of the outdoor unit 10 is arranged at a location different from the housing in which the outdoor heat exchanger 13 is contained, such configuration is also included in the scope of the present invention.

In each of the embodiments, the case in which the first switching valve 61 and the second switching valve 62 disposed in the use-side refrigerant channel switching portion 60 are three-way valves was described but not limited to that. For example, as shown in Embodiment 4, the use-side refrigerant channel switching portion 60 may be configured by providing two two-way switching valves instead of a three-way valve. With such configuration, the flow direction of the refrigerant passing through the two-way switching valve can be made constant all the time in any of the operation mode executed by the air conditioner 100, the air conditioner 200, and the air conditioner 300, and a seal structure of the valve can be simplified.

Also, even if the first pump 26 and the second pump 27 of the relay portion 20 also including the relay portion 20*a*, the relay portion 20*b*, the relay portion 20*c*, and the relay portion 20*d*) are arranged at a location different from the housing in which the first intermediate heat exchanger 21 and the second intermediate heat exchanger 22 are contained, such configuration is also included in the scope of the present invention. Moreover, it may also be so configured that a plurality of sets including the outdoor heat exchanger 13 and the compressor 11 are provided in the outdoor unit 10, the refrigerant flowing out of each set is made to merge and communicate through the second extension pipeline 42 and flow into the relay portion 20, and the refrigerant flowing out of the relay portion 20 is made to communicate through the first extension pipeline 41 and branched and then, flow into each set.

Moreover, in the use-side refrigerant pipeline 3 of the air conditioner 100, the air conditioner 200, the air conditioner 300, the air conditioner 400, and the air conditioner 500, a strainer for trapping dusts in the use-side refrigerant or the like, an expansion tank for preventing breakage of a pipeline due to expansion of the use-side refrigerant, a constant pressure valve for regulating a discharge pressure of the first pump 26 and the second pump 27 and the like are not disposed, but an auxiliary device such as above for preventing valve clogging or the like of the first pump 26 and the second pump 27 may be provided. Moreover, in each Embodiment, the case in which the heat-source side refrigerant channel switching portion 50 is disposed in the outdoor unit 10 and the heat-source side refrigerant circuit A and the use-side refrigerant circuit B are in the counterflow style in the first intermediate heat exchanger 21 and the second intermediate heat exchanger 22 is shown as an example, but not limited to that.

The invention claimed is:

1. An air conditioner comprising:

a heat-source side refrigerant circuit in which a compressor, an outdoor heat exchanger, a plurality of intermediate heat exchangers, a first refrigerant flow-rate controller disposed between said plurality of intermediate heat exchangers, and a second refrigerant flow-rate controller disposed on an inlet side of a first intermediate heat exchanger located on an upstream side of said plurality of intermediate heat exchangers and a third refrigerant flow rate controller disposed on an outlet side of second intermediate heat exchanger located on downstream side in said plurality of intermediate heat exchangers are connected in series; and a plurality of use-side refrigerant circuits in which each of said plurality of intermediate heat exchangers and a plurality of indoor heat exchangers are connected in parallel, wherein said compressor and said outdoor heat exchanger are disposed in an outdoor unit;

wherein said plurality of intermediate heat exchangers, said first refrigerant flow-rate controller, and said second refrigerant flow-rate controller and said third flow rate controller are disposed in a relay portion;

wherein said plurality of indoor heat exchangers are disposed in a plurality of indoor units, respectively;

wherein said outdoor unit and said relay portion are connected by two refrigerant pipelines;

wherein in said plurality of intermediate heat exchangers, a heat-source side refrigerant circulating in said heat-source side refrigerant circuit and a use-side refrigerant circulating in said use-side refrigerant circuit perform heat exchange, wherein operation modes of the air conditioner include a full-cooling operation mode in which only a cooling operation is possible for all of the plurality of indoor units, a full-heating operation mode in which only a heating operation is possible for all of the plurality of the indoor units, and a simultaneous cooling and/or heating operation mode in which a cooling operation and a heating operation can be selected for each indoor unit;

wherein, in said simultaneous cooling and/or heating operation mode, an opening degree of said first refrigerant flow-rate controller is throttled and said first intermediate heat exchanger operates as a condenser and said second intermediate heat exchanger operates as an evaporator, wherein said first refrigerant flow-rate controller is fully opened and an opening degree of said second refrigerant flow-rate controller is throttled and all the intermediate heat exchangers operate as an evaporator in said full-cooling operation mode or wherein an opening degree of said third refrigerant flow-rate controller is throttled in said full-heating operation and said first refrigerant flow-rate controller and said second refrigerant flow-rate controller are fully opened and all the intermediate heat exchangers operate as a condenser in said full-heating operation mode, and wherein in each of said full-cooling operation mode and full-heating operation mode, each indoor heat exchanger is connected to all of the plurality of intermediate heat exchangers, the use-side refrigerant flowing out of each of the plurality of intermediate heat exchanger flows into each indoor heat exchanger after merging outside of the plurality of intermediate heat exchangers at a front side of each indoor heat exchanger, and the use-side refrigerant flowing out of each indoor heat exchanger flows into each intermediate heat exchanger after branching at a front side of each intermediate heat exchanger.

2. The air conditioner of claim 1, wherein said relay portion and each of said plurality of indoor units are connected by two extension pipelines.

3. The air conditioner of claim 2, wherein a use-side refrigerant channel switching portion, capable of selectively switching said plurality of use-side refrigerant circuits disposed in said relay portion, is disposed in said relay portion; and said use-side refrigerant channel switching portion selectively switches said plurality of use-side refrigerant circuits by connecting any one of said plurality of intermediate heat exchangers to a selected one of said indoor heat exchangers.

4. The air conditioner of claim 1, wherein, in said plurality of intermediate heat exchangers disposed in said relay portion, said heat-source side refrigerant circulating in said heat-source side refrigerant circuit and said use-side refrigerant circulating in said use-side refrigerant circuit are counterflows.

5. The air conditioner of claim 1, wherein, in said relay portion, a use-side refrigerant flow-rate control portion controlling a flow rate of the use-side refrigerant circulating in said use-side refrigerant circuit is disposed.

6. The air conditioner of claim 5, wherein said use-side refrigerant flow-rate control portion adjusts a flow rate of the use-side refrigerant to be supplied to said plurality of indoor units based on at least one of a temperature of the use-side refrigerant flowing into said plurality of indoor units and a temperature of the use-side refrigerant flowing out of said plurality of indoor units.

7. The air conditioner of claim 5, wherein said use-side refrigerant flow-rate control portion adjusts a flow rate of the use-side refrigerant to be supplied to said plurality of intermediate heat exchangers based on at least one of a temperature of the use-side refrigerant flowing into said plurality of intermediate heat exchangers and a temperature of the use-side refrigerant flowing out of said plurality of intermediate heat exchangers.

8. The air conditioner of claim 1, wherein at least one of water and an antifreezing solution is used for the use-side refrigerant to be circulated in said use-side refrigerant circuit.

9. The air conditioner of claim 1, wherein a natural refrigerant, or a refrigerant having a global warming coefficient smaller than a global warming coefficient of a fluorocarbon refrigerant, is used for the heat-source side refrigerant to be circulated in said heat-source side refrigerant circuit.

10. The air conditioner of claim 1, wherein in said plurality of intermediate heat exchangers, said heat-source side refrigerant heats said use-side refrigerant without condensation in a supercritical state.

11. The air conditioner of claim 1, wherein said plurality of indoor units are installed in a living space disposed on each floor of a building, respectively; and said outdoor unit and said relay portion are not installed in said living space.

12. The air conditioner of claim 11, wherein said relay portion is installed in a common space disposed in said building.

13. The air conditioner of claim 1, wherein the heat source side refrigerant is a refrigerant of which a standard for a permissible concentration of the refrigerant leaking into a space is determined by international standards, either water or antifreezing fluid is used for the use-side refrigerant, the plurality of indoor units are installed in a living space, the outdoor unit and the relay portion are installed outside the living space, the relay portion and each indoor units and are connected with two pipes, and the air conditioner is operable to perform both heating and cooling operations at the same time.

14. The air conditioner of claim 1, wherein said heat-source side refrigerant circuit includes a bypass pipeline which bypasses at least one of said plurality of intermediate heat exchangers disposed in said relay portion; and bypass refrigerant flow-rate control means disposed in said bypass pipeline, said bypass refrigerant flow-rate control means controlling a flow rate of the heat-source side refrigerant flowing through the bypass pipeline.

15. The air conditioner of claim 1, wherein said heat-source side refrigerant circuit includes a gas-liquid separator disposed on the inlet side of the first intermediate heat exchanger located on an upstream side of said relay portion;

a liquid-state refrigerant bypass pipeline for bypassing a liquid-state refrigerant separated by said gas-liquid separator to an outlet side of said first intermediate heat exchanger; and a liquid-state refrigerant flow-rate controller installed in said liquid-state refrigerant bypass pipeline , said liquid-state refrigerant flow-rate controller controlling a flow rate of the heat-source side refrigerant flowing through the liquid-state refrigerant bypass pipeline.

* * * * *